US010544783B2

(12) United States Patent
McCarthy

(10) Patent No.: US 10,544,783 B2
(45) Date of Patent: Jan. 28, 2020

(54) GAS COMPRESSOR AND SYSTEM AND METHOD FOR GAS COMPRESSING

(71) Applicant: I-JACK TECHNOLOGIES INCORPORATED, Moosomin (CA)

(72) Inventor: Dan McCarthy, Moosomin (CA)

(73) Assignee: I-JACK TECHNOLOGIES INCORPORATED, Moosomin, SK (CA)

( * ) Notice: Subject to any disclaimer, the term of this patent is extended or adjusted under 35 U.S.C. 154(b) by 0 days.

(21) Appl. No.: 16/147,188

(22) Filed: Sep. 28, 2018

(65) Prior Publication Data

US 2019/0032652 A1 Jan. 31, 2019

Related U.S. Application Data

(63) Continuation-in-part of application No. 15/786,369, filed on Oct. 17, 2017, now Pat. No. 10,087,924, (Continued)

(51) Int. Cl.
*F04B 49/00* (2006.01)
*F04B 35/00* (2006.01)
(Continued)

(52) U.S. Cl.
CPC ..... *F04B 49/002* (2013.01); *E21B 43/126* (2013.01); *F04B 9/113* (2013.01);
(Continued)

(58) Field of Classification Search
CPC ..... F04B 49/002; F04B 49/12; F04B 35/008; F04B 35/00; F04B 43/126; F04B 47/04;
(Continued)

(56) References Cited

U.S. PATENT DOCUMENTS 1,619,475 A 3/1927 Hubbard
2,946,316 A 7/1960 Bruehl
(Continued)

FOREIGN PATENT DOCUMENTS

CA 2165063 A1 3/1995
CA 2309970 C 7/1999
(Continued)

OTHER PUBLICATIONS

Brahma Compression Ltd., "CGR50 Casing Gas Recovery Unit", www.gascompressors.ca, before Apr. 21, 2016, 8 pages.
(Continued)

*Primary Examiner* — Nathan C Zollinger

(57) ABSTRACT

Methods and systems are provided to adaptively control a hydraulic fluid supply to supply a driving fluid for applying a driving force on a piston in a gas compressor, the driving force being cyclically reversed between a first direction and a second direction to cause the piston to reciprocate in strokes. During a first stroke of the piston, a speed of the piston, a temperature of the driving fluid, and a load pressure applied to the piston is monitored. Reversal of the driving force after the first stroke is controlled based on the speed, load pressure, and temperature.

20 Claims, 27 Drawing Sheets

Related U.S. Application Data which is a continuation of application No. 15/659,229, filed on Jul. 25, 2017.

(60) Provisional application No. 62/513,182, filed on May 31, 2017, provisional application No. 62/421,558, filed on Nov. 14, 2016.

(51) Int. Cl.

| | |
|---|---|
| ***F04B 47/04*** | (2006.01) |
| ***F04B 27/02*** | (2006.01) |
| ***F04B 9/113*** | (2006.01) |
| ***E21B 43/12*** | (2006.01) |
| ***F04B 49/12*** | (2006.01) |
| *E21B 4/00* | (2006.01) |

(52) U.S. Cl.

CPC ..... *F04B 27/02* (2013.01); *F04B 35/00* (2013.01); *F04B 47/04* (2013.01); *F04B 49/12* (2013.01); *E21B 4/00* (2013.01); *F04B 2201/0202* (2013.01); *F04B 2201/121* (2013.01); *F04B 2203/09* (2013.01)

(58) Field of Classification Search

CPC .. F04B 9/113; F04B 27/02; F04B 2201/0202; F04B 2201/121; F04B 2203/09; E21B 4/00

See application file for complete search history.

(56) References Cited

U.S. PATENT DOCUMENTS

| | | | | |
|---|---|---|---|---|
| 3,632,234 | A | 1/1972 | Lake | |
| 3,801,230 | A | 2/1974 | Brown | |
| 4,013,385 | A | 3/1977 | Peterson | |
| 4,380,150 | A | 4/1983 | Carlson | |
| 4,390,322 | A | 6/1983 | Budzich | |
| 4,515,516 | A | 5/1985 | Perone et al. | |
| 4,516,473 | A | 5/1985 | Oneyama et al. | |
| 4,653,986 | A * | 3/1987 | Ashton | F04B 49/002 417/243 |
| 4,761,118 | A * | 8/1988 | Zanarini | F04B 9/115 417/254 |
| 4,861,239 | A * | 8/1989 | Simmons | F04B 9/105 417/383 |
| 4,949,805 | A | 8/1990 | Mather et al. | |
| 4,990,058 | A * | 2/1991 | Eslinger | F04B 9/113 417/18 |
| 5,238,372 | A | 8/1993 | Morris | |
| 5,281,100 | A | 1/1994 | Diederich | |
| 5,450,901 | A | 9/1995 | Ellwood | |
| 5,481,873 | A | 1/1996 | Saruwatari et al. | |
| 5,584,664 | A | 12/1996 | Elliott et al. | |
| 5,622,478 | A | 4/1997 | Elliott et al. | |
| 5,743,716 | A | 4/1998 | Smith | |
| 5,782,612 | A | 7/1998 | Margardt | |
| 5,807,083 | A | 9/1998 | Tomoiu | |
| 5,868,122 | A | 2/1999 | Gram et al. | |
| 6,408,736 | B1 | 6/2002 | Holt et al. | |
| 6,422,313 | B1 | 7/2002 | Knight | |
| 6,568,911 | B1 | 5/2003 | Brightwell et al. | |
| 6,652,241 | B1 | 11/2003 | Alder | |
| 7,255,540 | B1 | 8/2007 | Cooper | |
| 7,527,482 | B2 * | 5/2009 | Ursan | F04B 9/107 417/212 |
| 7,730,939 | B2 | 6/2010 | Merrick, III | |
| 7,762,321 | B2 | 7/2010 | Fesi et al. | |
| 7,766,079 | B2 | 8/2010 | Hoffarth | |
| 8,046,990 | B2 | 11/2011 | Bollinger et al. | |
| 8,047,820 | B2 | 11/2011 | Merrick, III | |
| 8,066,496 | B2 | 11/2011 | Brown | |
| 8,136,586 | B2 | 3/2012 | Merrick, III | |
| 8,147,218 | B2 * | 4/2012 | Thrasher | F04B 47/08 417/384 |
| 8,161,741 | B2 | 4/2012 | Ingersoll et al. | |
| 8,226,370 | B2 * | 7/2012 | Wu | F15B 1/021 417/12 |
| 8,297,362 | B1 | 10/2012 | Strider et al. | |
| 8,387,375 | B2 | 3/2013 | Blieske | |
| 8,851,860 | B1 * | 10/2014 | Mail | F04B 47/02 166/105 |
| 9,109,511 | B2 | 8/2015 | Ingersoll et al. | |
| 9,359,876 | B2 | 6/2016 | Fink | |
| 9,605,805 | B2 | 3/2017 | Calvin et al. | |
| 9,745,975 | B2 * | 8/2017 | Dancek | E21B 43/126 |
| 9,816,497 | B2 * | 11/2017 | Strickland | F04B 25/04 |
| 10,072,487 | B2 * | 9/2018 | McCarthy | E21B 43/129 |
| 2004/0162658 | A1 | 8/2004 | Newman | |
| 2005/0103576 | A1 | 5/2005 | Engstrom | |
| 2005/0175476 | A1 | 8/2005 | Patterson | |
| 2007/0041847 | A1 | 2/2007 | Inoue et al. | |
| 2009/0194291 | A1 | 8/2009 | Fesi et al. | |
| 2009/0246049 | A1 | 10/2009 | Merrick, III | |
| 2010/0172771 | A1 | 7/2010 | Hoffarth | |
| 2012/0204548 | A1 | 8/2012 | Turnis et al. | |
| 2012/0224977 | A1 | 9/2012 | Sotz et al. | |
| 2012/0247785 | A1 | 10/2012 | Schmitt | |
| 2013/0094978 | A1 | 4/2013 | Hoffarth | |
| 2014/0093395 | A1 * | 4/2014 | Leavy | F04B 9/125 417/26 |
| 2014/0219830 | A1 * | 8/2014 | Strickland | F04B 25/04 417/212 |
| 2014/0231093 | A1 | 8/2014 | Hoell | |
| 2014/0294635 | A1 | 10/2014 | Rietkerk | |
| 2014/0353391 | A1 | 12/2014 | Burklin et al. | |
| 2015/0233368 | A1 | 8/2015 | Gallaway | |
| 2015/0240799 | A1 | 8/2015 | Obrejanu et al. | |
| 2015/0361970 | A1 * | 12/2015 | White | F04B 25/00 417/53 |
| 2016/0032911 | A1 | 2/2016 | McCoy | |
| 2016/0258426 | A1 * | 9/2016 | Tao | E21B 43/126 |
| 2017/0321526 | A1 * | 11/2017 | McCarthy | E21B 43/129 |

FOREIGN PATENT DOCUMENTS

| | | | |
|---|---|---|---|
| CA | 2353391 | A1 | 6/2000 |
| CA | 2331931 | A1 | 7/2002 |
| CA | 2379766 | C | 10/2004 |
| CA | 2644346 | A1 | 5/2010 |
| CA | 2803208 | A1 | 2/2012 |
| CA | 2891110 | A1 | 5/2013 |
| CA | 2599447 | C | 7/2013 |
| CA | 2843321 | C | 2/2015 |
| CA | 2861781 | C | 3/2016 |
| CN | 2445111 | Y | 8/2001 |
| CN | 1326050 | A | 12/2001 |
| CN | 201103527 | Y | 8/2008 |
| CN | 201103528 | Y | 8/2008 |
| CN | 201225264 | Y | 4/2009 |
| CN | 202108682 | U | 1/2012 |
| CN | 202360325 | U | 8/2012 |
| CN | 202674817 | U | 1/2013 |
| WO | 2011/079267 | A1 | 6/2011 |
| WO | 2011/079271 | A2 | 6/2011 |
| WO | 2012/012896 | A1 | 2/2012 |
| WO | 2013/064748 | A1 | 5/2013 |
| WO | 2013/071134 | A1 | 5/2013 |
| WO | 2013/177268 | A1 | 11/2013 |
| WO | 2014/113545 | A1 | 7/2014 |
| WO | 2016/037500 | A1 | 3/2016 |

OTHER PUBLICATIONS

Brittania Industries 2009 Inc., "Casing Gas Compressor Packages", www.brittaniaindustries.com, before Apr. 21, 2016, 2 pages.

Broadwind Energy and Safe North America, "CNG Boost™ (Hydraulic Compressor) System Operation and Technology Overview", www.bwen.com and www.safegas.it/en/, before Apr. 21, 2016, 3 pages.

Karl Bratt; Jonathan Haines; Andrew Hall; and Brandon Koster, "Project Proposal & Feasibility Study NaturaFill: Fuel for Thought",

(56) References Cited

OTHER PUBLICATIONS

© 2013, Karl Bratt, Jonathan Haines, Andrew Hall, Brandon Koster, and Calvin College, Updated: Dec. 9, 2013, 59 pages.
Karl Bratt; Jonathan Haines; and Brandon Koster, "Final Design Report NaturaFill: Fuel for Thought", © 2014, Karl Bratt, Jonathan Haines, Brandon Koster, and Calvin College, Updated: May 15, 2014, 112 pages.
Chemac Inc., "Hofer Piston compressors with hydraulic drive unit", www.chemacinc.com, before Apr. 21, 2016, 4 pages.
Corken, Inc. (A Unit of IDEX Corporation), "Sour Gas Compressors Oil & Natural Gas Applications", http://www.corken.com, Jul. 2015, 8 pages.
Hans Turck Gmbh & Co. KG, "Inductive sensor BI5-EM18-Y1X-H1141", www.turck.com, before Apr. 21, 2016, 4 pages.
Compact Compression Inc., "Casing Gas Compression", http://www.compactcompression.com, before Apr. 21, 2016, 32 pages.
Permian Production Equipment, Inc., "The Hydraulic Beam Gas Compressor® Your Solution When More Production is the Question", www.hydraulic.beamgascompressor.com, before Apr. 21, 2016, 4 pages.
Linde Hydraulics Gmbh & Co. KG, "HPV-02. Variable pumps for closed loop operation.", http://www.linde-hydraulics.com, before Apr. 21, 2016, 36 pages.
Hoerbiger, "Ring and packing Sealing systems for reciprocating compressors", http://www.hoerbiger.com, before Apr. 21, 2016, 24 pages.
Krzysztof Palka, "Understanding Sucker Rod Pump Operation with Hydraulic Jack", © Krzysztof Palka 2015, 27 pages.
Non-Final Office Action issued by the U.S. Patent and Trademark Office dated Sep. 1, 2017 in connection with U.S. Appl. No. 15/656,252, 25 pages.
Final Office Action issued by the U.S. Patent and Trademark Office dated Nov. 24, 2017 in connection with U.S. Appl. No. 15/656,252, 21 pages.
I-Jack Technologies Incorporated, "IJack DGAS Product Manual Publication No. 800-0030 Rev 2.1", before before May 31, 2017, 34 pages.
Non-Final Office Action issued by the U.S. Patent and Trademark Office dated Feb. 20, 2018 in connection with U.S. App. No. 15/822,035, 27 pages.
Non-Final Office Action issued by the U.S. Patent and Trademark Office dated Feb. 15, 2019 in connection with U.S. App. No. 15/659,229, 19 pages.
Non-Final Office Action issued by the U.S. Patent and Trademark Office dated Oct. 18, 2018 in connection with U.S. App. No. 16/059,891, 8 pages.
Non-Final Office Action issued by the U.S. Patent and Trademark Office dated Jan. 17, 2018 in connection with U.S. App. No. 15/786,369, 13 pages.

* cited by examiner

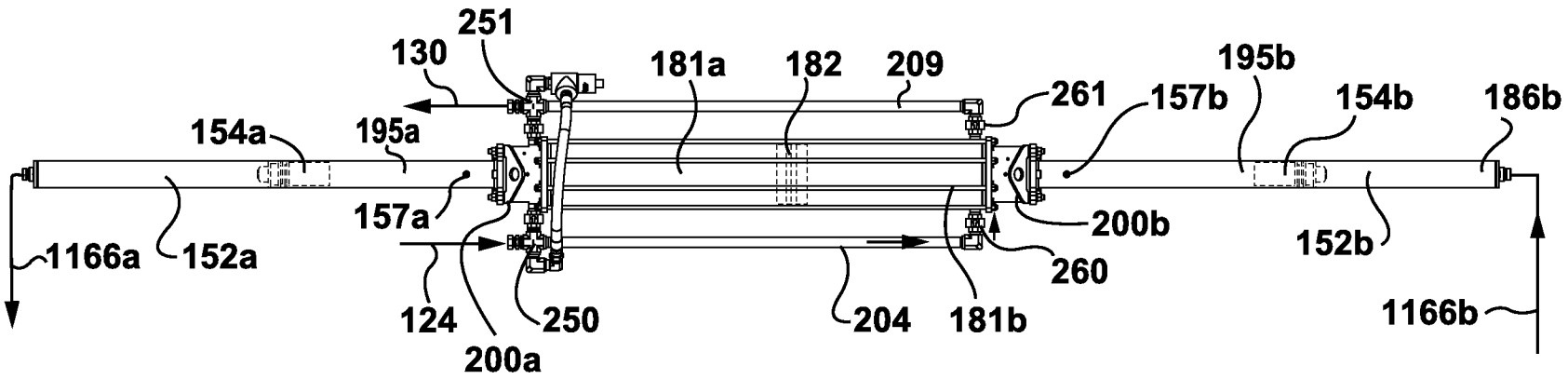
FIG. 3 (ii)

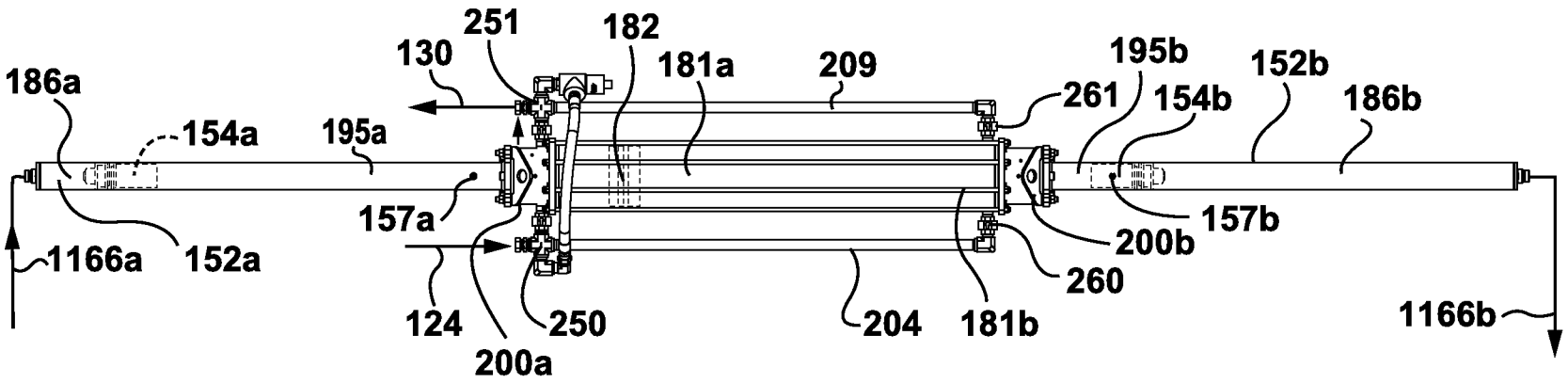
FIG. 3 (iii)

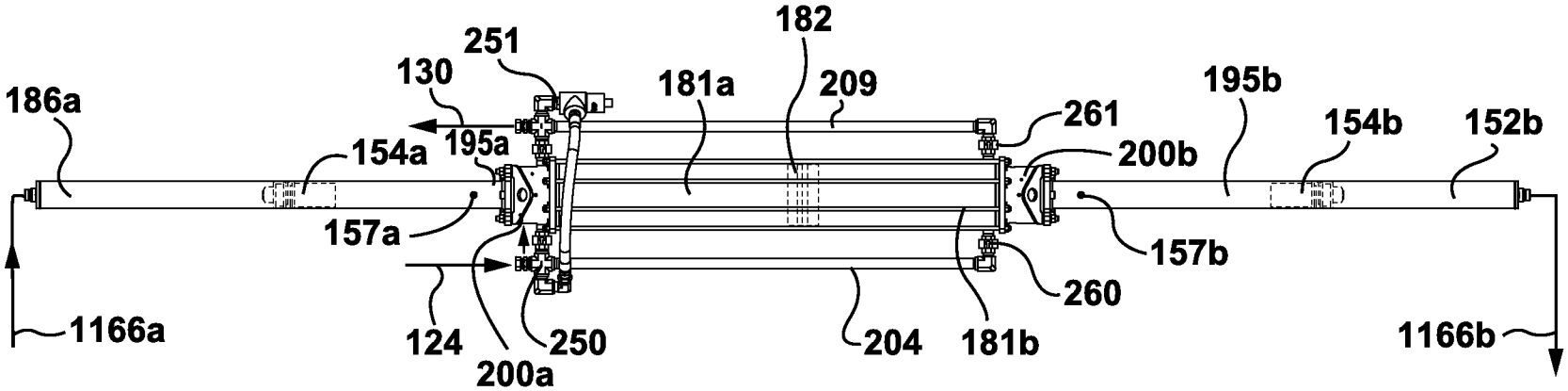
FIG. 3 (iv)

180
157a
157b
154a
154b
158a
158b
159a
159b
160a
160b
182

GAS COMPRESSOR AND SYSTEM AND METHOD FOR GAS COMPRESSING

CROSS-REFERENCE TO RELATED APPLICATION

This application is a Continuation-in-part of U.S. patent application Ser. No. 15/786,369, filed Oct. 17, 2017, which is a Continuation of U.S. patent application Ser. No. 15/659,229, filed Jul. 25, 2017, which claims the benefit of, and priority from, U.S. Provisional Patent Application No. 62/513,182, filed May 31, 2017, and U.S. Provisional Patent Application No. 62/421,558, filed Nov. 14, 2016. The entire contents of each of the aforementioned applications are incorporated by reference herein.

TECHNICAL FIELD

The present disclosure relates to systems and methods for gas compressing, and gas compressors driven by a driving fluid such as a hydraulic fluid, including hydraulic gas compressors driven by hydraulic fluid that are used in oil and gas field applications.

BACKGROUND

Various different types of gas compressors to compress a wide range of gases are known. Hydraulic gas compressors in particular are used in a number of different applications. One such category of, and application for, gas compressors is a gas compressor employed in connection with the operation of oil and gas producing well systems. When oil is extracted from a reservoir using a well and pumping system, it is common for natural gas, often in solution, to also be present within the reservoir. As oil flows out of the reservoir and into the well, a wellhead gas may be formed as it travels into the well and may collect within the well and/or travel within the casing of the well. The wellhead gas may be primarily natural gas and also includes impurities such as water, hydrogen sulphide, crude oil, and natural gas liquids (often referred to as condensate).

The presence of natural gas within the well can have negative impacts on the functioning of an oil and gas producing well system. It can for example create a back pressure on the reservoir at the bottom of the well shaft that inhibits or restricts the flow of oil to the well pump from the reservoir. Accordingly, it is often desirable to remove the natural gas from the well shaft to reduce the pressure at the bottom of the well shaft, particularly in the vicinity of the well pump. Natural gas that migrates into the casing of the well shaft may be drawn upwards—such as by venting to atmosphere or connecting the casing annulus to a pipe that allows for gas to flow out of the casing annulus. To further improve the flow of gas out of the casing annulus and reduce the pressure of the gas at the bottom of the well shaft, the natural gas flowing from the casing annulus may be compressed by a gas compressor and then may be utilized at the site of the well and/or transported for use elsewhere. The use of a gas compressor will further tend to create a lower pressure at the top of the well shaft compared to the bottom of the well shaft, assisting in the flow of natural gas upwards within the well bore and casing.

There are concerns in using hydraulic gas compressors in oil and gas field environments, relating to the potential contamination of the hydraulic fluid in the hydraulic cylinder of a gas compressor from components of the natural gas that is being compressed.

There are additional concerns in inefficient hydraulic gas compressor operation and increased costs associated with using such compressors.

Improved gas compressors and control systems and methods are desirable, including gas compressors employed in connection with oil and gas field operations including in connection with oil and gas producing wells.

SUMMARY

In an aspect of the disclosure, there is provided a method of adaptively controlling a hydraulic fluid supply to supply a driving fluid for applying a driving force on a piston in a hydraulic gas compressor, such as a double action hydraulic gas compressor. During operation, the driving force is cyclically reversed between a first direction and a second direction to cause the piston to reciprocate in strokes. During a stroke of the piston, a speed of the piston, a temperature of the driving fluid, and a load pressure applied to the piston are monitored. Reversal of the driving force after the stroke is controlled based on the speed, temperature, and load pressure.

In selected embodiments, the reversal timing may be controlled primarily based on the speed of the piston, but with other minor considerations, such as load pressure and driving fluid temperature. A pair of proximity sensors may be used to detect the piston speed and whether the piston reaches predefined end of stroke positions.

Conveniently, such control based on the monitored speed, temperature, and load pressure allows quick adjustment of the timing of reversing the driving force applied on the compressor piston in real-time to achieve both smooth transition between strokes and near maximum compression efficiency, under varying environment and operation conditions.

In an embodiment, the present disclosure relates to a method of adaptively controlling a hydraulic fluid supply to supply a driving fluid for applying a driving force on a piston in a gas compressor, the driving force being cyclically reversed between a first direction and a second direction to cause the piston to reciprocate in strokes, the method comprising monitoring, during a first stroke of the piston, a speed of the piston, a temperature of the driving fluid, and a load pressure applied to the piston; and controlling reversal of the driving force after the first stroke based on the speed, load pressure, and temperature.

In another embodiment, the present disclosure relates to a control system for adaptively controlling a hydraulic fluid supply to supply a driving fluid for applying a driving force on a piston in a gas compressor, the driving force being cyclically reversed between a first direction and a second direction to cause the piston to reciprocate in strokes. The system comprises first and second proximity sensors positioned and configured to respectively generate a first signal indicative of a first time (T1) when a first part of the piston is in proximity of the first proximity sensor, and a second signal indicative of a second time (T2) when a second part of the piston is in a proximity of the second proximity sensor, whereby a speed of the piston during a first stroke of the piston is calculable based on T1, T2 and a distance between the first and second proximity sensors; a temperature sensor positioned and configured to generate a signal indicative of a temperature of the driving fluid; and a controller configured to receive signals from the sensors and for controlling the hydraulic fluid supply to control reversal of the driving force based on the speed of the piston, the temperature of the driving fluid, and the load pressure applied to the piston during the first stroke. In an embodiment of this system, the piston may comprise first and second axially extending and spaced apart grooves each having an end, and each one of the first and second parts of the piston may be one of the ends of the first and second grooves. Each one of the first and second grooves may have another end configured and positioned to cause a respective one of the first and second proximity sensors to generate a signal indicative of an end of stroke position of the piston when the other end is in proximity of the respective one of the first and second proximity sensors.

In a further embodiment, the present disclosure relates a gas compressing system comprising a gas compressor comprising a gas chamber for receiving a gas, having a first end and a second end; and a gas piston reciprocally moveable in the gas chamber for compressing the gas towards the first or second end; a hydraulic fluid supply for supplying a driving fluid to apply a driving force to the gas piston, the driving force cyclically reversible between a first direction and a second direction to cause the gas piston to reciprocate in strokes; and a control system according to the preceding paragraph for controlling the hydraulic fluid supply and the driving force applied to the gas piston. The gas compressor may comprise first and second hydraulic cylinders, each comprising a driving fluid chamber for receiving the driving fluid and a hydraulic piston moveably disposed therein and coupled to the gas piston, such that reciprocal movement of the hydraulic piston causes corresponding reciprocal movement of the gas piston. The hydraulic piston may comprise an axially extending groove having an end configured and positioned to function as one of the first and second parts of the piston. The groove may have another end configured and positioned to cause a respective one of the first and second proximity sensors to generate a signal indicative of an end of stroke position of the piston when the other end is in proximity of the respective one of the first and second proximity sensors.

In another embodiment, the present disclosure relates to a gas compressor comprising a gas cylinder comprising a gas chamber and a gas piston reciprocally moveable within the gas chamber for compressing a gas in the gas chamber, the gas piston having a first end and a second end; a first hydraulic cylinder coupled to the first end of the gas piston, and a second hydraulic cylinder coupled to the second end of the gas piston, wherein each one of the first and second hydraulic cylinders comprises a driving fluid chamber for receiving a driving fluid and a hydraulic piston moveably disposed in the driving fluid chamber and coupled to the gas piston such that reciprocal movement of the hydraulic piston causes corresponding reciprocal movement of the gas piston, the hydraulic piston comprising an axially extending groove thereon, the groove having a first end and a second end; and a first proximity sensor on the first hydraulic cylinder and a second proximity sensor on the second hydraulic cylinder, for detecting positions and movement of the gas piston, wherein the grooves of the hydraulic pistons and the first and second proximity sensors are configured and positioned to cause a corresponding one of the first and second proximity sensors to generate a signal indicative of a position of the gas piston when one of the first and second ends of the grooves is in proximity of the corresponding proximity sensor. Each one of the first ends of the grooves may be positioned to indicate an end of stroke position of the gas piston, and the second ends of the grooves may be positioned for measuring a speed of the gas piston during a stroke. The first ends of the grooves may be far ends away from the gas piston and the second ends of the grooves may be near ends close to the gas piston. The gas compressor may also comprise a controller configured to receive signals from the first and second proximity sensors and for controlling reversal of a driving force applied by the driving fluid based on the signals received from the first and second proximity sensors.

In another embodiment, the present disclosure relates to a gas compressor system that comprises a controller; a gas compressor that comprises a first driving fluid cylinder having a first driving fluid chamber adapted for containing a first driving fluid therein, and a first driving fluid piston movable within the first driving fluid chamber; a gas compression cylinder having a gas compression chamber comprising a first end and a second end, the gas compression chamber adapted for holding a gas therein and a gas piston reciprocally movable within the gas compression chamber between the first and the second end for compressing a gas; a second driving fluid cylinder having a second driving fluid chamber adapted for containing a second driving fluid therein, and a second driving fluid piston movable within the second driving fluid chamber; the first and second driving fluid cylinders located at each end of the gas compression cylinder and each of the first and second driving fluid pistons connected to the gas piston for axially driving the gas piston between the first and the second end; a first and a second proximity sensor respectively coupled to the first and second driving fluid cylinders, the first and second proximity sensors respectively operable to indicate a first and second time when a pre-defined portion of the first and the second driving fluid pistons is proximal to a respective one of the sensors and send the first and the second time to the controller in response thereto, the controller for determining a speed of movement of the gas piston within the gas compression chamber between the first and second end based on the first and second time; a temperature sensor coupled to one of the driving fluid cylinders and operable to detect a temperature of a respective one of the driving fluids and provide a temperature signal indicative of the temperature to the controller; a pressure sensor coupled to the driving fluid cylinders and operable to detect a pressure difference between the first and second driving fluids and provide a pressure signal indicative of the pressure difference to the controller; and the controller in communication with the temperature sensor, the pressure sensor and the first and second proximity sensors, the controller configured to control the flow of driving fluid into and out of each of the driving fluid chambers for causing a subsequent movement of the gas piston in an opposite direction between the second end and the first end in a second other stroke in response to the pressure signal, the temperature signal and the speed.

In another embodiment, the present disclosure relates to a gas compressor system that comprises a driving fluid cylinder having a driving fluid chamber adapted for containing a driving fluid therein, and a driving fluid piston movable within the driving fluid chamber. A gas compression cylinder having a gas compression chamber adapted for holding a gas therein and a gas piston movable within the gas compression chamber. A buffer chamber located between the driving fluid chamber and the gas compression chamber, the buffer chamber adapted to inhibit movement of at least one non-driving fluid component, when gas is located within the gas compression chamber, from the gas compression chamber into the driving fluid chamber.

In another embodiment, the present disclosure relates to a gas compressor system that comprises a first driving fluid cylinder having a first driving fluid chamber adapted for containing a first driving fluid therein, and a first driving fluid piston movable within the first driving fluid chamber. A gas compression chamber adapted for holding a gas therein and a gas piston movable within the gas compression chamber. A first buffer chamber located between the first driving fluid chamber and a first section of the gas compression chamber. A second driving fluid cylinder having a second driving fluid chamber adapted for containing a second driving fluid therein, and a second driving fluid piston movable within the second driving fluid chamber. A second buffer chamber located between the first driving fluid chamber and a second section of the gas compression chamber. The first buffer chamber is adapted to inhibit movement of at least one non-driving fluid component, when gas is located within a first section of the gas compression chamber, from the first section gas compression chamber section into the first driving fluid chamber. The second buffer chamber is adapted to inhibit movement of at least one non-driving fluid component, when gas is located within a second section of the gas compression chamber, from the second section of the gas compression chamber into the second driving fluid chamber.

In a further embodiment, the present disclosure relates to a gas compressor that comprises a driving fluid cylinder having a driving fluid chamber operable for containing a driving fluid therein and a driving fluid piston movable within the driving fluid chamber. A gas compression cylinder having a gas compression chamber operable for holding a gas therein and a gas piston movable within the gas compression chamber. A buffer chamber located between the driving fluid chamber and the gas compression chamber, the buffer chamber configured and operable to inhibit movement of at least one non-driving fluid component from the gas compression chamber to substantially avoid contamination of the driving fluid, when gas is located within the gas compression chamber.

In another embodiment, the present disclosure relates to a gas compressor that comprises a driving fluid cylinder having a driving fluid chamber operable for containing a driving fluid therein and a driving fluid piston movable within the driving fluid chamber. A gas compression cylinder having a gas compression chamber operable for holding natural gas therein and a gas piston movable within the gas compression chamber. A buffer chamber located between the driving fluid chamber and the gas compression chamber, the buffer chamber containing a non-natural gas component so as to substantially avoid contamination of the driving fluid in the driving fluid chamber, when gas is located within the gas compression chamber.

In some embodiments, it is desirable to provide a gas compressor system that can compensate for variances within the system which can alter the gas compression. Further, it is also desirable to achieve a smooth transition of a piston moving within the gas compression chamber to cause said gas compression, between a drive stroke providing movement to the right and a drive stroke providing movement to the left, in order to provide longer equipment life of the gas compressor system and to reduce wear of the system. It is further desirable for the drive stroke of the piston to travel along a pre-defined distance of the gas compression chamber (e.g. close to a full length of the chamber) in order to achieve maximum gas compression without physically abutting the ends of the gas compression chamber.

In at least some of the embodiments presented herein, the buffer chamber described herein may not be needed within the gas compressor system which adaptively controls a gas compressor to improve gas compression.

BRIEF DESCRIPTION OF THE DRAWINGS

In the figures, which illustrate example embodiments.

DETAILED DESCRIPTION

Figure 1:
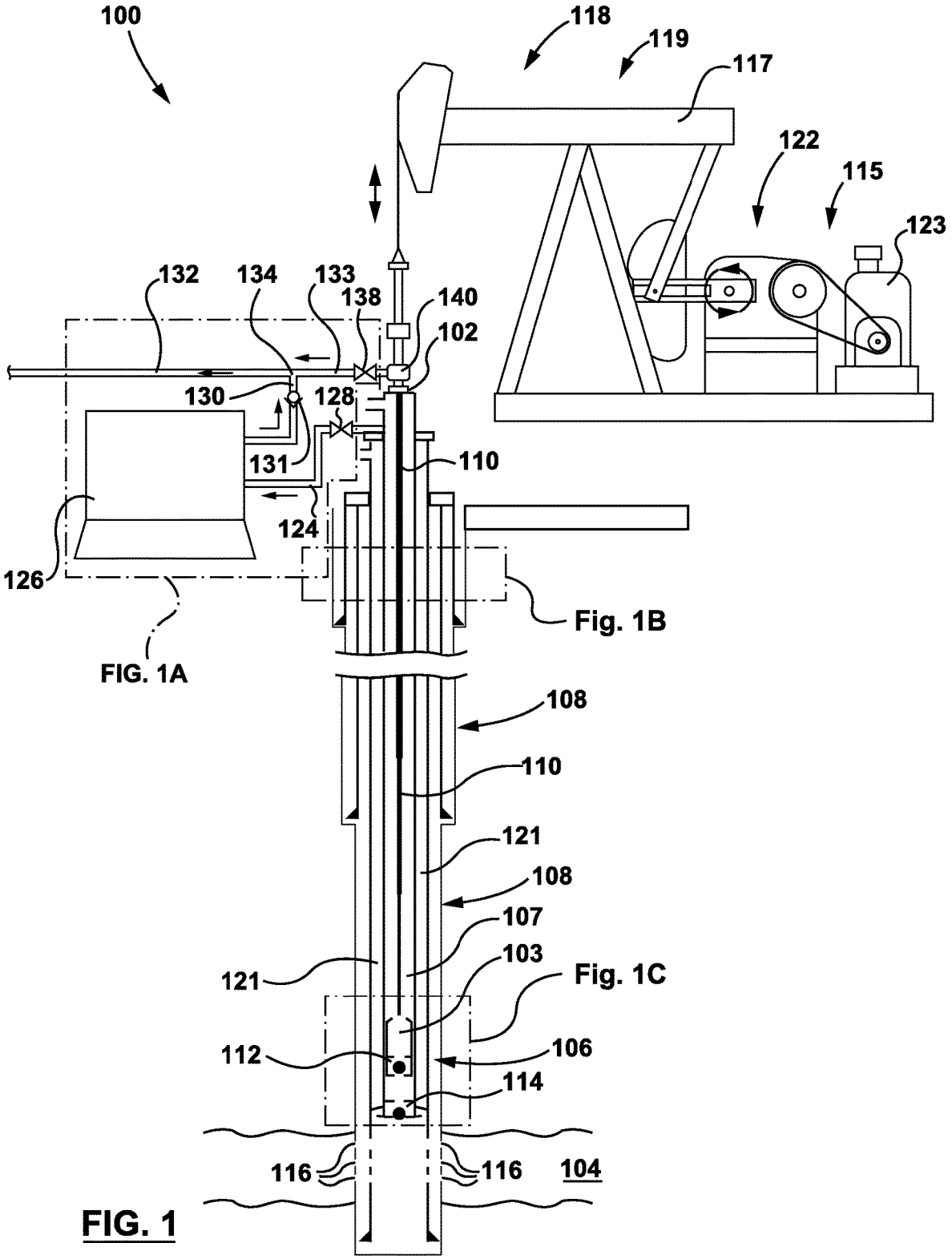
FIG. 1 is a schematic view of an oil and gas producing well system.
Figure 1A:
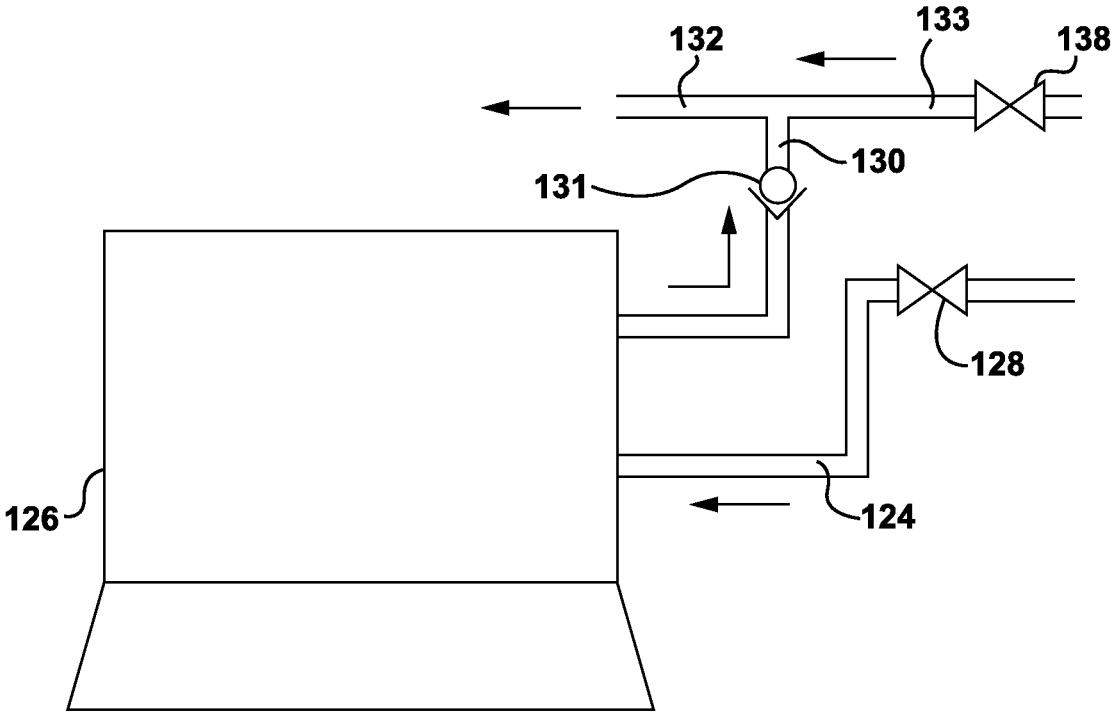
FIG. 1A is an enlarged schematic view of a portion of the system of FIG. 1.
Figure 1B:
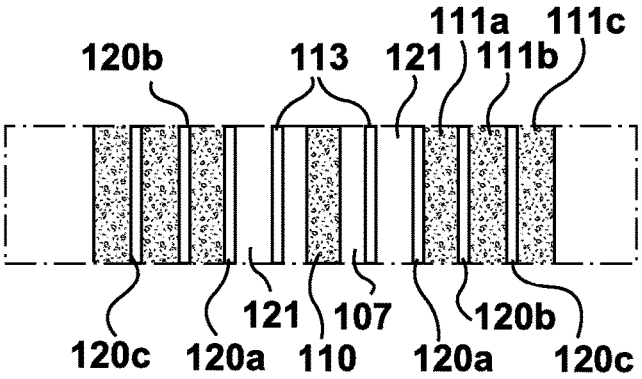
FIG. 1B is an enlarged view of part of the system of FIG. 1.

With reference to FIGS. 1, 1A, 1B and 1C, an example oil and gas producing well system 100 is illustrated schematically that may be installed at, and in, a well shaft (also referred to as a well bore) 108 and may be used for extracting liquid and/or gases (e.g. oil and/or natural gas) from an oil and gas bearing reservoir 104.

Extraction of liquids including oil as well as other liquids such as water from reservoir 104 may be achieved by operation of a down-well pump 106 positioned at the bottom of well shaft 108. For extracting oil from reservoir 104, down-well pump 106 may be operated by the up-and-down reciprocating motion of a sucker rod 110 that extends through the well shaft 108 to and out of a well head 102. It should be noted that in some applications, well shaft 108 may not be oriented entirely vertically, but may have horizontal components and/or portions to its path.

Well shaft 108 may have along its length, one or more generally hollow cylindrical tubular, concentrically positioned, well casings 120*a*, 120*b*, 120*c*, including an innermost production casing 120*a* that may extend for substantially the entire length of the well shaft 108. Intermediate casing 120*b* may extend concentrically outside of production casing 120*a* for a substantial length of the well shaft 108, but not to the same depth as production casing 120*a*. Surface casing 120*c* may extend concentrically around both production casing 120*a* and intermediate casing 120*b*, but may only extend from proximate the surface of the ground level, down a relatively short distance of the well shaft 108. The casings 120*a*, 120*b*, 120*c* may be made from one or more suitable materials such as for example steel. Casings 120*a*, 120*b*, 120*c* may function to hold back the surrounding earth/other material in the sub-surface to maintain a generally cylindrical tubular channel through the sub-surface into the oil/natural gas bearing formation 104. Casings 120*a*, 120*b*, 120*c* may each be secured and sealed by a respective outer cylindrical layer of material such as layers of cement 111*a*, 111*b*, 111*c* which may be formed to surround casings 120*a*-120*c* in concentric tubes that extend substantially along the length of the respective casing 120*a*-120*c*. Production tubing 113 may be received inside production casing 120*a* and may be generally of a constant diameter along its length and have an inner tubing passageway/annulus to facilitate the communication of liquids (e.g. oil) from the bottom region of well shaft 108 to the surface region. Casings 120*a*-120*c* generally, and casing 120*a* in particular, can protect production tubing 120 from corrosion, wear/damage from use. Along with other components that constitute a production string, a continuous passageway (a tubing annulus) 107 from the region of pump 106 within the reservoir 104 to well head 102 is provided by production tubing 113. Tubing annulus 107 provides a passageway for sucker rod 110 to extend and within which to move and provides a channel for the flow of liquid (oil) from the bottom region of the well shaft 108 to the region of the surface.

An annular casing passageway or gap 121 (referred to herein as a casing annulus) is typically provided between the inward facing generally cylindrical surface of the production casing 120*a* and the outward facing generally cylindrical surface of production tubing 113. Casing annulus 121 typically extends along the co-extensive length of inner casing 120*a* and production tubing 113 and thus provides a passageway/channel that extends from the bottom region of well shaft 108 proximate the oil/gas bearing formation 104 to the ground surface region proximate the top of the well shaft 108. Natural gas (that may be in liquid form in the reservoir 104) may flow from reservoir 104 into the well shaft 108 and may be, or transform into, a gaseous state and then flow upwards through casing annulus 121 towards well head 102. In some situations, such as with a newly formed well shaft 108, the level of the liquid (mainly oil and natural gas in solution) may actually extend a significant way from the bottom/end of the well shaft 108 to close to the surface in both the tubing annulus 107 and the casing annulus 121, due to relatively high downhole pressures.

Down-well pump 106 may have a plunger 103 that is attached to the bottom end region of sucker rod 110 and plunger 103 may be moved downwardly and upwardly within a pump chamber by sucker rod 110. Down well pump 106 may include a one way travelling valve 112 which is a mobile check valve which is interconnected with plunger 103 and which moves in up and down reciprocating motion with the movement of sucker rod 110. Down well pump 106 may also include a one way standing intake valve 114 that is stationary and attached to the bottom of the barrel of pump 106/production tubing 113. Travelling valve 112 keeps the liquid (oil) in the channel 107 of production tubing 113 during the upstroke of the sucker rod 110. Standing valve 114 keeps the fluid (oil) in the channel 107 of the production tubing 113 during the downstroke of sucker rod 110. During a downstroke of sucker rod 110 and plunger 103, travelling valve 112 opens, admitting liquid (oil) from reservoir 104 into the annulus of production tubing 113 of down-well pump 106. During this downstroke, one-way standing valve 114 at the bottom of well shaft 108 is closed, preventing liquid (oil) from escaping.

During each upstroke of sucker rod 110, plunger 103 of down-well pump 106 is drawn upwardly and travelling valve 112 is closed. Thus, liquid (oil) drawn in through one-way valve 112 during the prior downstroke can be raised. And as standing valve 114 opens during the upstroke, liquid (oil) can enter production tubing 113 below plunger 103 through perforations 116 in production casing 120*a* and cement layer 111*a*, and past standing valve 114. Successive upstrokes of down-well pump 106 form a column of liquid/oil in well shaft 108 above down-well pump 106. Once this column of liquid/oil is formed, each upstroke pushes a volume of oil toward the surface and well head 102. The liquid/oil, eventually reaches a T-junction device 140 which has connected thereto an oil flow line 133. Oil flow line 133 may contain a valve device 138 that is configured to permit oil to flow only towards a T-junction interconnection 134 to be mixed with compressed natural gas from piping 130 that is delivered from a gas compressor system 126 and then together both flow way in a main oil/gas output flow line 132.

Sucker rod 110 may be actuated by a suitable lift system 118 that may for example as illustrated schematically in FIG. 1, be a pump jack system 119 that may include a walking beam mechanism 117 driven by a pump jack drive mechanism 120 (often referred to as a prime mover). Prime mover 120 may include a motor 123 that is powered for example by electricity or a supply of natural gas, such as for example, natural gas produced by oil and gas producing well system 100. Prime mover 120 may be interconnected to and drive a rotating counter weigh device 122 that may cause the pivoting movement of the walking beam mechanism 120 that causes the reciprocating upward and downward movement of sucker rod 110.

Figure 1C:
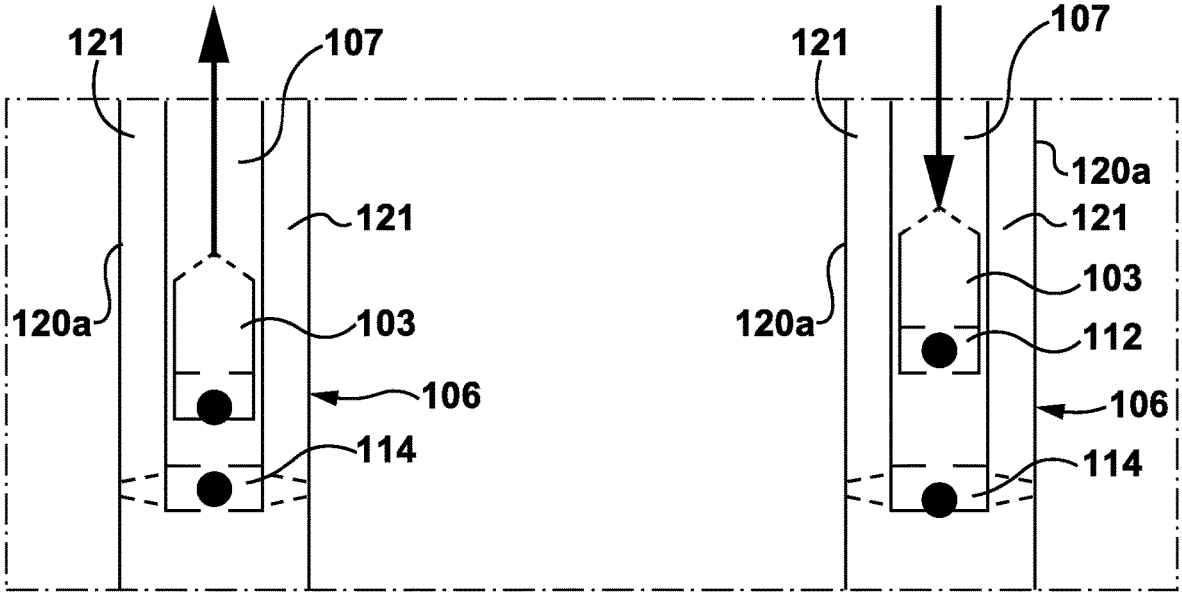
FIG. 1C is an enlarged view of another part of the system of FIG. 1.
Figure 1D:
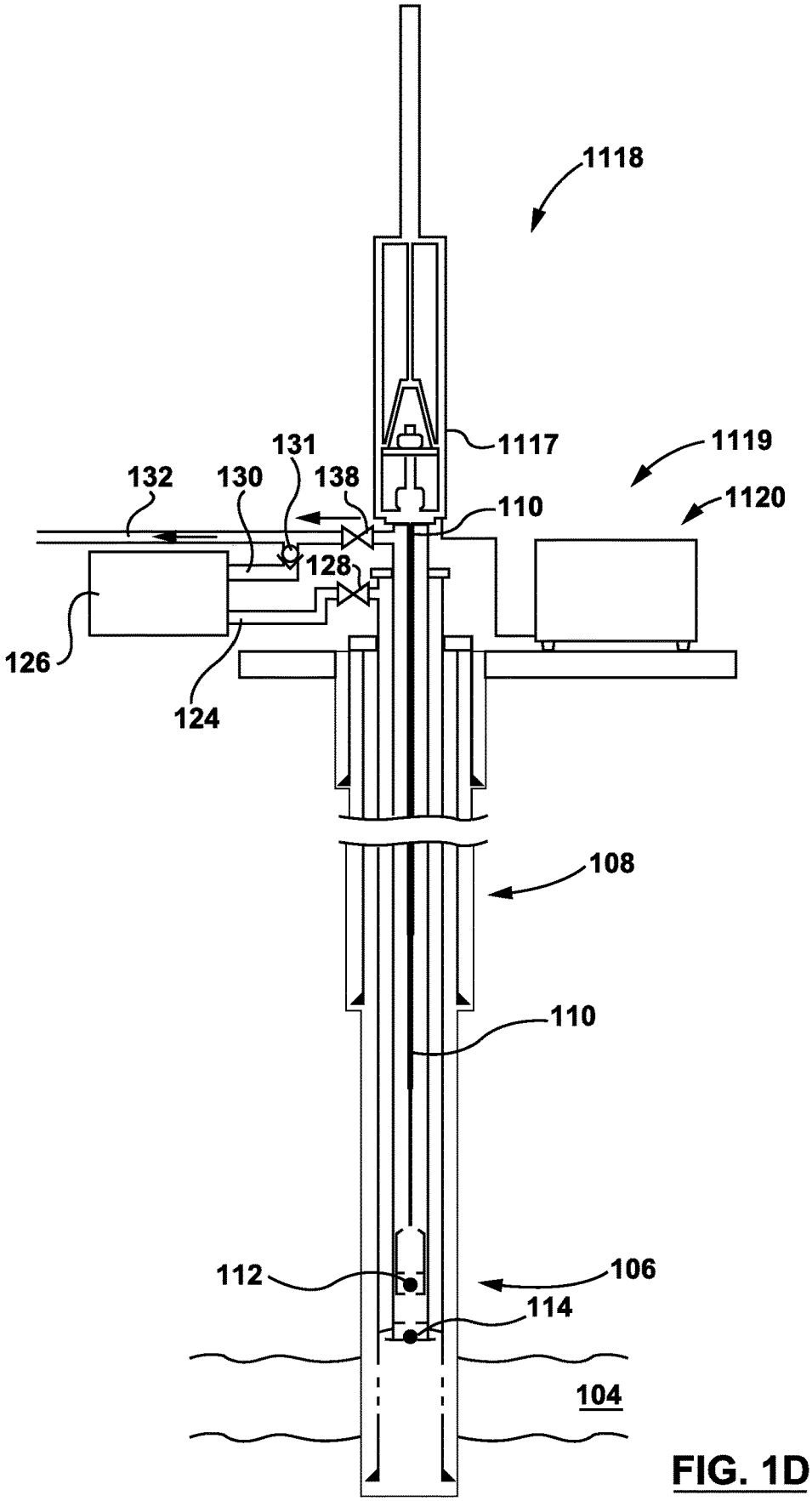
FIG. 1D is a schematic view of an oil and gas well producing system like the system of FIG. 1 but with an alternate lift system.

As shown in FIG. 1D, lift mechanism 1118 may in other embodiments be a hydraulic lift system 1119 that includes a hydraulic fluid based power unit 1120 that supplies hydraulic fluid through a fluid supply circuit to a master cylinder apparatus 1117 to controllably raise and lower the sucker rod 110. The power unit 1120 may include a suitable controller to control the operation of the hydraulic lift system 1119.

With reference to FIGS. 1 to 1C, natural gas exiting from annulus 121 of casing 120 may be fed by suitable piping 124 through valve device 128 to interconnected gas compressor system 126. Piping 124 may be made of any suitable material(s) such as steel pipe or flexible hose such as Aeroquip FC 300 AOP elastomer tubing made by Eaton Aeroquip LLC. In normal operation of system 100, the flow of natural gas communicated through piping 124 to gas compressor system 126 is not restricted by valve device 128 and the natural gas will flow there through. Valve 128 may be closed (e.g. manually) if for some reason it is desired to shut off the flow of natural gas from annulus 121.

Compressed natural gas that has been compressed by gas compressor system 126 may be communicated via piping 130 through a one way check valve device 131 to interconnect with oil flow line 133 to form a combined oil and gas flow line 132 which can deliver the oil and gas therein to a destination for processing and/or use. Piping 130 may be made of any suitable material(s) such as steel pipe or flexible hose such as Aeroquip FC 300 AOP elastomer tubing made by Eaton Aeroquip LLC.

Gas compressor system 126 may include a gas compressor 150 that is driven by a driving fluid. As indicated above, natural gas from casing annulus 121 of well shaft 108 may be supplied by piping 124 to gas compressor system 126. Natural gas may be compressed by gas compressor 150 and then communicated via piping 130 through a one way check valve device 131 to interconnect with oil flow line 133 to form combined oil and gas flow line 132.

The driving fluid for driving gas compressor 150 may be any suitable fluid such as a fluid that is substantially incompressible, and may contain anti-wear additives or constituents. The driving fluid may, for example, be a suitable hydraulic fluid. For example, the hydraulic fluid may be SKYDROL™ aviation fluid manufactured by Solutia Inc. The hydraulic fluid may for example be a fluid suitable as an automatic transmission fluid, a mineral oil, a bio-degradable hydraulic oil, or other suitable synthetic or semi-synthetic hydraulic fluid.

Figure 10A:
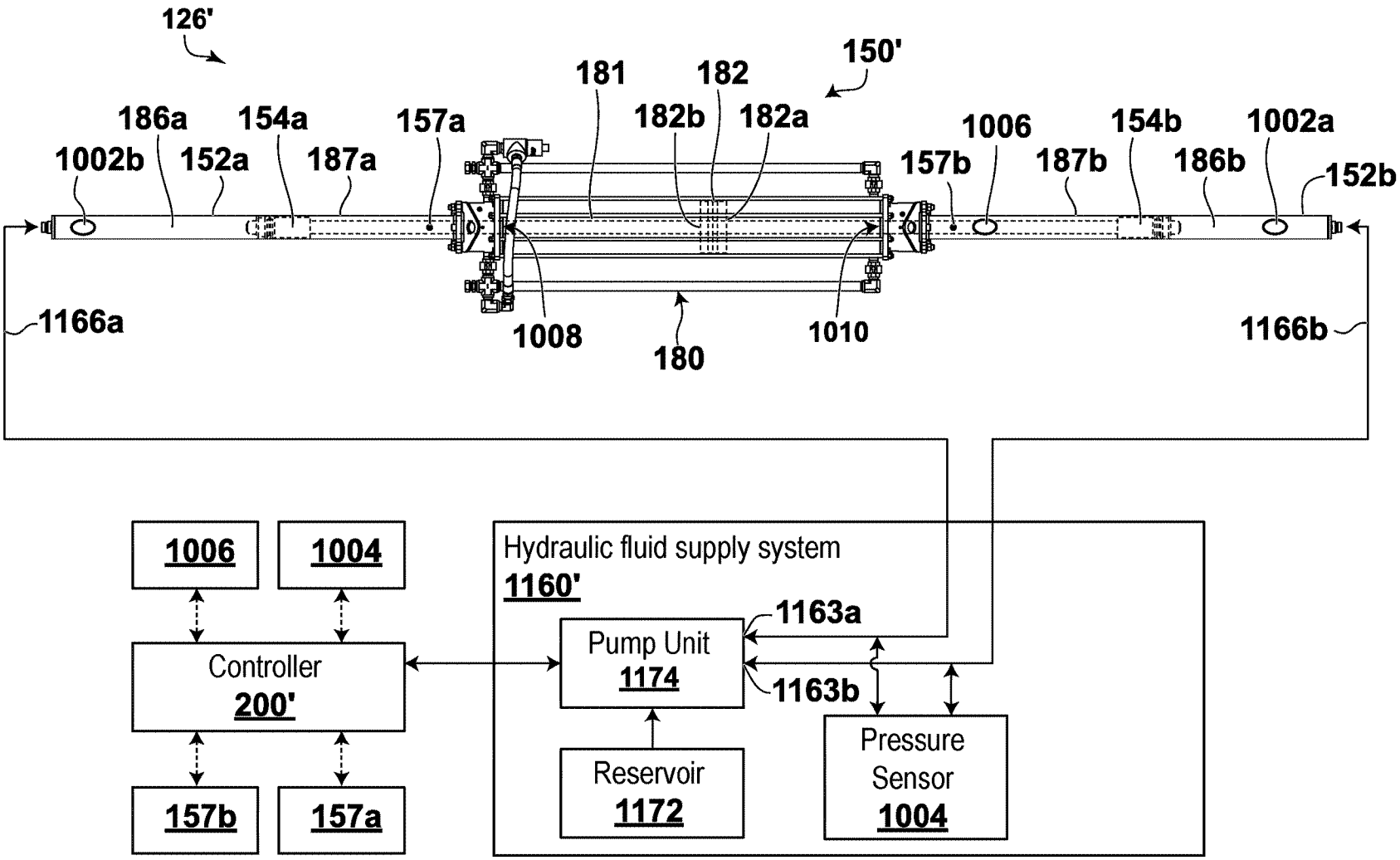
FIG. 10A is a schematic diagram of an gas compressor system.

Hydraulic gas compressor 150 may be in hydraulic fluid communication with a hydraulic fluid supply system which may provide an open loop or closed loop hydraulic fluid supply circuit. For example gas compressor 150 may be in hydraulic fluid communication with a hydraulic fluid supply system 1160 as depicted in FIG. 10A.

Figure 2:
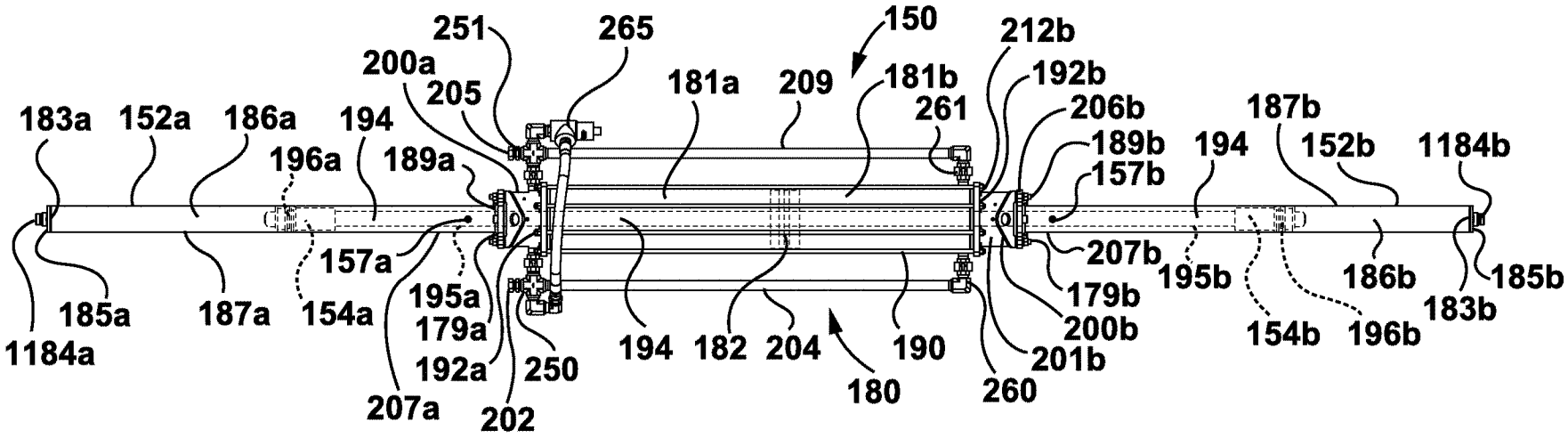
FIG. 2 is a side view of a gas compressor forming part of the system of FIG. 1.
Figure 7:
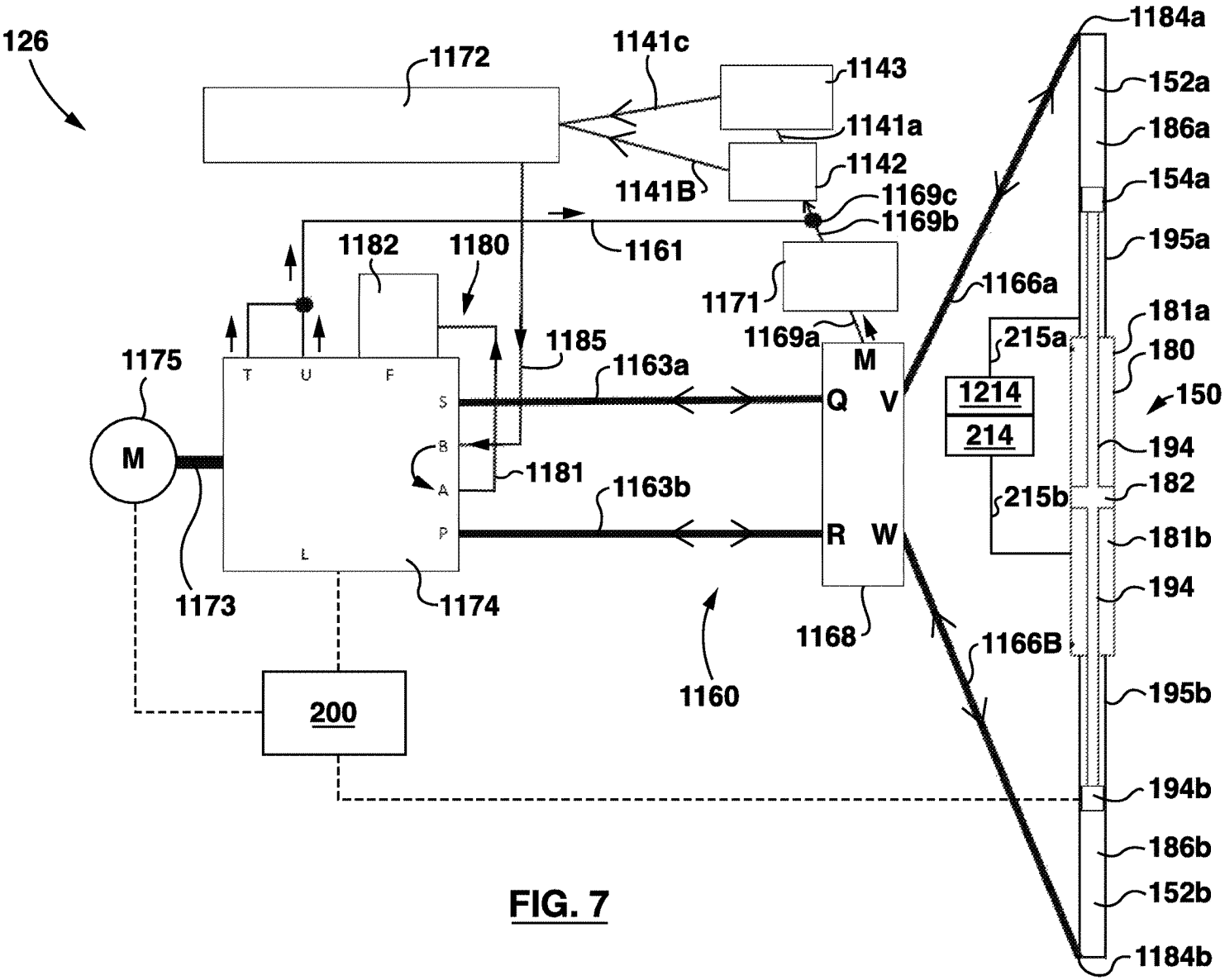
FIG. 7 is a schematic diagram a gas compressor system including the gas compressor of FIG. 2.

Turning now to FIGS. 2 and 7, hydraulic gas compressor 150 may have first and second, one-way acting, hydraulic cylinders 152*a*, 152*b* positioned at opposite ends of hydraulic gas compressor 150. Cylinders 152*a*, 152*b* are each configured to provide a driving force that acts in an opposite direction to each other, both acting inwardly towards each other and towards a gas compression cylinder 180. Thus, positioned generally inwardly between hydraulic cylinders 152*a*, 152*b* is gas compression cylinder 180. Gas compression cylinder 180 may be divided into two gas compression chamber sections 181*a*, 181*b* by a gas piston 182. In this way, gas such as natural gas in each of the gas chamber sections 181*a*, 181*b*, may be alternately compressed by alternating, inwardly directed driving forces of the hydraulic cylinders 152*a*, 152*b* driving the reciprocal movement of gas piston 182 and piston rod 194

Gas compression cylinder 180 and hydraulic cylinders 152*a*, 152*b* may have generally circular cross-sections although alternately shaped cross sections are possible in some embodiments.

Hydraulic cylinder 152*a* may have a hydraulic cylinder base 183*a* at an outer end thereof. A first hydraulic fluid chamber 186*a* may thus be formed between a cylinder barrel/tubular wall 187*a*, hydraulic cylinder base 183*a* and hydraulic piston 154*a*. Hydraulic cylinder base 183*a* may have a hydraulic input/output fluid connector 1184*a* that is adapted for connection to hydraulic fluid communication line 1166*a*. Thus hydraulic fluid can be communicated into and out of first hydraulic fluid chamber 186*a*.

At the opposite end of gas compressor 150, is a similar arrangement. Hydraulic cylinder 152*b* has a hydraulic cylinder base 183*b* at an outer end thereof. A second hydraulic fluid chamber 186*b* may thus be formed between a cylinder barrel/tubular wall 187*b*, hydraulic cylinder base 183*b* and hydraulic piston 154*b*. Hydraulic cylinder base 183*b* may have an input/output fluid connector 1184*b* that is adapted for connection to a hydraulic fluid communication line 1166*b*. Thus hydraulic fluid can be communicated into and out of second hydraulic fluid chamber 186*b*.

In embodiments such as is illustrated in FIG. 7, the driving fluid connectors 1184*a*, 1184*b* may each connect to a single hydraulic line 1166*a*, 1166*b* that may, depending upon the operational configuration of the system, either be communicating hydraulic fluid to, or communicating hydraulic fluid away from, each of hydraulic fluid chamber 186*a* and hydraulic fluid chamber 186*b*, respectively. However, other configurations for communicating hydraulic fluid to and from hydraulic fluid chambers 186*a*, 186*b* are possible.

As indicated above, gas compression cylinder 180 is located generally between the two hydraulic cylinders 152*a*, 152*b*. Gas compression cylinder 180 may be divided into the two adjacent gas chamber sections 181*a*, 181*b* by gas piston 182. First gas chamber section 1814*a* may thus be defined by the cylinder barrel/tubular wall 190, gas piston 182 and first gas cylinder head 192*a*. The second gas chamber section 181*b* may thus be defined by the cylinder barrel/tubular wall 190, gas piston 182 and second gas cylinder head 192*b* and formed on the opposite side of gas piston 182 to first gas chamber section 181*a*.

The components forming hydraulic cylinders 154*a*, 154*b* and gas compression cylinder 180 may be made from any one or more suitable materials. By way of example, barrel 190 of gas compression cylinder 180 may be formed from chrome plated steel; the barrel of hydraulic cylinders 152*a*, 152*b*, may be made from a suitable steel; gas piston 182 may be made from T6061aluminum; the hydraulic pistons 154*a*, 154*b* may be made generally from ductile iron; and piston rod 194 may be made from induction hardened chrome plated steel.

The diameter of hydraulic pistons 154*a*, 154*b* may be selected dependent upon the required output gas pressure to be produced by gas compressor 150 and a diameter (for example about 3 inches) that is suitable to maintain a desired pressure of hydraulic fluid in the hydraulic fluid chambers 186*a*, 186*b* (for example—a maximum pressure of about 2800 psi).

Hydraulic pistons 154*a*, 154*b* may also include seal devices 196*a*, 196*b* respectively at their outer circumferential surface areas to provide fluid/gas seals with the inner wall surfaces of respective hydraulic cylinder barrels 187*a*, 187*b* respectively. Seal devices 196*a*, 196*b*, may substantially prevent or inhibit movement of hydraulic fluid out of hydraulic fluid chambers 186*a*, 186*b* during operation of hydraulic gas compressor 150 and may prevent or at least inhibit the migration of any gas/liquid that may be in respective adjacent buffer chambers 195*a*, 195*b* (as described further hereafter) into hydraulic fluid chambers 186*a*, 186*b*.

Figure 8:
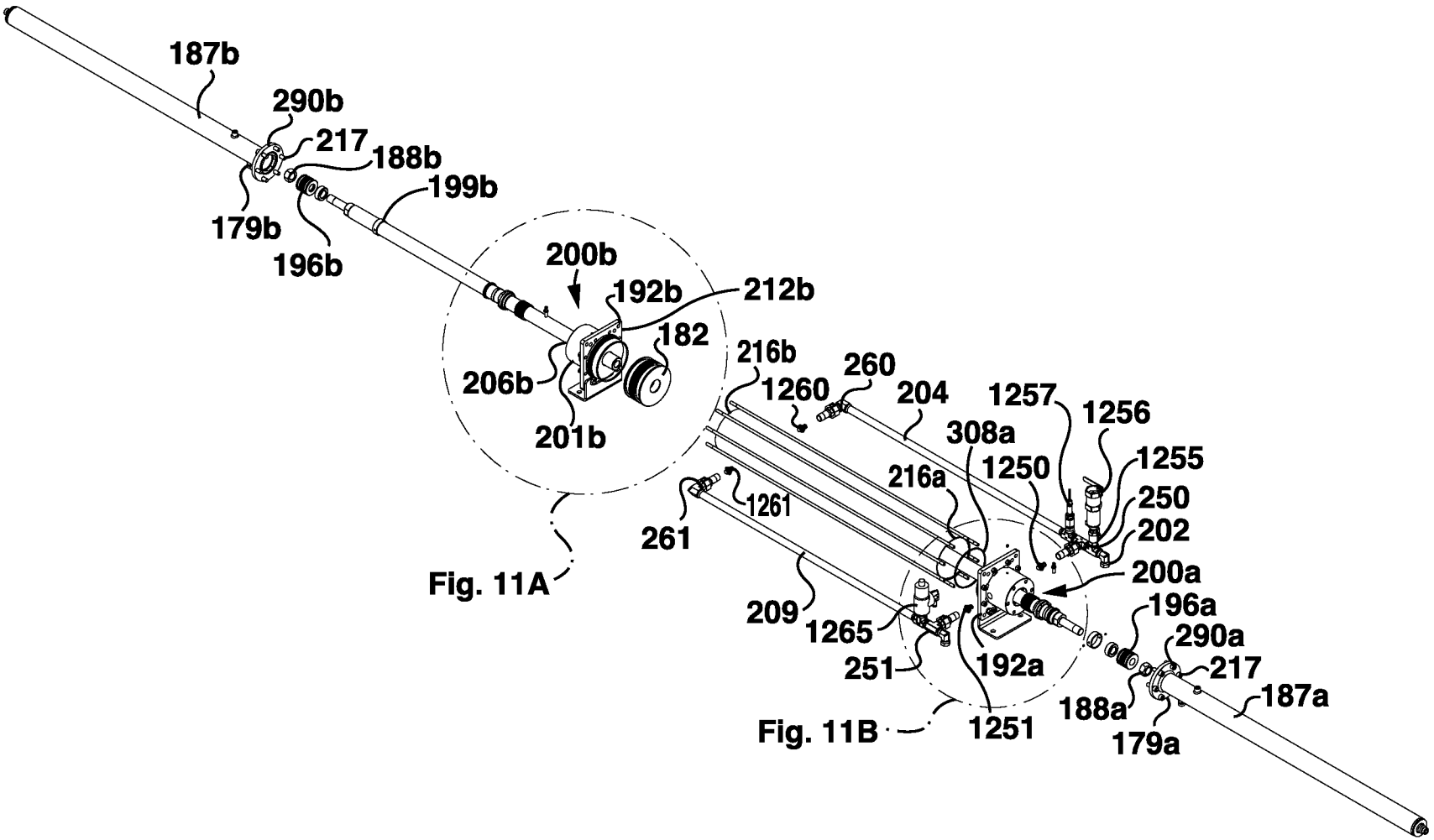
FIG. 8 is a perspective exploded view of a gas compressor substantially like the gas compressor of FIG. 2.
Figure 8A:
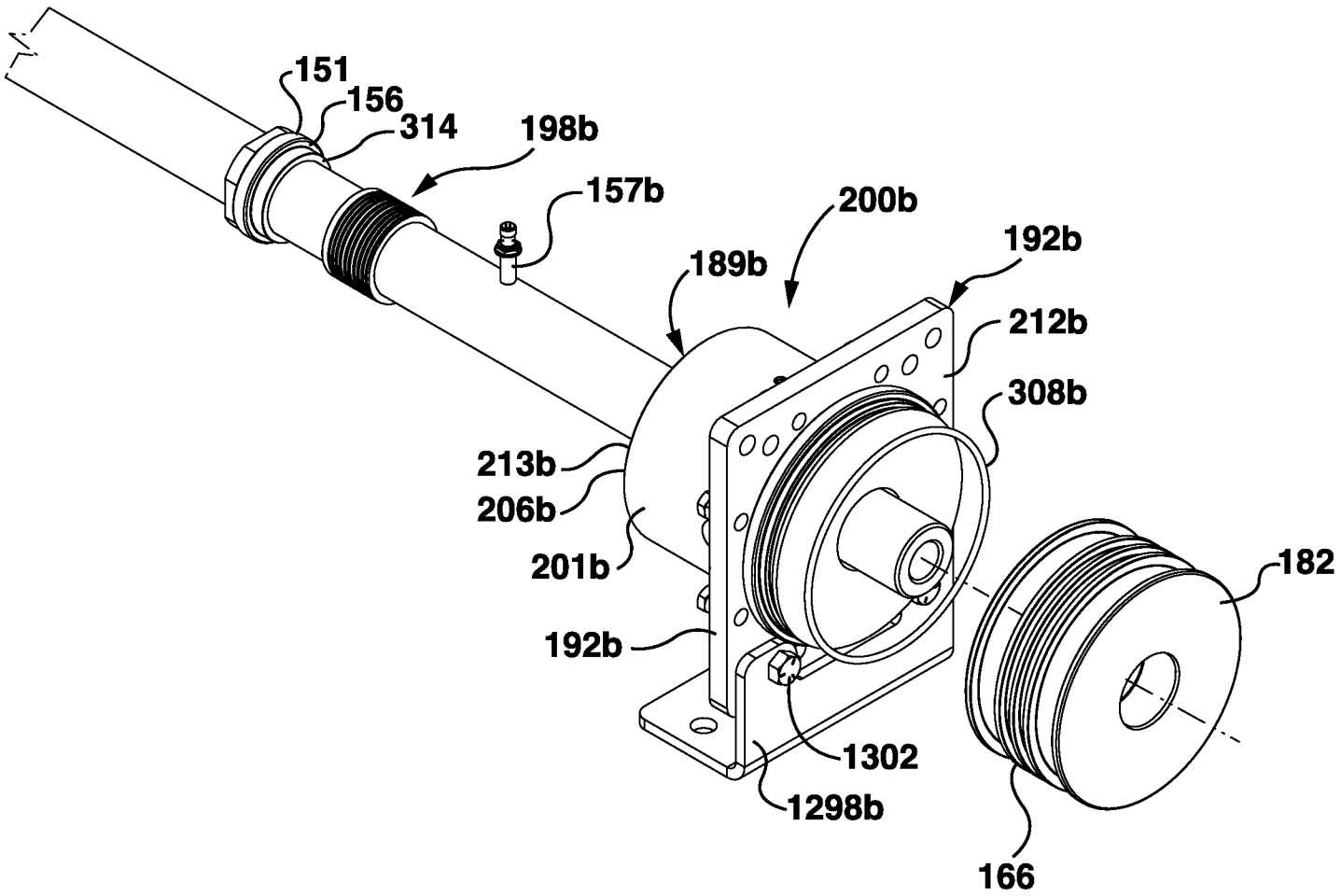
FIG. 8A is enlarged view of the portion marked FIG. 8A in FIG. 8.
Figure 8B:
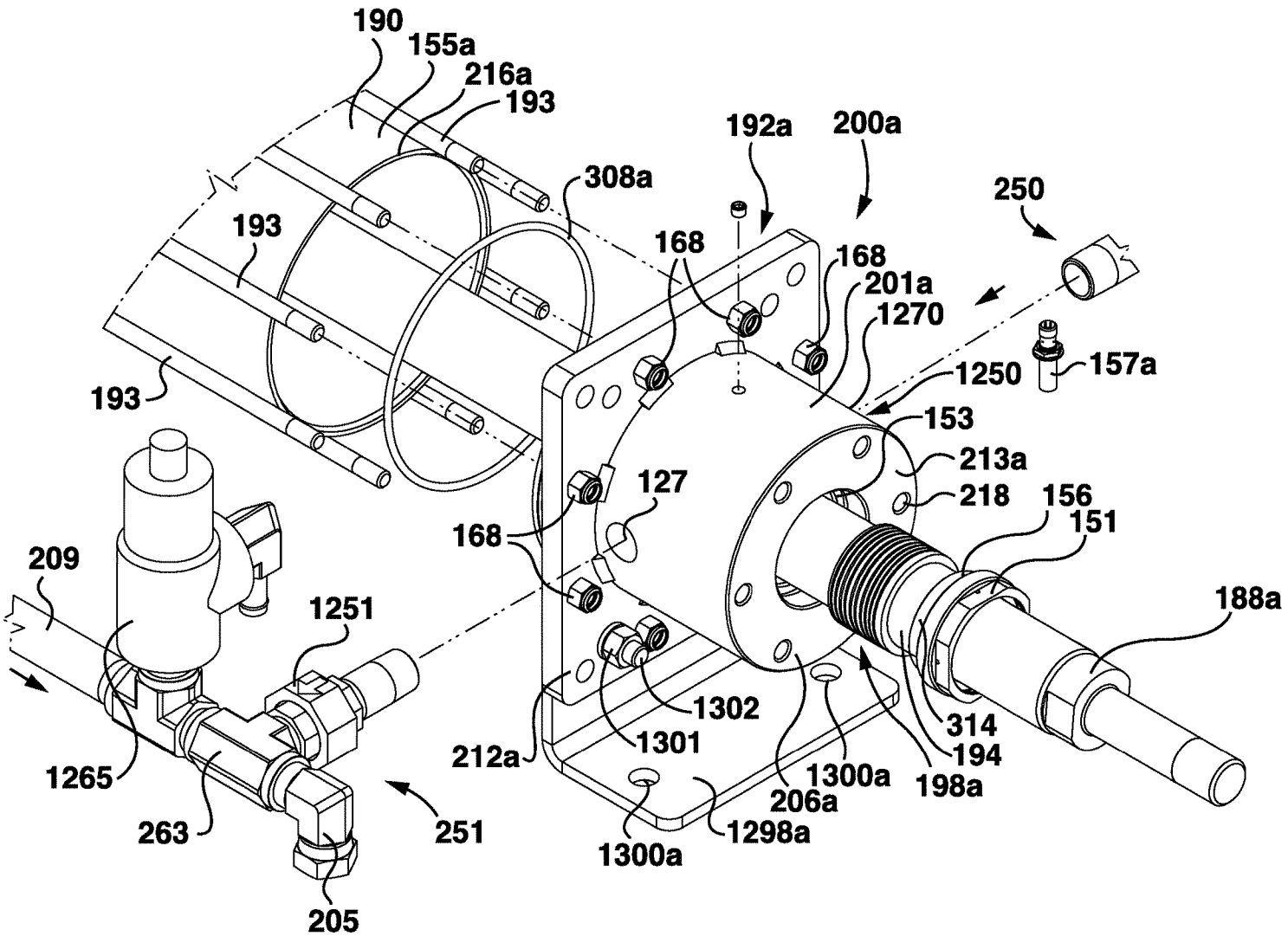
FIG. 8B is enlarged view of the portion marked FIG. 8B in FIG. 8.

Also with reference now to FIGS. 8, 8A and 8B, hydraulic piston seal devices 196*a*, 196*b* may include a plurality of polytetrafluoroethylene (PTFE) (e.g. Teflon™ seal rings and may also include Hydrogenated nitrile butadiene rubber (HNBR) energizers/energizing rings for the seal rings. A mounting nut 188*a*, 188*b* may be threadably secured to the opposite ends of piston rod 194 and may function to secure the respective hydraulic pistons 154*a*, 154*b* onto the end of piston rod 194.

The diameter of the gas piston 182 and corresponding inner surface of gas cylinder barrel 190 will vary depending upon the required volume of gas and may vary widely (e.g. from about 6 inches to 12 inches or more). In one example embodiment, hydraulic pistons 154*a*, 154*b* have a diameter of 3 inches; piston rod 194 has a diameter or 2.5 inches and gas piston 182 has a diameter of 8 inches.

Gas piston 182 may also include a conventional gas compression piston seal device at its outer circumferential surfaces to provide a seal with the inner wall surface of gas cylinder barrel 190 to substantially prevent or inhibit movement of natural gas and any additional components associated with the natural gas, between gas compression cylinder sections 181*a*, 181*b*. Gas piston seal device may also assist in maintaining the gas pressure differences between the adjacent gas compression cylinder sections 181*a*, 181*b*, during operation of hydraulic gas compressor 150.

As noted above, hydraulic pistons 154*a*, 154*b* may be formed at opposite ends of a piston rod 194. Piston rod 194 may pass through gas compression cylinder sections 181*a*, 181*b* and pass through a sealed (e.g. by welding) central axial opening 191 through gas piston 182 and be configured and adapted so that gas piston 182 is fixedly and sealably mounted to piston rod 194.

Piston rod 194 may also pass through axially oriented openings in head assemblies 200*a*, 200*b* that may be located at opposite ends of gas cylinder barrel 190. Thus, reciprocating axial/longitudinal movement of piston rod 194 will result in reciprocating synchronous axial/longitudinal movement of each of hydraulic pistons 154*a*, 154*b* in respective hydraulic fluid chambers 186*a*, 186*b*, and of gas piston 182 within gas compression chamber sections 181*a*, 181*b* of gas compression cylinder 180.

Located on the inward side of hydraulic piston 154*a*, within hydraulic cylinder 154*a*, between hydraulic fluid chamber 186*a* and gas compression cylinder section 181*a*, may be located first buffer chamber 195*a*. Buffer chamber 195*a* may be defined by an inner surface of hydraulic piston 154*a*, the cylindrical inner wall surface of hydraulic cylinder barrel 187*a*, and hydraulic cylinder head 189*a*.

Similarly, located on the inward side of hydraulic piston 154*b*, within hydraulic cylinder 154*b*, between hydraulic fluid chamber 186*b* and gas compression cylinder section 181*b*, may be located second buffer chamber 195*b*. Buffer chamber 195*b* may be defined by an inner surface of hydraulic piston 154*b*, the cylindrical inner wall surface of cylinder barrel 187*b*, and hydraulic cylinder head 189*b*.

As hydraulic pistons 154*a*, 154*b* are mounted at opposite ends of piston rod 194, piston rod 194 also passes through buffer chambers 195*a*, 195*b*.

With particular reference now to FIGS. 2, 6, 8, 8A-C, and 9A-C and 13A-C, head assembly 200*a* may include hydraulic cylinder head 189*a* and gas cylinder head 192*a* and a hollow tubular casing 201*a*. Hydraulic cylinder head 189*a* may have a generally circular hydraulic cylinder head plate 206*a* formed or mounted within casing 201*a* (FIG. 8B).

A barrel flange plate 290*a* (FIG. 9A), hydraulic cylinder head plate 206*a* (FIG. 8B) and a gas cylinder head plate 212*a* may have casing 201*a* disposed there between. Gas cylinder head plate 212*a* may be interconnected to an inward end of hollow tubular casing 201*a* for example by welds or the two parts may be integrally formed together. In other embodiments, hollow tubular casing 201*a* may be integrally formed with both hydraulic cylinder head plate 206*a* and gas cylinder head plate 212*a*.

Hydraulic cylinder barrel 187*a* may have an inward end 179*a*, interconnected such as by welding to the outward facing edge surface of a barrel flange plate 290*a*. Barrel flange plate 290*a* may be configured as shown in FIGS. 2, 8, 8A-C, and 9A-C.

Barrel flange plate 290*a* may be connected to the hydraulic cylinder head plate 206*a* by bolts 217 (FIG. 8) received in threaded openings 218 of outward facing surface 213*a* of hydraulic head plate 206*a* (FIGS. 8 and 8B). A gas and liquid seal may be created between the mating surfaces of hydraulic head plate 206*a* and barrel flange plate 290*a*. A sealing device may be provided between these plate surfaces such as TEFLON hydraulic seals and buffers.

Gas cylinder barrel 190 may have an end 155*a* (FIG. 8B) interconnected to the inward facing surface of gas cylinder head plate 212*a* such as by passing first threaded ends of each of the plurality of tie rods 193 through openings in head plate 212*a* and securing them with nuts 168.

Piston rod 194 may have a portion that moves longitudinally within the inner cavity formed through openings within barrel flange plate 290*a*, hydraulic cylinder head plate 206*a* and gas cylinder head plate 212*a* and within tubular casing 210*a*.

A structure and functionality corresponding to the structure and functionality just described in relation to hydraulic cylinder 152*a*, buffer chamber 195*a*, and gas compression cylinder section 181*a*, may be provided on the opposite side of hydraulic gas compression cylinder 150 in relation to hydraulic cylinder 152*b*, buffer chamber 195*b*, and gas compression cylinder section 181*b*.

Thus with particular reference to FIGS. 8, 8A and 8B, head assembly 200*b* may include hydraulic cylinder head 189*b*, gas cylinder head 192*b* and a hollow tubular casing 201*b*. Hydraulic cylinder head 189*b* may have a hydraulic cylinder head plate 206*b* formed or mounted within casing 201*b* (FIG. 8A)

A barrel flange plate 290*b*/hydraulic cylinder head plate 206*b* and a gas cylinder head plate 212*b* (FIGS. 8 and 8A) may have casing 201*b* generally disposed there between. Gas cylinder head plate 212*b* may be interconnected to hollow tubular casing 201*b* for example by welds or the two parts may be integrally formed together. In other embodiments, hollow tubular casing 201*b* may be integrally formed with hydraulic cylinder head plate 206*b* and gas cylinder head plate 212*b*.

Hydraulic cylinder barrel 187*b* (FIG. 9A) may have an inward end 179*b*, interconnected such as by welding to the outward facing edge surface of a barrel flange plate 290*b*.

Barrel flange plate 290*b* may also be configured as shown in FIGS. 2, 8, 8A-C, and FIGS. 9A-C.

Figure 9A:
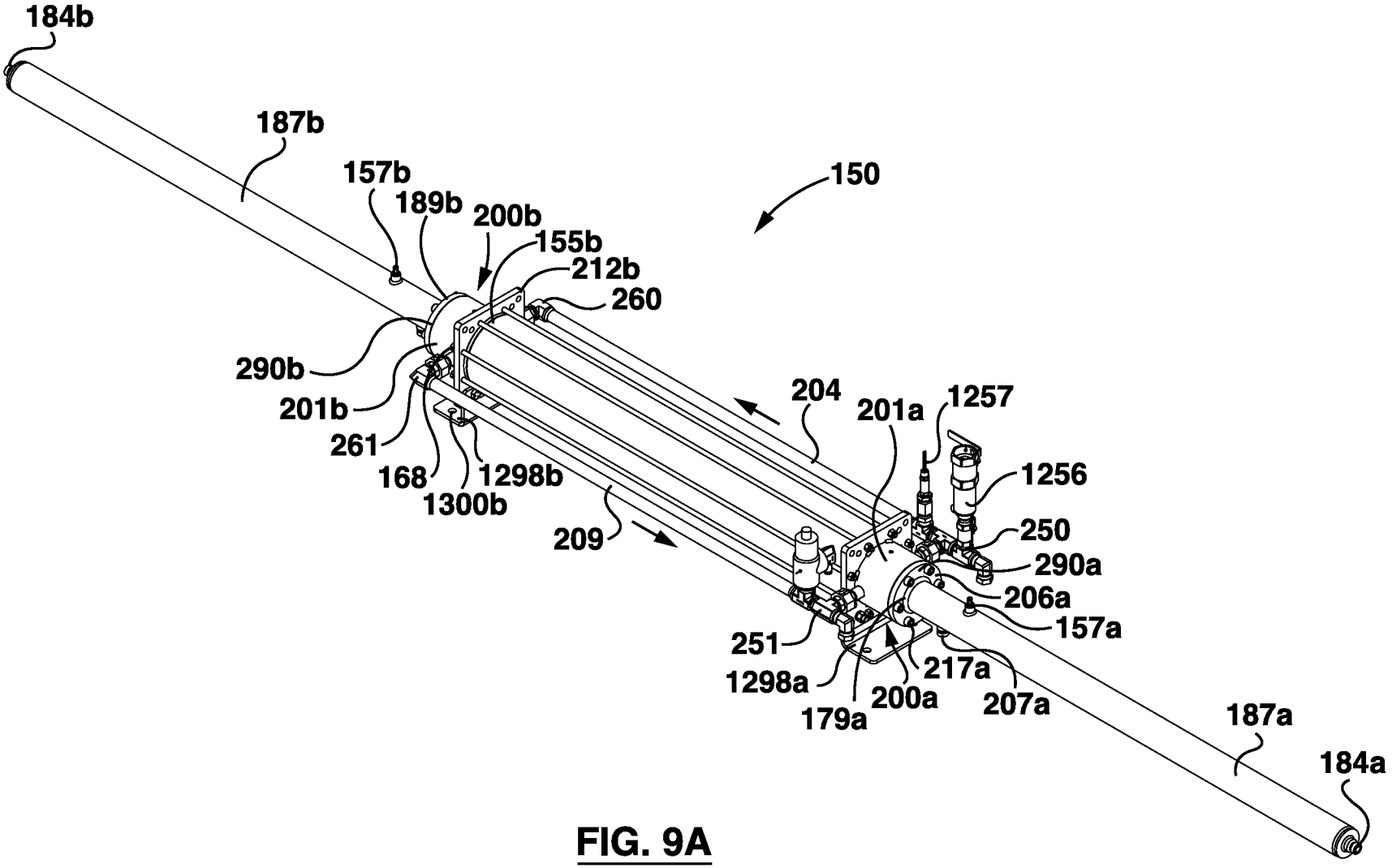
FIG. 9A is a perspective view of the gas compressor of FIG. 2.
Figure 9B:
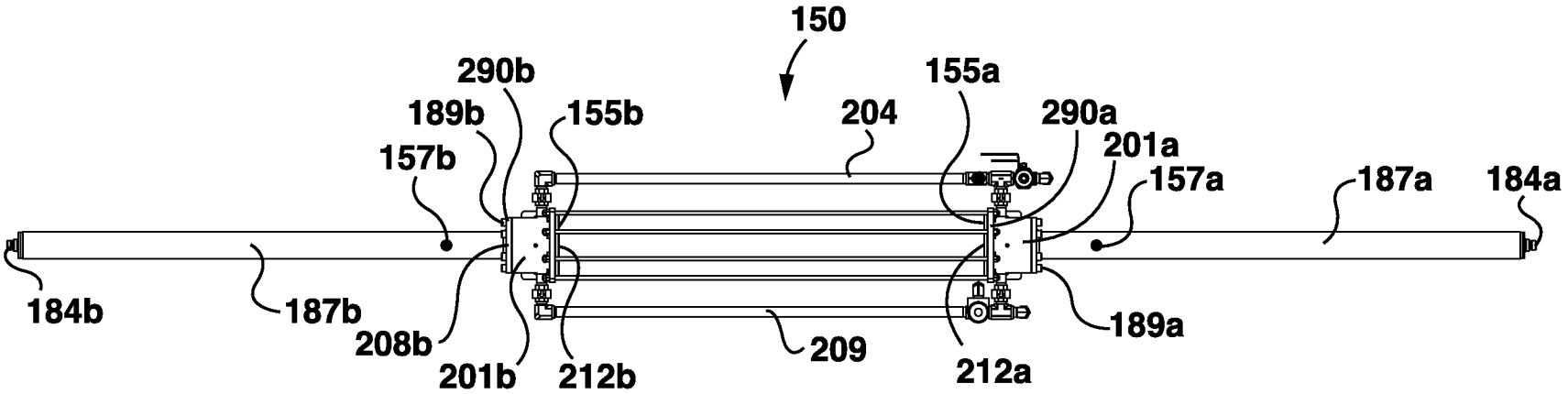
FIG. 9B is a top view of the gas compressor of FIG. 2.

Barrel flange plate 290*b* may be connected to the hydraulic cylinder head plate 206*b* by bolts 217 received in threaded openings 218*b* of outward facing surface 213*b* of hydraulic head plate 206*b* (FIG. 9B). A gas and liquid seal may be created between the mating surfaces of hydraulic head plate 206*b* and barrel flange plate 290*b*. A sealing device may be provided between these plate surfaces such as TEFLON hydraulic seals and buffers.

Gas cylinder barrel 190 may have an end 155*b* (FIG. 9A) interconnected to the inward facing surface of gas cylinder head plate 212*b* such as by passing first threaded ends of each of the plurality of tie rods 193 through openings in head plate 212*b* and securing them with nuts 168.

Piston rod 194 may have a portion that moves longitudinally within the inner cavity formed through openings within hydraulic cylinder head plate 206*b* and gas cylinder head plate 212*b* and within tubular casing 210*b*.

With particular reference now to FIGS. 8, 8A and 8B, two head sealing O-rings 308*a*, 308*b* may be provided and which may be made from highly saturated nitrile-butadiene rubber (HNBR). One O-ring 308*a* may be located between a first circular edge groove 216*a* at end 155*a* of gas cylinder barrel 190 and the inward facing surface of gas cylinder head plate 212*a*. O-ring 308*a* may be retained in a groove in the inward facing surface of gas cylinder head plate 212*a*. O-ring 308*b* may be located between a second opposite circular edge groove 216*b* of at the opposite end of gas cylinder barrel 190 and the inward facing surface of gas cylinder head plate 212*b*. O-ring 308*b* may be retained in a groove in the inward facing surface of gas cylinder head plate 212*b*. In this way gas seals are provided between gas compression chamber sections 181*a*, 181*b* and their respective gas cylinder head plates 212*a*, 212*b*.

By securing threaded both opposite ends of each of the plurality of tie rods 193 through openings in gas cylinder head plates 212*a*, 212*b* and securing them with nuts 168, tie rods 193 will function to tie together the head plates 212*a* and 212*b* with gas cylinder barrel 190 and O-rings 308*a*, 308*b* securely held there between and providing a sealed connection between cylinder barrel 190 and head plates 212*a*, 212*b*.

Seal/wear devices 198*a*, 198*b* may be provided within casing 201*a* to provide a seal around piston rod 194 and with an inner surface of casing 201*a* to prevent or limit the movement of natural gas out of gas compression cylinder section 181*a*, into buffer chamber 195*a*. Corresponding seal/wear devices may be provided within casing 201*b* to provide a seal around piston rod 194 and with an inner surface of casing 201*b* to prevent or limit the movement of natural gas out of gas compression cylinder section 181*b*, into buffer chamber 195*b*. These seal devices 198*a*, 198*b* may also prevent or at least limit/inhibit the movement of other components (such as contaminants) that have been transported with the natural gas from well shaft 108 into gas compression cylinder sections 181*a*, 181*b*, from migrating into respective buffer chambers 195*a*, 195*b*.

While in some embodiments, the gas pressure in gas compression chamber sections 181*a*, 181*b* will remain generally, if not always, above the pressure in the adjacent respective buffer chambers 195*a*, 195*b*, the seal/wear devices 198*a*, 198*b* may in some situations prevent migration of gas and/or liquid that may be in buffer chambers 195*a*, 195*b* from migrating into respective gas compression chamber sections 181*a*, 181*b*. The seal/wear devices 198*a*, 198*b* may also assist to guide piston rod 194 and keep piston rod 194 centred in the casings 201*a*, 201*b* and absorb transverse forces exerted upon piston rod 194.

Also, with particular reference to FIGS. 8, 8A and 8B, each seal device 198*a*, 198*b* may be mounted in a respective casing 201*a*, 201*b*. Associated with each head assembly 200*a*, 200*b* may also be a rod seal retaining nut 151 which may be made from any suitable material, such as for example aluminium bronze. A rod seal retaining nut 151 may be axially mounted around piston rod 194. Rod seal retaining nut 151 may be provided with inwardly directed threads 156. The threads 156 of rod sealing nut 151 may engage with internal mating threads in opening 153 of the respective casing 201*a*, 201*b*. By tightening rod sealing nut 151, components of sealing devices 198*a*, 198*b* may be axially compressed within casing 201*a*, 201*b*. The compression causes components of the sealing devices 198*a*, 1987*b* to be pushed radially outwards to engage an inner cylindrical surface of the respective casings 201*a*, 201*b* and radially inwards to engage the piston rod 194. Thus seal devices 198*a*, 198*b* are provided to function as described above in providing a sealing mechanism.

As each rod seal retaining nut 151 can be relatively easily unthreaded from engagement with its respective casing 201*a*, 201*b*, maintenance and/or replacement of one or more components of seal devices 198*a*, 198*b* is made easier. Additionally, by turning a rod seal retaining nut 151 may be engaged to thread the rod seal retaining nut further into opening 153 of the casing, adjustments can be made to increase the compressive load on the components of the sealing devices 198*a*, 198*b* to cause them to be being pushed radially further outwards into further and stronger engagement with an inner cylindrical surface of the respective casings 201*a*, 201*b* and further inwards to engage with the piston rod 194. Thus the level of sealing action/force provided by each seal device 198*a*, 198*b* may be adjusted.

However, even with an effective seal provided by the sealing devices 198*a*, 198*b*, it is possible that small amounts of natural gas, and/or other components such as hydrogen sulphide, water, oil may still at least in some circumstances be able to travel past the sealing devices 198*a*, 198*b* into respective buffer chambers 195*a*, 195*b*. For example, oil may be adhered to the surface of piston rod 194 and during reciprocating movement of piston rod 194, it may carry such other components from the gas compression cylinder section 181*a*, 181*b* past sealing devices 198*a*, 198*b*, into an area of respective cylinder barrels 187*a*, 187*b* that provide respective buffer chambers 195*a*, 195*b*. High temperatures that typically occur within gas compression chamber sections 181*a*, 181*b* may increase the risk of contaminants being able to pass seal devices 198*a*, 198*b*. However buffer chambers 195*a*, 195*b* each provide an area that may tend to hold any contaminants that move from respective gas compression chamber sections 181*a*, 181*b* and restrict the movement of such contaminants into the areas of cylinder barrels that provide hydraulic cylinder fluid chambers 186*a*, 186*b*.

Mounted on and extending within cylinder barrel 187*a* close to hydraulic cylinder head 189*a*, is a proximity sensor 157*a*. Proximity sensor 157*a* is operable such that during operation of gas compressor 150, as piston 154*a* is moving from left to right, just before piston 154*a* reaches the position shown in FIG. 3(*i*), proximity sensor 157*a* will detect the presence of hydraulic piston 154*a* within hydraulic cylinder 152*a* at a longitudinal position that is shortly before the end of the stroke. Sensor 157*a* will then send a signal to controller 200, in response to which controller 200 can take steps to change the operational mode of hydraulic fluid supply system 1160 (FIG. 7).

Similarly, mounted on and extending within cylinder barrel 187*b* close to hydraulic cylinder head 189*b*, is another proximity sensor 157*b*. Proximity sensor 157*b* is operable such that during operation of gas compressor 150, as piston 154*b* is moving from right to left, just before piston 154*b* reaches the position shown in FIG. 5(*iii*), proximity sensor 157*b* will detect the presence of hydraulic piston 154*b* within hydraulic cylinder 152*b* at a longitudinal position that is shortly before the end of the stroke. Proximity sensor 157*b* will then send a signal to controller 200, in response to which controller 200 can take steps to change the operational mode of hydraulic fluid supply system 1160.

Proximity sensors 157*a*, 157*b* may be in communication with controller 200. In some embodiments, proximity sensors 157*a*, 157*b* may be implemented using inductive proximity sensors, such as model BI 2--M12-Y1X-H1141 sensors manufactured by Turck, Inc. These inductive sensors are operable to generate proximity signals responsive to the proximity of a metal portion of piston rod 194 proximate to each of hydraulic piston 154*a*, 154*b*. For example sensor rings may be attached around piston rod 194 at suitable positions towards, but spaced from, hydraulic pistons 154*a*, 154*b* respectively such as annular collar 199*b* in relation to hydraulic piston 154*b*—FIGS. 6 and 8. Proximity sensors 157*a*, 157*b* may detect when collars 199*a*, 199*b* on piston rod 194 pass by. Steel annular collars 199*a*, 199*b* may be mounted to piston rod 194 and may be held on piston rod 194 with set screws and a LOCTITE™ adhesive made by Henkel Corporation.

It is possible for controller 200 (FIG. 7) to be programmed in such manner to control the hydraulic fluid supply system 1160 in such a manner as to provide for a relatively smooth slowing down, a stop, reversal in direction and speeding up of piston rod 194 along with the hydraulic pistons 154*a*, 154*b* and gas piston 182 as the piston rod 194, hydraulic pistons 154*a*, 154*b* and gas piston 182 transition between a drive stroke providing movement to the right to a drive stroke providing the stroke to the left and back to a stroke providing movement to the right.

An example hydraulic fluid supply system 1160 for driving hydraulic pistons 154*a*, 154*b* of hydraulic cylinders 152*a*, 152*b* of hydraulic gas compressor 150 in reciprocating movement is illustrated in FIG. 7. Hydraulic fluid supply subsystem 1160 may be a closed loop system and may include a pump unit 1174, hydraulic fluid communication lines 1163*a*, 1163*b*, 1166*a*, 1166*b*, and a hot oil shuttle valve device 1168. Shuttle valve device 1168 may be for example a hot oil shuttle valve device made by Sun Hydraulics Corporation under model XRDCLNN-AL.

Fluid communication line 1163*a* fluidly connects a port S of pump unit 1174 to a port Q of shuttle valve 1168. Fluid communication line 1163*b* fluidly connects a port P of pump 1174 to a port R of shuttle valve 1168. Fluid communication line 1166*a* fluidly connects a port V of shuttle valve 1168 to a port 1184*a* of hydraulic cylinder 152*a*. Fluid communication line 1166*b* fluidly connects a port W of shuttle valve 1168 to a port 1184*b* of hydraulic cylinder 152*b*.

An output port M of shuttle valve 1168 may be connected to an upstream end of a bypass fluid communication line 1169 having a first portion 1169*a*, a second portion 1169*b* and a third portion 1169*c* that are arranged in series. A filter 1171 may be interposed in bypass line 1169 between portions 1169*a* and 1169*b*. Filter 1171 may be operable to remove contaminants from hydraulic fluid flowing from shuttle valve device 1168 before it is returned to reservoir 1172. Filter 1171 may for example include a type HMK05/25 5 micro-m filter device made by Donaldson Company, Inc. The downstream end of line portion 1169*b* joins with the upstream end of line portion 1169*c* at a T-junction where a downstream end of a pump case drain line 1161 is also fluidly connected. Case drain line 1161 may drain hydraulic fluid leaking within pump unit 1174. Fluid communication line portion 1169*c* is connected at an opposite end to an input port of a thermal valve device 1142. Depending upon the temperature of the hydraulic fluid flowing into thermal valve device 1142 from communication line portion 1169*c* of bypass line 1169, thermal valve device 1142 directs the hydraulic fluid to either fluid communication line 1141*a* or 1141*b*. If the temperature of the hydraulic fluid flowing into thermal valve device 1142 is greater than a set threshold level, valve device 1142 will direct the hydraulic fluid through fluid communication line 1141*a* to a cooling device 1143 where hydraulic fluid can be cooled before being passed through fluid communication line 1141*c* to reservoir 1172. If the hydraulic fluid entering fluid valve device 1142 does not require cooling, then thermal valve 1142 will direct the hydraulic fluid received therein from communication line portion 1169*c* to communication line 1141*b* which leads directly to reservoir 1172. An example of a suitable thermal valve device 1142 is a model 67365-110F made by TTP (formerly Thermal Transfer Products). An example of a suitable cooler 1143 is a model BOL-16-216943 also made by TTP.

Drain line 1161 connects output case drain ports U and T of pump unit 1174 to a T-connection in communication line 1169*b* at a location after filter 1171. Thus any hydraulic fluid directed out of case drain ports U/T of pump unit 1174 can pass through drain line 1161 to the T-connection of communication line portions 1169*b*, 1169*c*, (without going through the filter device 1171) where it can mix with any hydraulic fluid flowing from filter 1171 and then flow to thermal valve device 1142 where it can either be directed to cooler 1143 before flowing to reservoir 1172 or be directed directly to reservoir 1172. By not passing hydraulic fluid from case drain 1161 through relatively fine filter 1171, the risk of filter 1171 being clogged can be reduced. It will be noted that filter 1182 provides a secondary filter for fluid that is re-charging pump unit 1174 from reservoir 1172.

Hydraulic fluid supply system 1160 may include a reservoir 1172 may utilize any suitable driving fluid, which may be any suitable hydraulic fluid that is suitable for driving the hydraulic cylinders 152*a*, 152*b*.

Cooler 1143 may be operable to maintain the hydraulic fluid within a desired temperature range, thus maintaining a desired viscosity. For example, in some embodiments, cooler 1143 may be operable to cool the hydraulic fluid when the temperature goes above about 50° C. and to stop cooling when the temperature falls below about 45° C. In some applications such as where the ambient temperature of the environment can become very cold, cooler 1143 may be a combined heater and cooler and may further be operable to heat the hydraulic fluid when the temperature reduces below for example about −10° C. The hydraulic fluid may be selected to maintain a viscosity generally in hydraulic fluid supply system 1160 of between about 20 and about 40 $mm^2s^{-1}$ over this temperature range.

Hydraulic pump unit 1174 is generally part of a closed loop hydraulic fluid supply system 1160. Pump unit 1174 includes outlet ports S and P for selectively and alternately delivering a pressurized flow of hydraulic fluid to fluid communication lines 1163*a* and 1163*b* respectively, and for allowing hydraulic fluid to be returned to pump unit 1174 at ports S and P. Thus hydraulic fluid supply system 1160 may be part of a closed loop hydraulic circuit, except to the extent described hereinafter. Pump unit 1174 may be implemented using a variable-displacement hydraulic pump capable of producing a controlled flow hydraulic fluid alternately at the outlets S and P. In one embodiment, pump unit 1174 may be an axial piston pump having a swashplate that is configurable at a varying angle α. For example pump unit 1174 may be a HPV-02 variable pump manufactured by Linde Hydraulics GmbH & Co. KG of Germany, a model that is operable to deliver displacement of hydraulic fluid of up to about 55 cubic centimeters per revolution at pressures in the range of 58-145 psi. In other embodiments, the pump unit 1174 may be other suitable variable displacement pump, such as a variable piston pump or a rotary vane pump, for example. For the Linde HPV-02 variable pump, the angle α of the swashplate may be adjusted from a maximum negative angle of about −21°, which may correspond to a maximum flow rate condition at the outlet S, to about 0°, corresponding to a substantially no flow condition from either port S or P, and a maximum positive angle of about +21°, which corresponds to a maximum flow rate condition at the outlet P.

In this embodiment the pump unit 1174 may include an electrical input for receiving a displacement control signal from controller 200. The displacement control signal at the input is operable to drive a coil of a solenoid (not shown) for controlling the displacement of the pump unit 1174 and thus a hydraulic fluid flow rate produced alternately at the outlets P and S. The electrical input is connected to a 24 VDC coil within the hydraulic pump 1174, which is actuated in response to a controlled pulse width modulated (PWM) excitation current of between about 232 mA ($i_{Ou}$) for a no flow condition and about 425 mA ($i_U$) for a maximum flow condition.

For the Linde HPV-02 variable pump unit 1174, the swashplate is actuated to move to an angle α either +21° or −21°, only when a signal is received from controller 200. Controller 200 will provide such a signal to pump unit 1174 based on the position of the hydraulic pistons 154*a*, 154*b* as detected by proximity sensors 157*a*, 157*b* as described above, which provide a signal to the controller 200 when the gas compressor 150 is approaching the end of a drive stroke in one direction, and commencement of a drive stroke in the opposite direction is required.

Pump unit 1174 may also be part of a fluid charge system 1180. Fluid charge system 1180 is operable to maintain sufficient hydraulic fluid within pump unit 1174 and may maintain/hold fluid pressure of for example at least 300 psi at both ports S and P so as to be able to control and maintain the operation of the main pump so it can function to supply a flow of hydraulic fluid under pressure alternately at ports S and P.

Fluid charge system 1180 may include a charge pump that may be a 16cc charge pump supplying for example 6-7 gpm and it may be incorporated as part of pump unit 1174. Charge system 1180 functions to supply hydraulic fluid as may be required by pump unit 1174, to replace any hydraulic fluid that may be directed from port M of shuttle valve device 1168 through a relief valve associated with shuttle valve device 1168 to reservoir 1172 and to address any internal hydraulic fluid leakage associated with pump unit 1174. The shuttle valve device 1168 may for example redirect in the range of 3-4 gpm from the hydraulic fluid circuit. The charge pump will then replace the redirected hydraulic fluid 1:1 by maintaining a low side loop pressure.

The relief valve associated with shuttle valve device 1168 will typically only divert to port M a very small proportion of the total amount of hydraulic fluid circulating in the fluid circuit and which passes through shuttle valve device 1168 into and out of hydraulic cylinders 152*a*, 152*b*. For example, the relief valve associated with shuttle valve device may only divert approximately 3 to 4 gallons per minute of hydraulic fluid at 200 psi, accounting for example for only about 1% of the hydraulic fluid in the substantially closed loop the hydraulic fluid circuit. This allows at least a portion of the hydraulic fluid being circulated to gas compressor 150 on each cycle to be cooled and filtered.

The charge pump may draw hydraulic fluid from reservoir 1172 on a fluid communication line 1185 that connects reservoir 1172 with an input port B of pump unit 1174. The charge pump of pump unit 1174 then directs and forces that fluid to port A where it is then communicated on fluid communication line 1181 to a filter device 1182 (which may for example be a 10 micro-m filter made by Linde.

Upon passing through filter device 1182 the hydraulic fluid may then enter port F of pump unit 1174 where it will be directed to the fluid circuit that supplies hydraulic fluid at ports S and P. In this way a minimum of 300 psi of pressure of the hydraulic fluid may be maintained during operation at ports S and P. The charge pressure gear pump may be mounted on the rear of the main pump and driven through a common internal shaft.

In a swashplate pump, rotation of the swashplate drives a set of axially oriented pistons (not shown) to generate fluid flow. In an embodiment of FIG. 7, the swashplate of the pump unit 1174 is driven by a rotating shaft 1173 that is coupled to a prime mover 1175 for receiving a drive torque. In some embodiments, prime mover 1175 is an electric motor but in other embodiments, the prime mover may be implemented in other ways such as for example by using a diesel engine, gasoline engine, or a gas driven turbine.

Prime mover 1175 is responsive to a control signal received from controller 200 at a control input to deliver a controlled substantially constant rotational speed and torque at the shaft 1173. While there may be some minor variations in rotational speed, the shaft 1173 may be driven at a speed that is substantially constant and can for a period of time required, produce a substantially constant flow of fluid alternately at the outlet ports S and P. In one embodiment the prime mover 256 is selected and configured to deliver a rotational speed of about 1750 rpm which is controlled to be substantially constant within about ±1%.

To alternately drive the hydraulic cylinders 152*a*, 152*b* to provide the reciprocating axial motion of the hydraulic pistons 154*a*, 154*b* and thus reciprocating motion of gas piston 182, a displacement control signal is sent from controller 200 to pump unit 1174 and a signal is also provided by controller to prime mover 1175. In response, prime mover 1175 drives rotating shaft 1173, to drive the swashplate in rotation. The displacement control signal at the input of pump unit 1174 drives a coil of a solenoid (not shown) to cause the angle α of the swashplate to be adjusted to desired angle such as a maximum negative angle of about −21°, which may correspond to a maximum flow rate condition at the outlet S and no flow at outlet P. The result is that pressurized hydraulic fluid is driven from port S of pump unit 1174 along fluid communication line 1163*a* to input port Q of shuttle valve device 1168. The shuttle valve device 1168 with the lower pressure hydraulic fluid at port R will be configured such that the pressurized hydraulic fluid flows into port Q and will flow out of port V of shuttle valve device 1168 and into and along fluid communication line 1166*a* and then will enter hydraulic fluid chamber 186*a* of hydraulic cylinder 152*a*. The flow of hydraulic fluid into hydraulic fluid chamber 186*a* will cause hydraulic piston 154*a* to be driven axially in a manner which expands hydraulic fluid chamber 186*a*, thus resulting in movement in one direction of piston rod 194, hydraulic pistons 154*a*, 154*b* and gas piston 182.

During the expansion of hydraulic fluid chamber 186*a* as piston 154*a* moves within cylinder barrel 187*a*, there will be a corresponding contraction in size of hydraulic fluid chamber 186*b* of hydraulic cylinder 152*b* within cylinder barrel 187*b*. This results in hydraulic fluid being driven out of hydraulic fluid chamber 186*b* through port 1184*b* and into and along fluid communication line 1166*b*. The configuration of shuttle valve device 1168 will be such that on this relatively low pressure side, hydraulic fluid can flow into port W and out of port R of shuttle valve device 1168, then along fluid communication line 1163*b* to port P of pump unit 1174. However, the relief valve associated with shuttle valve device 1168 may, in this operational configuration, direct a small portion of the hydraulic fluid flowing along line 1166*b* to port M for communication to reservoir 1172, as discussed above. However, most (e.g. about 99%) of the hydraulic fluid flowing in communication line 1166*b* will be directed to communication line 1163*b* for return to pump unit 1174 and enter at port P.

When the hydraulic piston 154*a* approaches the end of its drive stroke, a signal is sent by proximity sensor 157*a* to controller 200 which causes controller 200 to send a displacement control signal to pump unit 1174. In response to receiving the displacement control signal at the input of pump unit 1174, a coil of the solenoid (not shown) is driven to cause the angle α of the swashplate of pump unit 1174 to be altered such as to be set at a maximum negative angle of about +21°, which may correspond to a maximum flow rate condition at the outlet P and no flow at outlet S. The result is that pressurized hydraulic fluid is driven from port P of pump unit 1174 along fluid communication line 1163*b* to port R of shuttle valve device 1168. The configuration of shuttle valve device 1168 will have been adjusted due to the change in relative pressures of hydraulic fluid in lines 1163*a* and 1163*b*, such that on this relatively high pressure side, hydraulic fluid can flow into port R and out of port W of shuttle valve device 1168, then along fluid communication line 1166*b* to port 1184*b*. Pressurized hydraulic fluid will then enter hydraulic fluid chamber 186*b* of hydraulic cylinder 152*b*. This will cause hydraulic piston 154*b* to be driven in an opposite axial direction in a manner which expands hydraulic fluid chamber 186*b*, thus resulting in synchronized movement in an opposite direction of hydraulic cylinders 154*a*, 154*b* and gas piston 182.

During the expansion of hydraulic fluid chamber 186*b*, there will be a corresponding contraction of hydraulic fluid chamber 186*a* of hydraulic cylinder 152*a*. This results in hydraulic fluid being driven out of hydraulic fluid chamber 186*a* through port 1184*a* and into and along fluid communication line 1166*a*. The configuration of shuttle valve device 1168 will be such that on what is now a relatively low pressure side, hydraulic fluid can now flow into port V and out of port Q of shuttle valve device 1168, then along fluid communication line 1163*a* to port S of pump unit 1174. However, the relief valve associated with shuttle valve device 1168 may in this operational configuration, direct as small portion of the hydraulic fluid flowing along line 1166*a* to port M for communication to reservoir 1172, as discussed above. Again most of the hydraulic fluid flowing in communication line 1166*a* will be directed to communication line 1163*a* for return to pump unit 1174 at port S but a small portion (e.g. 1%) may be directed by shuttle valve device 1168 to port M for communication to reservoir 1172, as discussed above. However, most (e.g. about 99%) of the hydraulic fluid flowing in communication line 1166*a* will be directed to communication line 1163*a* for return to pump unit 1174 and enter at port S.

The foregoing describes one cycle which can be repeated continuously for multiple cycles, as may be required during operation of gas compressor system 126. If a change in flow rate/fluid pressure is required in hydraulic fluid supply system 1160, to change the speed of movement and increase the frequency of the cycles, controller 200 may send an appropriate signal to prime mover 1175 to vary the output to vary the rotational speed of shaft 1173. Alternately and/or additionally, controller 200 may send a displacement control signal to the input of pump unit 1174 to drives the solenoid (not shown) to cause a different angle α of the swashplate to provide different flow rate conditions at the port P and no flow at outlet S or to provide different flow rate conditions at the port S and no flow at outlet P. If zero flow is required, the swash plate may be moved to an angle of zero degrees.

Controller 200 may also include an input for receiving a start signal operable to cause the controller 200 to start operation of gas compressor system 126 and outputs for producing a control signal for controlling operation of the prime mover 1175 and pump unit 1174. The start signal may be provided by a start button within an enclosure that is depressed by an operator on site to commence operation. Alternatively, the start signal may be received from a remotely located controller, which may be communication with the controller via a wireless or wired connection. The controller 200 may be implemented using a microcontroller circuit although in other embodiments, the controller may be implemented as an application specific integrated circuit (ASIC) or other integrated circuit, a digital signal processor, an analog controller, a hardwired electronic or logic circuit, or using a programmable logic device or gate array, for example.

Figure 4:
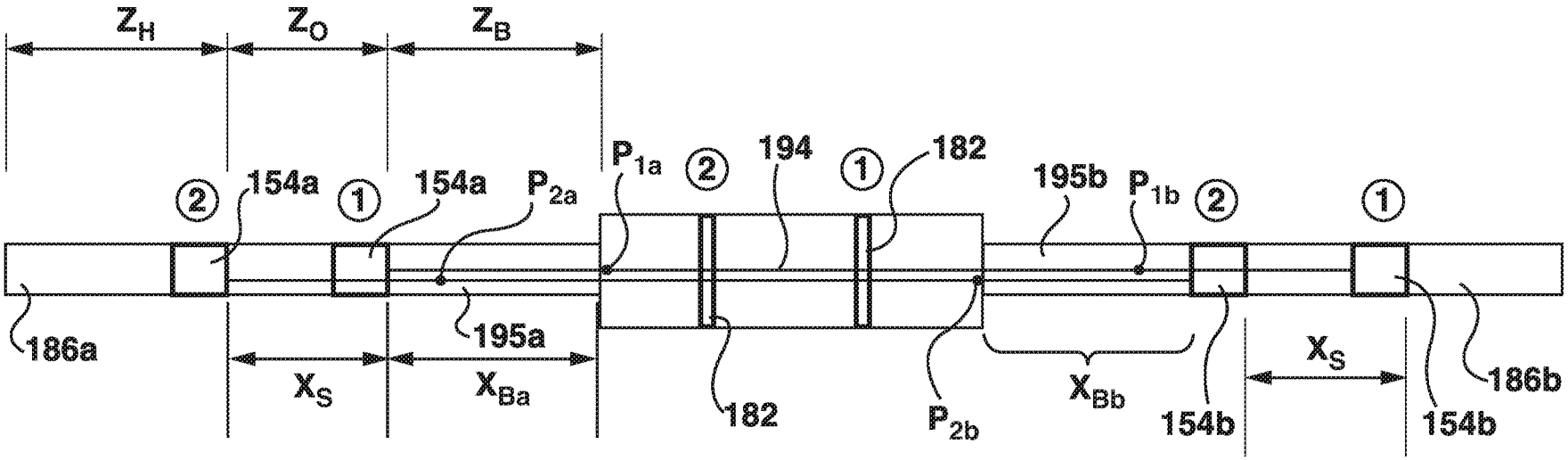
FIG. 4 is a schematic side view of the gas compressor of FIG. 2.

With reference now to FIG. 4, it may be appreciated that hydraulic cylinder barrel 187*a* may be divided into three zones: (i) a zone ZH dedicated exclusively to holding hydraulic fluid; (ii) a zone ZB dedicated exclusively for the buffer area and (iii) an overlap zone, Zo, that which, depending upon where the hydraulic piston 154*a* is in the stroke cycle, will vary between an area holding hydraulic fluid and an area providing part of the buffer chamber. Hydraulic cylinder barrel 187*b* may be divided into a corresponding set of three zones in the same manner with reference to the movement of hydraulic piston 154*b*.

If the length XBa (which is the length of the cylinder barrel from gas cylinder head 192*a* to the inward facing surface of hydraulic cylinder 154*a* at its full right position) is greater than the stroke length Xs, then any point P1*a* on piston rod 194 on the piston rod 194 that is at least for part of the stroke within gas compression chamber section 181*a*, will not move beyond the distance XBa when the gas piston 182 and the hydraulic cylinder 154*a* move from the farthermost right positions of the stroke position (1) to the farthermost left positions of the stroke position (2). Thus, any materials/contaminants carried on piston rod 194 starting at P1*a* will not move beyond the area of the hydraulic cylinder barrel 187*a* that is dedicated to providing buffer chamber 195*a*. Thus, any such contaminants travelling on piston rod 194 will be prevented, or at least inhibited, from moving into the zones ZH and Zo of hydraulic cylinder barrel 187*a* that hold hydraulic fluid. Thus any point P1*a* on piston rod 194 that passes into the gas compression chamber will not pass into an area of the hydraulic cylinder barrel 187*a* that will encounter hydraulic fluid (i.e. It will not pass into ZH or Zo). Thus, all portions of piston rod 194 that encounter gas, will not be exposed to an area that is directly exposed to hydraulic fluid. Thus cross contamination of contaminants that may be present with the natural gas in the gas compression cylinder 180 may be prevented or inhibited from migrating into the hydraulic fluid that is in that areas of hydraulic cylinder barrel 187*a* adapted for holding hydraulic fluid. It may be appreciated, that since there is an overlap zone, the hydraulic pistons do move from a zone where there should never be anything but hydraulic fluid to a zone which transitions between hydraulic fluid and the contents (e.g. air) of the buffer zone. Therefore, contaminants on the inner surface wall of the cylinder barrel 187*a*, 187*b* in the overlap zone could theoretically get transferred to the edge surface of the piston. However, the presence of buffer zone significantly reduces the level of risk of cross contamination of contaminants into the hydraulic fluid.

With reference continuing to FIG. 4, it may be appreciated that hydraulic cylinder barrel 187*b* may also be divided into three zones—like hydraulic cylinder barrel 187*a*, namely: (i) a zone ZH dedicated exclusively to holding hydraulic fluid; (ii) a zone ZB dedicated exclusively for the buffer area and (iii) an overlap zone that which, depending upon where the device is in the stroke cycle, will vary between an area holding hydraulic fluid and an area providing part of the buffer chamber.

If the length XBb (which is the length of the cylinder barrel from gas cylinder head 192*b* to the inward facing surface of hydraulic cylinder 152*b* at its full right position) is greater than the stroke length Xs, then any point P1*b* on piston rod 194 will not move beyond the distance XBb when the gas piston 182 and the hydraulic cylinder 154*b* move from the farthermost right positions of the stroke (1) to the farthermost left positions of the stroke (2). Thus any materials/contaminants on piston rod 194 starting at P1*b* will be prevented or at least inhibited from moving beyond the area of the hydraulic cylinder barrel 187*b* that provides buffer chamber 195*b*. Thus, any such contaminants travelling on piston rod 194 will be prevented, or at least inhibited, from moving into the zones ZH and Zo of hydraulic cylinder barrel 187*b* that hold hydraulic fluid. Thus any point P2*b* on piston rod 194 that passes into the gas compression chamber will not pass into an area of the hydraulic cylinder barrel 187*b* that will encounter hydraulic fluid (i.e. It will not pass into Zh or Zo). Thus, all portions of piston rod 194 that encounter gas, will not be exposed to an area that is directly exposed to hydraulic fluid. Thus cross contamination of contaminants that may be present with the natural gas in the gas compression cylinder 180 may be prevented or inhibited from migrating into the hydraulic fluid that is in that areas of hydraulic cylinder barrel 187*b* adapted for holding hydraulic fluid. Thus, any such contaminants travelling on piston rod 194 will be prevented or a least inhibited from moving into the area of hydraulic cylinder barrel 187*b* that in operation, holds hydraulic fluid. Thus cross contamination of contaminants that may be present with the natural gas in the gas compression cylinder 180 may be prevented or at least inhibited from migrating into the hydraulic fluid that is in that area of hydraulic cylinder barrel 187*b* that is used to hold hydraulic fluid.

In some embodiments, during operation of hydraulic gas compressor 150, buffer chambers 195*a*, 195*b* may each be separately open to ambient air, such that air within buffer chamber may be exchanged with the external environment (e.g. air at ambient pressure and temperature). However, it may not desirable for the air in buffer chambers 195*a*, 195*b* to be discharged into the environment and possibly other components to be discharged directly into the environment, due to the potential for other components that are not environmentally friendly also being present with the air. Thus a closed system may be highly undesirable such that for example buffer chambers 195*a*, 195*b* may be in communication with each such that a substantially constant amount of gas (e.g. such as air) can be shuttled back and forth through communication lines—such as communication lines 215*a*, 215*b* in FIG. 7.

Buffer chambers 195*a* and/or 195*b* may in some embodiments be adapted to function as a purge region. For example, buffer chambers 195*a*, 195*b* may be fluidly interconnected to each other, and may also in some embodiments, be in fluid communication with a common pressurized gas regulator system 214 (FIG. 7), through gas lines 215*a*, 215*b* respectively. Pressurized gas regulator system 214 may for example maintain a gas at a desired gas pressure within buffer chambers 195*a*, 195*b* that is always above the pressure of the compressed natural gas and/or other gases that are communicated into and compressed in gas compression cylinder chamber sections 181*a*, 181*b* respectively. For example, pressurized gas regulator system 214 may provide a buffer gas such as purified natural gas, air, or purified nitrogen gas, or another inert gas, within buffer chambers 195*a*, 195*b*. This may then prevent or substantially restrict natural gas and any contaminants contained in gas compression cylinder sections 181*a*, 181*b* migrating into buffer chambers 195*a*, 195*b*. The high pressure buffer gas in buffer chambers 195*a*, 195*b* may prevent movement of natural gas and possibly contaminants into the buffer chambers 195*a*, 195*b*. Furthermore if the buffer gas is inert, any gas that seeps into the gas compression cylinder chamber sections 181*a*, 181*b* will not react with the natural gas and/or contaminants. This can be particularly beneficial if for example the contaminants include hydrogen sulphide gas which may be present in one or both of gas compression cylinder chamber sections 181*a*, 181*b*.

In some embodiments, gas lines 215*a*, 215*b* (FIG. 7) may not be in fluid communication with a pressurized gas regulator system 214—but instead may be interconnected directly with each other to provide a substantially unobstructed communication channel for whatever gas is in buffer chambers 195*a*, 195*b*. Thus during operation of gas compressor 150, as hydraulic pistons 154*a*, 154*b* move right and then left (and/or upwards downwards) in unison, as one buffer chamber (e.g. buffer chamber 195*a*) increases in size, the other buffer chamber (e.g. buffer chamber 195*b*) will decrease in size. So instead of gas in each buffer chamber 195*a*, 195*b* being alternately compressed and then decompressed, a fixed total volume of gas at a substantially constant pressure may permit gas thereof to shuttle between the buffer chambers 195*a*, 195*b* in a buffer chamber circuit.

Also, instead of being directly connected with each other, buffer chambers 195*a*, 195*b* may be both in communication with a common holding tank 1214 (FIG. 7) that may provide a source of gas that may be communicated between buffer chambers 195*a*, 195*b*. The gas in the buffer chamber gas circuit may be at ambient pressure in some embodiments and pressurized in other embodiments. The holding tank 1214 may in some embodiments also serve as a separation tank whereby any liquids being transferred with the gas in the buffer chamber system can be drained off.

In the embodiment of FIGS. 2, and 9A-9C, a drainage port 207*a* for buffer chamber 195*a* may be provided on an underside surface of hydraulic cylinder barrel 187*a*. A corresponding drainage port 207*b* may be provided for buffer chamber 195*b*. Drainage ports 207*a*, 207*b* may allow drainage of any liquids that may have accumulated in each of buffer chambers 195*a*, 195*b* respectively. Alternately or additionally such liquids may be able to be drained from an outlet in a holding tank 1214.

Figure 5:
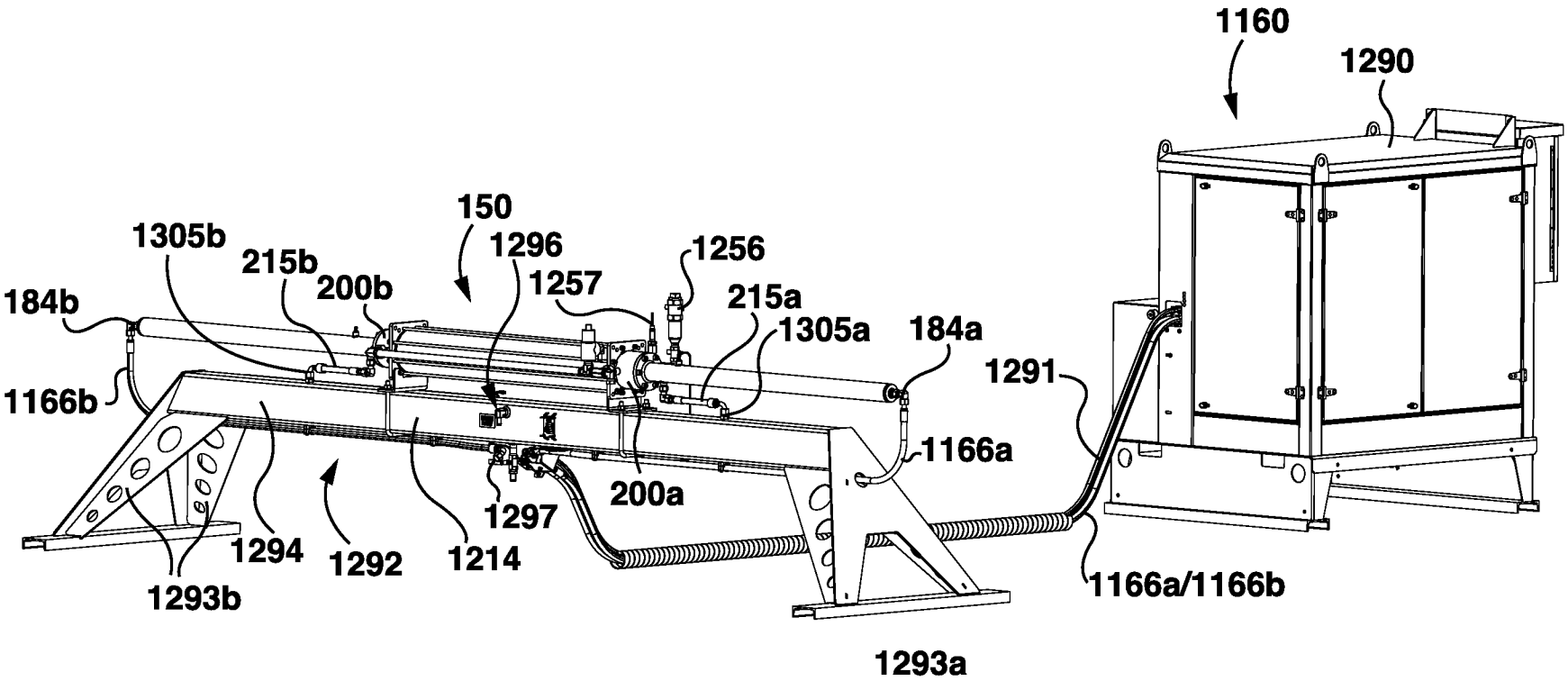
FIG. 5 is a perspective view of a gas compressor system including the gas compressor of FIG. 2 forming part of an oil and gas producing well systems of FIG. 1 or 1D.
Figure 6:
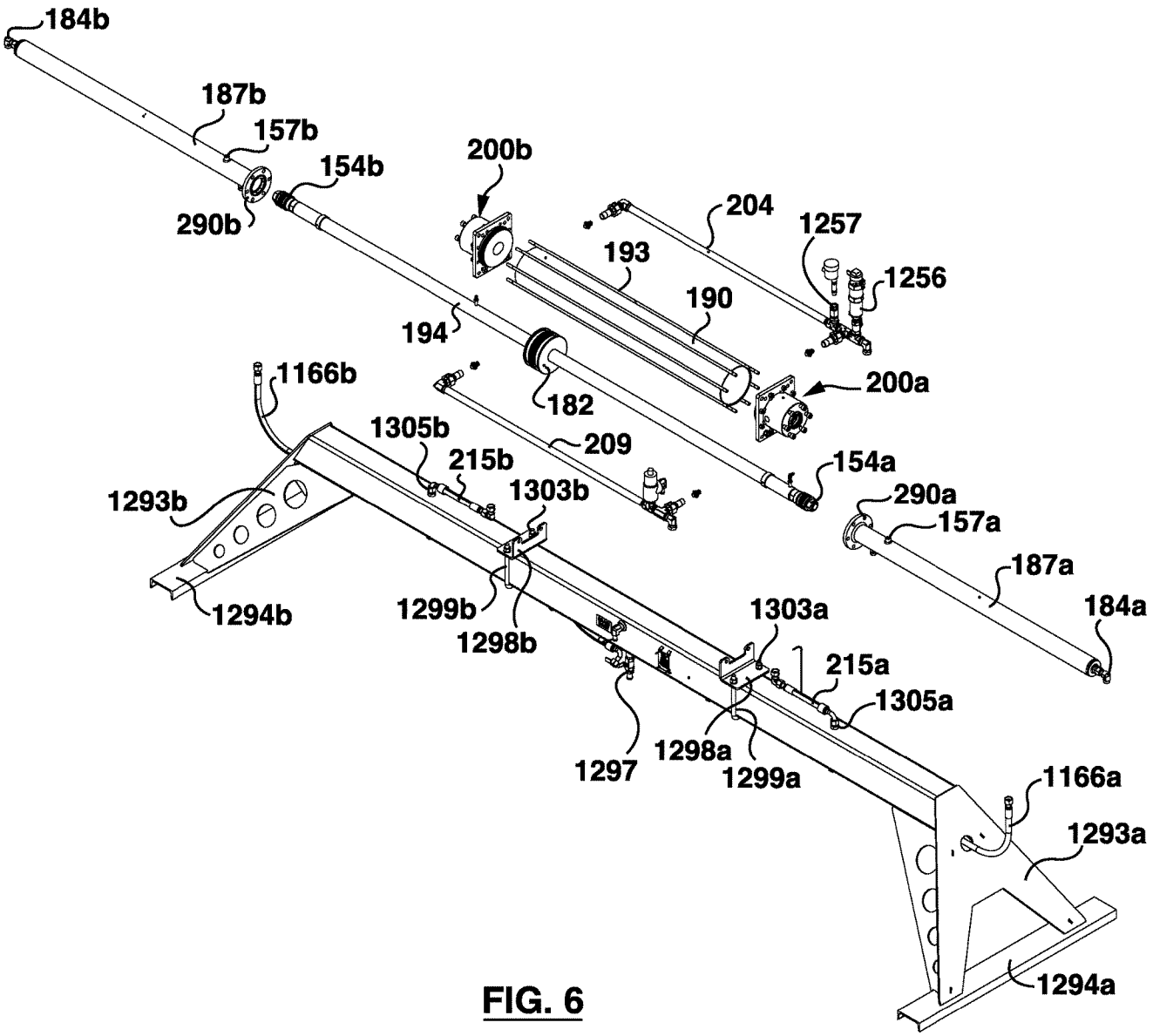
FIG. 6 is a perspective view of a portion of the gas compressor system of FIG. 5 with some parts thereof exploded.

As illustrated in FIGS. 5 and 6, gas compressor system 126 may include a cabinet enclosure 1290 for holding components of hydraulic fluid supply system 1160 including pump unit 1174, prime mover 1175, reservoir 1172, shuttle device 1168, filters 1182 and 1171, thermal valve device 1142 and cooler 1143. Controller 200 may also be held in cabinet enclosure 1290. One or more electrical cables 1291 may be provided to provide power and communication pathways with the components of gas compressor system 126 that are mounted on a support frame 1292. Additionally, piping 124 (FIG. 1) carrying natural gas to compressor 150 may be connected to connector 250 when gas compressor 150 is mounted on support frame 1292 to provide a supply of natural gas to gas compressor 150.

Gas compressor system 126 may thus also include a support frame 1292. Support frame 1292 may be generally configured to support gas compressor 150 in a generally horizontal orientation. Support frame 1292 may include a longitudinally extending hollow tubular beam member 1295 which may be made from any suitable material such as steel or aluminium. Beam member 1295 may be supported proximate each longitudinal end by pairs of support legs 1293*a*, 1293*b* which may be attached to beam member 1295 such as by welding. Pairs of support legs 1293*a*, 1293*b* may be transversely braced by transversely braced support members 1294*a*, 1294*b* respectively that are attached thereto such as by welding. Support legs 1293*a*, 1293*b* and brace members 1294*a*, 1294*b* may also be made from any suitable material such as steel or aluminium.

Figure 9C:
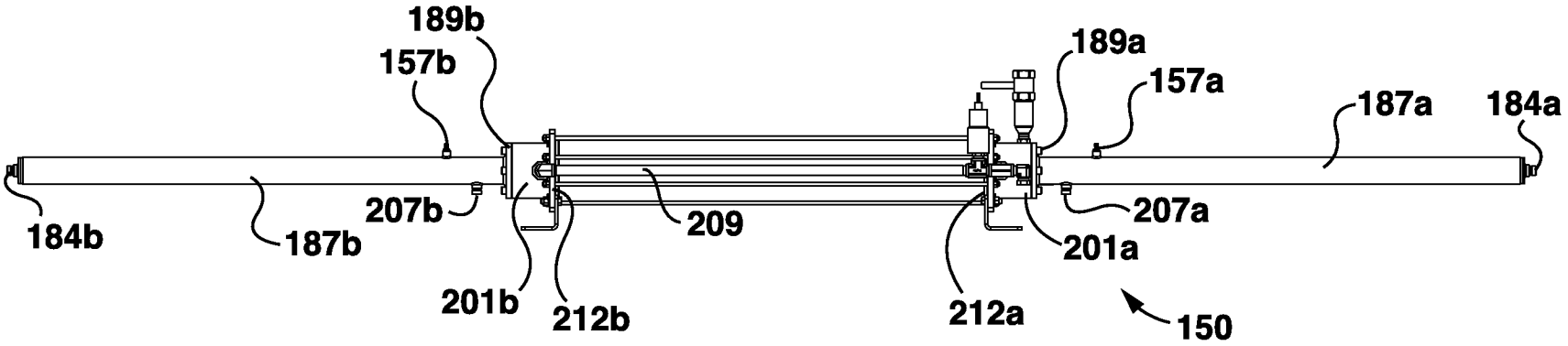
FIG. 9C is a side view of the gas compressor of FIG. 2.

Mounted to an upper surface of beam member 1295 may be L-shaped, transversely oriented support brackets 1298*a*, 1298*b* that may be appropriately longitudinally spaced from each other (see also FIGS. 8 to 9C). Support brackets 1298*a*, 1298*b* may be secured to beam member 1295 by U-members 1299*a*, 1299*b* respectively that are secured around the outer surface of beam member 1295 and then secured to support brackets 1298*a*, 1298*b* by passing threaded ends through openings 1300*a*, 1300*b* and securing the ends with pairs of nuts 1303*a*, 1303*b* (FIG. 6). Support bracket 1298*a* may be secured to gas cylinder head plate 212*a* by bolts received through aligned openings in support bracket 1298*a* and gas cylinder head plate 212*a*, secured by nuts 1303*a*. Similarly, support bracket 1298*b* may be secured to gas cylinder head plate 212*b* by bolts received through aligned openings in support bracket 1298*b* and gas cylinder head plate 212, secured by nuts 1303*b*. In this way, gas compressor 150 may be securely mounted to and supported by support frame 1292.

Hydraulic fluid communication lines 1166*a*, 1166*b* extend from ports 184*a*, 184*b* respectively to opposite ends of support frame 1294 and may extend under a lower surface of beam member 1295 to a common central location where they may then extend together to enclosure cabinet 1290 housing shuttle valve device 1168.

Tubular beam member 1295 may be hollow and may be configured to act as, or to hold a separate tank such as, holding tank 1214. Thus beam member 1285 may serve to act as a gas/liquid separation and holding tank and may serve to provide a gas reservoir for gas for buffer chamber system of buffer chambers 195*a*, 195*b*. Lines 215*a*, 215*b* may lead from ports of buffer chambers 195*a*, 195*b* into ports 1305*a*, 1305*b* into holding tank 1214 within tubular member 1295.

Holding tank 1214 within beam member 1295 may also have an externally accessible tank vent 1296 that allow for gas in holding tank 1214 to be vented out. Also, holding tank 1214 may have a manual drain device 1297 that is also externally accessible and may be manually operable by an operator to permit liquids that may accumulate in holding tank 1214 to be removed.

In operation of gas compressor system 126, including hydraulic gas compressor 150, the reciprocal movement of the hydraulic pistons 152*a*, 152*b*, can be driven by a hydraulic fluid supply system such as for example hydraulic fluid supply system 1160 as described above. The reciprocal movement of hydraulic pistons 154*a*, 154*b* will cause the size of the buffer chambers 195*a*, 195*b* to grow smaller and larger, with the change in size of the two buffer chambers 195*a*, 195*b* being for example 180 degrees out of phase with each other. Thus, as hydraulic piston 154*b* moves from position 1 to position 2 in FIG. 6 driven by hydraulic fluid forced into hydraulic fluid chamber 186*b*, some of the gas (e.g. air) in buffer chamber 195*b* will be forced into gas line(s) 215*a*, 215*b* (FIG. 7) that interconnect chambers 195*a*, 195*b*, and flow through holding tank 1214 towards and into buffer chamber 195*a*. In the reverse direction, as hydraulic piston 154*a* moves from position 2 to position 1 in FIG. 4 driven by hydraulic fluid forced into hydraulic fluid chamber 186*a*, some of the gas (e.g. air) in buffer chamber 195*a* will be forced into gas lines 215*a*, 215*b* and flow through holding tank 1214 towards and into buffer chamber 195*b*. In this way, the gas in the system of buffer chambers 195*a*, 195*b* can be part of a closed loop system, and gas may simply shuttle between the two buffer chambers 195*a*, 195*b*, (and optionally through holding tank 1214) thus preventing contaminants that may move into buffer chambers 195*a*, 195*b* from gas cylinder sections 181*a*, 181*b* respectively, from contaminating the outside environment. Additionally, such a closed loop system can prevent any contaminants in the outside environment from entering the buffer chambers 195*a*, 195*b* and thus potentially migrating into the hydraulic fluid chambers 186*a*, 186*b* respectively.

Gas compressor system 126 may also include a natural gas communication system to allow natural gas to be delivered from piping 124 (FIG. 1) to the two gas compression chamber sections 181*a*, 181*b* of gas compression cylinder 180 of gas compressor 150, and then communicate the compressed natural gas from the sections 181*a*, 181*b* to piping 130 for delivery to oil and gas flow line 133.

With reference to FIG. 2 in particular, the natural gas communication system may include a first input valve and connector device 250, a second input valve and connector device 260, a first output valve and connector device 261 and a second output valve and connector device 251. A gas input suction distribution line 204 fluidly interconnects input valve and connector device 250 with input valve and connector device 260. A gas output pressure distribution line 209 fluidly interconnects output valve and connector device 261 with valve and connector device 251.

Figure 3:
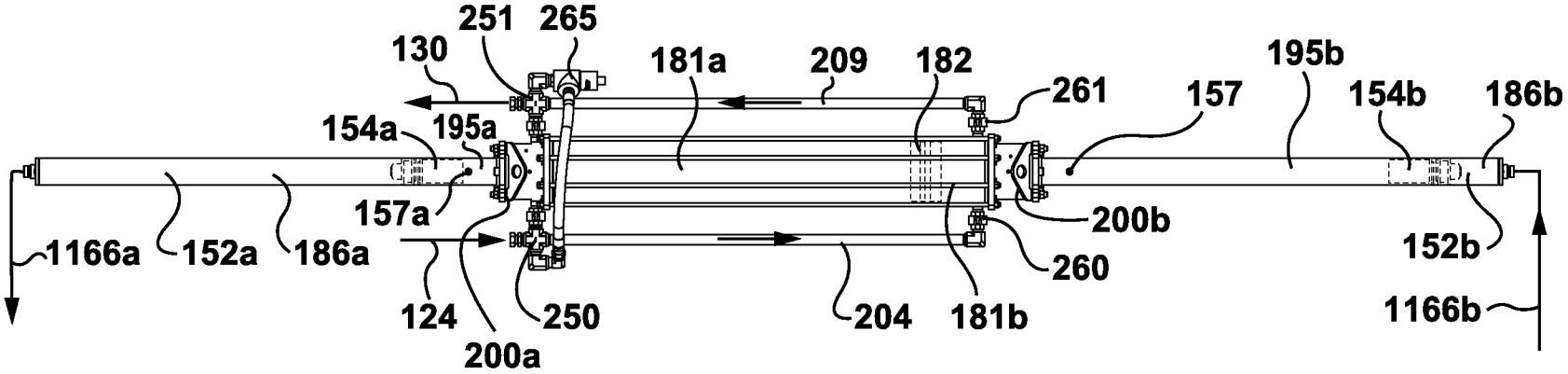
FIGS. 3 (i) to (iv) are side views of the gas compressor or FIG. 2 showing a cycle of operation.

With reference also to FIGS. 8, 8A and 8B, input valve and connector device 250 may include a gas compression chamber section valve and connector, a gas pipe input connector, and a gas suction distribution line connector. In an embodiment as shown in FIGS. 2 and 3(*i*) to (*iv*) an excess pressure valve and bypass connector is also provided. In an alternate embodiment as shown in FIGS. 8 to 9C, there is no bypass connector. However, in this latter embodiment there is a lubrication connector 1255 to which is attached in series to an input port of a lubrication device 1256 comprising suitable fittings and valves. Lubrication device 1256 allows a lubricant such as a lubricating oil (like WD-40 oil) to be injected into the passageway where the natural gas passes though connector device 250. The WD40 can be used to dissolve hydrocarbon sludges and soots to keep seals functional.

An electronic gas pressure sensing/transducer device 1257 may also be provided which may for example be a model AST46HAP00300PGT1L000 made by American Sensor technologies. This sensor reads the casing gas pressure.

Gas pressure sensing device/transducer 1257 may be in electronic communication with controller 200 and may provide signals to controller 200 indicative of the pressure of the gas in the casing/gas distribution line 204. In response to such signal, controller 200 may modify the operation of system 100 and in particular the operation of hydraulic fluid supply system 1160. For example, if the pressure in gas suction distribution line 204 descends to a first threshold level (e.g. 8 psi), controller 200 can control the operation of hydraulic fluid supply system 170 to slow down the reciprocating motion of gas compressor 150, which should allow the pressure of the gas that is being fed to connector device 250 and gas suction distribution line 204 to increase. If the pressure measured by sensing device 1257 reaches a second lower threshold—such that it may be getting close to zero or negative pressure (e.g. 3 psi) controller 200 may cause hydraulic fluid supply system 1160 to cease the operation of gas compressor 150.

Hydraulic fluid supply system 1160 may then be re-started by controller 200, if and when the pressure measured by gas pressure sensing device/transducer 1257 again rises to an acceptable threshold level as detected by a signal received by controller 200.

The output port of gas pressure sensing device 1257 may be connected to an input connector of gas suction distribution line 204.

With reference to FIGS. 8A and 8B, output valve and connector device 251 may include a gas compression chamber section valve, gas pipe output connector 205 and a gas pressure distribution line connector 263. In an embodiment as shown in FIG. 2, an excess pressure valve and bypass connector is also provided. In an alternate embodiment as shown in FIGS. 8 to 9C, there is no bypass connector.

With reference to the embodiment of FIGS. 2 and 3(*i*) to 3(*iv*), a pressure relief valve 265 is provided limit the gas discharge pressure. In some embodiments, relief valve 265 may discharge pressurized gas to the environment. However, in this illustrated embodiment, the relieved gas can be sent back through a bypass hose 266 to the suction side of the gas compressor 150 to limit environmental discharge. One end of a bypass hose 266 may be connected for communication of natural gas from a port of an excess gas pressure bypass valve 265 (FIG. 2). The opposite end of bypass port may be connected to an input port of connector 250. The output port from bypass valve 265 may provide one way fluid communication through bypass hose 266 of excessively pressured gas in for example gas output distribution line 209, to connector 250 and back to the gas input side of gas compressor 150. Thus, once the pressure is reduced to a level that is suitable for transmission in piping 120 (FIG. 2A), gas pressure relief valve will close.

With reference to FIGS. 8 and 8B, installed within connector 250 is a one way check valve device 1250. When connector 250 is received in an opening 1270 on the inward seal side of casing 201*a*, gas may flow through connector 250 and its check valve device 1250, through casing 201*a* into gas compression chamber section 181*a*. Similarly within connector 251 is a one way check valve device 1251. When connector 262 is received in an opening 1271 on the inward seal side of casing 201*b*, gas may flow out of gas compression chamber section 181*a* through casing 201*a*, and then through one-way valve device 1251 of connector 251 where gas can then flow through output connector 205 (FIG. 2) into piping 130 (FIG. 1).

The check valve device 1250 associated with connector 250 is operable to allow gas to flow into casing 201*a* and gas compression chamber section 181*a*, if the gas pressure at connector 250 is higher than the gas pressure on the inward side of the check valve device 1250. This will occur for example when gas compression chamber section 181*a* is undergoing expansion in size as gas piston 182 moves away from head assembly 200*a* resulting in a drop in pressure within compression chamber section 181*a*. Check valve device 1251 is operable to allow gas to flow out of casing 201*a* and gas compression chamber section 181*a*, if the gas pressure in gas compression chamber section 181*a* and casing 201*a* is higher than the gas pressure on the outward side of check valve device 1251 of connector 251, and when the gas pressure reaches a certain minimum threshold pressure that allows it to open. The check valve device 1251 may be operable to be adjusted to set the threshold opening pressure difference that causes/allows the one way valve to open. The increase in pressure gas compression chamber section 181*a* and casing 201*a* will occur for example when gas compression chamber section 181*a* is undergoing reduction in size as gas piston 182 moves towards from head assembly 200*a* resulting in an increase in pressure within compression chamber section 181*a*.

With reference to FIG. 8, at the opposite end of gas suction distribution line 204 to the end connected to gas pressure sensing device 1257, is a second input connector 260. Installed within connector 260 is a one way check valve device 1260. When connector 260 is received in an opening on the inward seal side of casing 201*b*, gas may flow from gas distribution line 204 through connector 260 and valve device 1260, through casing 201*b* into gas compression chamber section 181*b*.

Similarly at the opposite end of gas pressure distribution line 209 to the end connected to connector 210, is an output connector 261. Installed within connector 261 is a one way check valve device 1261. When connector 261 is received in an opening on the inward seal side of casing 201*b*, gas may flow out of gas compression chamber section 181*b* through casing 201*b* and then through valve device 1261 and connector 261 where pressurized gas can then flow through gas pressure distribution line 209 to output connector 205 and into piping 130 (FIG. 1).

One way check valve device 1260 is operable to allow gas to flow into casing 201*b* and gas compression chamber section 181*b*, if the gas pressure at connector 260 is higher than the gas pressure on the inward side of check valve device 1260. This will occur for example when gas compression chamber section 181*b* is undergoing expansion in size as gas piston 182 moves away from head assembly 200*b* resulting in a drop in pressure within compression chamber section 181*b*. One way check valve device 1261 is operable to allow gas to flow out of casing 201*b* and gas compression chamber section 181*b*, if the gas pressure in gas compression chamber section 181*b* and casing 201*b* is higher than the gas pressure on the outward side of check valve device 1261 of connector 261, and when the gas pressure reaches a certain minimum threshold pressure that allows it to open. The check valve device 1261 may be operable to be adjusted to set the threshold opening pressure difference that causes/allows the one way valve to open. The increase in pressure gas compression chamber section 181*b* and casing 201*b* will occur for example when gas compression chamber section 181*b* is undergoing reduction in size as gas piston 182 moves towards from head assembly 200*b* resulting in an increase in pressure within compression chamber section 181*b*.

With particular reference to FIG. 8B, interposed between an output end of gas pressure distribution line 209 and valve and connector 251 may be a bypass valve 1265. If the gas pressure in gas pressure distribution line 209 and/or in connector 250, reaches or exceeds a pre-determined upper pressure threshold level, excess pressure valve 1265 will open to relieve the pressure and reduce the pressure to a level that is suitable for transmission into piping 130 (FIG. 1).

In operation of gas compressor 150, hydraulic pistons 154*a*, 154*b* may be driven in reciprocating longitudinal movement for example by hydraulic fluid supply system 1160 as described above, thus driving gas piston 182 as well. The following describes the operation of the gas flow and gas compression in gas compressor system 126.

With hydraulic pistons 154*a*, 154*b* and gas piston 182 in the positions shown in FIG. 3(*i*) natural gas will be already located in gas cylinder compression section 181*a*, having been previously drawn into gas cylinder compression section 181*a* during the previous stroke due to pressure the differential that develops between the outer side of one way valve device 1250 and the inner side of valve device 1250 as piston 182 moved from left to right. During that previous stroke, natural gas will have been drawn from pipe 124 through connector 202 and connector device 250 and its check valve device 1250 into gas compression chamber section 181*a*, with check valve 1251 of connector device 251 being closed due to the pressure differential between the inner side of check valve device 1251 and the outer side of check valve device 1251 thus allowing gas compression cylinder section 181*a* to be filled with natural gas at a lower pressure than the gas on the outside of connector device 251.

Thus, with the pistons in the positions shown in FIG. 3(*i*), hydraulic cylinder chamber 186*b* is supplied with pressurized hydraulic fluid in a manner such as is described above, thus driving hydraulic piston 154*b*, along with piston rod 194, gas piston 182 and hydraulic piston 154*a* attached to piston rod 194, from the position shown in FIG. 3(*i*) to the position shown in FIG. 3(*ii*). As this is occurring, hydraulic fluid in hydraulic cylinder chamber 186*a* will be forced out of chamber 186*a*, and flow as described above.

As hydraulic piston 154*b*, along with piston rod 194, gas piston 182 and hydraulic piston 154*a* attached to piston rod 194, move from the position shown in FIG. 3(*i*) to the position shown in FIG. 3(*ii*), natural gas will be drawn from supply line 124, through connector device 250 into gas suction distribution line 204, and then pass through input valve connector 260 and one way valve device 1260 and into gas compression section 181*b*. Natural gas will flow in such a manner because as gas piston 182 moves to the left as shown in FIGS. 3(*i*) to (*ii*), the pressure in gas compression chamber 181*b* will drop, which will create a suction that will cause the natural gas in pipe 124 to flow.

Simultaneously, the movement of gas piston 182 to the left will compress the natural gas that is already present in gas compression chamber section 181*a*. As the pressure rises in gas chamber section 181*a*, gas flowing into connector 250 from pipe 124 will not enter chamber section 181*a*. Additionally, gas being compressed in gas compression chamber section 181*a* will stay in gas compression chamber section 181*a* until the pressure therein reaches the threshold level of gas pressure that is provided by one way check valve device 1251. Gas being compressed in chamber section 181*a* can't flow out of chamber section 181*a* into connector 250 because of the orientation of check valve device 1250.

The foregoing movement and compression of natural gas and movement of hydraulic fluid will continue as the pistons continue to move from the positions shown in FIG. 3(*ii*) to the position shown in FIG. 3(*iii*). During that time, dependent upon the pressure in gas compression chamber section 181*a*, gas will be allowed to pass out of gas compression chamber section 181*a* through connector 251 and will pass into piping 130 once the pressure is high enough to activate one way valve device 1251.

Just before hydraulic piston 154*b* reaches the position shown in FIG. 3(*iii*), proximity sensor 157*b* will detect the presence of hydraulic piston 154*b* within hydraulic cylinder 152*b* at a longitudinal position that is a short distance before the end of the stroke within hydraulic cylinder 152*b*. Proximity sensor 157*b* will then send a signal to controller 200, in response to which controller 200 will change the operational configuration of hydraulic fluid supply system 1160, as described above. This will result in hydraulic piston 154*b* not being driven any further to the left in hydraulic cylinder 152*b* than the position shown in FIG. 3(*iii*).

Once hydraulic piston 154*b*, along with piston rod 194, gas piston 182 and hydraulic piston 154*a* attached to piston rod 194, are in the position shown in FIG. 3(*iii*), natural gas will have been drawn through connector 260 and one way valve device 1260 again due to the pressure differential that is developed between gas compression chamber section 181*b* and gas suction distribution pipe 204, so that gas compression chamber section 181*b* is filled with natural gas. Much of the gas in gas compression chamber 181*a* that has been compressed by the movement of gas piston 182 from the position shown in FIG. 3(*i*) to the position shown in FIG. 3(*iii*), will, once compressed sufficiently to exceed the threshold level of valve device 1251, have exited gas compression chamber 181*a* and pass from gas pipeline output connector 205 into piping 130 (FIG. 1) for delivery to oil and gas pipeline 133. If the gas pressure is too high to be received in piping 130, excess valve and bypass connector 265/1265 will be opened to allow excess gas to exit to reduce the pressure.

Next, gas compressor system 126, including hydraulic fluid supply system 1160 is reconfigured for the return drive stroke. As natural gas has been drawn into gas compression cylinder section 181*b* it is ready to be compressed by gas piston 182. With hydraulic pistons 154*a*, 154*b* and gas piston 182 in the positions shown in FIG. 3(*iii*), hydraulic cylinder chamber 186*a* is supplied with pressurized hydraulic fluid by hydraulic fluid supply system 1160 for example as described above. This movement drives hydraulic piston 154*a*, along with piston rod 194, gas piston 182 and hydraulic piston 154*a* attached to piston rod 194, from the position shown in FIG. 3(*iii*) to the position shown in FIG. 3(*iv*). As this is occurring, hydraulic fluid in hydraulic cylinder chamber 186*b* will be forced out of the hydraulic fluid chamber 186*a* and may be handled by hydraulic fluid supply system 1160 as described above.

As hydraulic piston 154*a*, along with piston rod 194, gas piston 182 and hydraulic piston 154*b* attached to piston rod 194, move from the position shown in FIG. 5(*iii*) to the position shown in FIG. 3(*iv*), natural gas will be drawn from supply line 124, through connector 253 of valve and connector device 250 into gas compression section 181*a* due the drop in pressure of gas in gas compression section 181*a*, relative to the gas pressure in supply line 124 and the outside of connector 250. Simultaneously, the movement of gas piston 182 will compress the natural gas that is already present in gas compression section 181*b*. As the gas in gas compression chamber 181*b* is being compressed by the movement of gas piston 182, once the gas pressure reaches the threshold level of valve device 1261 to be activated, gas will be able to exit gas compression chamber 181*b* and pass through connector 261, into gas pressure distribution line 209 and then pass through output connector 205 into piping 130 (FIG. 3) for delivery to oil and gas pipeline 133. Again, if the gas pressure is too high to be received in piping 130, excess valve and bypass connector 265/1265 will be opened to allow excess gas to exit to reduce the gas pressure in gas pressure distribution line 209 and piping 130.

The foregoing movement and compression of natural gas and hydraulic fluid will continue as the pistons continue to move from the positions shown in FIG. 3(*iv*) to return to the position shown in FIG. 3(*i*). Just before piston 154*a* reaches the position shown in FIG. 3(*i*), proximity sensor 157*a* will detect the presence of hydraulic piston 154*a* within hydraulic cylinder 152*a* at a longitudinal position that is shortly before the end of the stroke within hydraulic cylinder 152*a*. Proximity sensor 157*a* will then send a signal to controller 200, in response to which controller 200 will reconfigure the operational mode of hydraulic fluid supply system 1160 as described above. This will result in hydraulic piston 154*a* not be driven any further to the right than the position shown in FIG. 3(*i*).

Once hydraulic piston 154*a*, along with piston rod 194, gas piston 182 and hydraulic piston 154*b* attached to piston rod 194, are in the position shown in FIG. 3(*i*), natural gas will have been drawn through valve and connector 253 so that gas compression chamber section 181*a* is once again filled and controller 200 will send a signal to the hydraulic fluid supply system 1160 so that gas compressor system 126 is ready to commence another cycle of operation.

During the operation of the gas compressor 150 as described above, any contaminants that may be carried with the natural gas from supply pipe 124 will enter into gas compression chamber sections 181*a*, 181*b*. However, the components of seal devices 198*a*, 198*b* associated with casings 201*a*, 201*b*, as described above, will provide a barrier preventing, or at least significantly limiting, the migration of any contaminants out of gas compression chamber sections 181*a*, 181*b*. However, any contaminants that do pass seal devices 198*a*, 198*b* are likely to be held in respective buffer chambers 195*a*, 195*b* and in combination with seal devices 196*a*, 196*b* of hydraulic pistons 154*a*, 154*b* respectively, may prevent contaminants from entering into the respective hydraulic cylinder chambers 186*a*, 186*b*. Particularly if buffer chambers 195*a*, 195*b* are pressurized, such as with pressurized air or a pressurized inert gas, then this should greatly restrict or inhibit the movement of contaminants in the natural gas in gas compression chamber sections 181*a*, 181*b* from migrating into buffer chambers 195*a*, 195*b*, thus further protecting the hydraulic fluid in hydraulic cylinder chambers 186*a*, 186*b*.

It should be noted that in use, hydraulic gas compressor 150 may be oriented generally horizontally, generally vertically, or at an angle to both vertical and horizontal directions.

While the gas compressor system 126 that is illustrated in FIGS. 1 to 9C discloses a single buffer chamber 195*a*, 195*b* on each side of the gas compressor 150 between the gas compression cylinder 180 and the hydraulic fluid chambers 186*a*, 186*b*, in other embodiments more than one buffer chamber may be configured on one or both sides of gas compression cylinder 180. Also, the buffer cavities may be pressurized with an inert gas to a pressure that is always greater than the pressure of the gas in the gas compression chambers so that if there is any gas leakage through the gas piston rod seals, that leakage is directed from the buffer chamber(s) toward the gas compression chamber(s) and not in the opposite direction. This may ensure that no dangerous gases such as hydrogen sulfide ($H_2S$) are leaked from the gas compressor system.

Adaptive Control System for Hydraulic Gas Compressor

As one skilled in the art will appreciate, it is desirable to provide efficient gas compression when operating a gas compressor as disclosed herein. Ideally, the maximum gas compression can be achieved if the gas piston in the gas compression chamber, such as gas piston 182 in gas compressor 150, is driven to reach and contact the end of the gas compression chamber at the end of each stroke. In fact, in some conventional hydraulic gas compression systems, the gas piston is driven in each direction until a face of the gas piston hits an end of the gas compression chamber (referred to as "physical end of stroke") before the hydraulic driving pressure is reversed in direction to drive the gas piston in the opposite direction. However, the impact of the physical contact between the faces of the gas piston and the ends of the gas compression chamber can produce loud noises and cause wear and tear of components in the gas compressor, thus reducing their useful lifetime.

To avoid such impact, in some existing gas compressing systems, the hydraulic pump used to apply hydraulic pressure on the gas piston is controlled to reverse the direction of the applied pressure before the gas piston contacts each end of the gas compressor chamber, based on, for example, the measured position and speed of the gas piston. However, as it is difficult to predict precisely when the piston will hit the physical end of stroke, many systems overcompensate by reversing the applied driving pressure when the piston is still a large distance away from the physical end. As a result, the gas compression efficiency is significantly reduced. Some techniques exist to provide more precise measurement of the piston position and speed but such techniques typically require expensive sensing and control equipment, and the sensors used also take up large physical space. For example, in some existing systems full length position sensors are used along the entire length of the gas compressor in order to determine the position of the piston during the entire stroke length in real time, so that the transition between strokes can be controlled to avoid physical end of stroke. However, such a technique requires precise and fast position detection along the full-length of the cylinder and suitable sensors for such detection can be expensive, and with the added sensors and related equipment the gas compressor can become bulky.

It has been recognized that an adaptive control method based on detected speed of the gas piston, the temperature of the hydraulic driving fluid, and the load pressure applied on the piston at certain piston position can provide effective control of the movement of the gas piston using relatively inexpensive proximity sensors, temperature sensors and pressure sensors.

In an embodiment, the adaptive control may be implemented as illustrated in FIG. 10A for controlling a gas compressor 150' which is modified from gas compressor 150 as explained below.

A hydraulic fluid supply system 1160', which may be similar to the supply system 1160, is provided to supply a hydraulic driving fluid for applying a driving force on gas piston 182.

As discussed with reference to gas compressor 150, the driving force (or pressure) is cyclically reversed between left and right directions in the view as illustrated in FIG. 10A to cause gas piston 182 to reciprocate in strokes. As in gas compressor 150, two proximity sensors 157*a* and 157*b* are provided and positioned to provide timing and position signals for monitoring the position and speed of travel of gas piston 182 during each stroke. For example, proximity sensor 157*b* may be positioned to detect whether gas piston 182 is at or near a predefined end of stroke positon on the left hand side, near chamber end 1008, as shown in FIG. 10A (this position is referred to as "Position 1" for ease of reference), and proximity sensor 157*a* may be positioned to detect whether gas piston 182 is at or near a predefined end of stroke position on the right hand side (this position is referred to as "Position 2"), near chamber end 1010. In some embodiments, gas compressor 150 and proximity sensors 157*a* and 157*b* may be configured so that proximity sensor 157*b* is in an "on" state when gas piston 182 is at or near Position 1, and is in an "off" state when gas piston 182 is not at or near Position 1; and proximity sensor 157*a* is in an "on" state when gas piston 182 is at or near Position 2, and is in an "off" state when gas piston 182 is not at or near Position 2.

As in system 1160, a pressure sensor 1004 may be provided at each of ports P and S respectively and the pressure sensors 1004 are used to detect the fluid pressures applied by the pump unit 1174 to the respective hydraulic pistons 154*a*, 154*b*, which can be used to calculate the load pressure applied on gas piston 182.

In addition, a temperature sensor 1006 is also provided for controlling the pump unit 1174 in system 1160'. The temperature sensor 1006 is positioned and configured to detect the temperature of the hydraulic driving fluid in the hydraulic fluid chambers 186*a*, 186*b*. The temperature sensor 1006 may be placed at any suitable location along the hydraulic fluid loop. For example, in an embodiment, the temperature sensor 1006 may be positioned at a fluid port.

Controller 200' may include hardware and software as discussed earlier, including hardware and software configured to receive and process signals from proximity sensors 157*a*, 157*b* and for controlling the operation of pump unit 1174, but is modified to also receive signals from pressure sensors 1004 and temperature sensor 1006 and processing these signals, and the signals form the proximity sensors 157*a*, 157*b* for controlling the pump unit 1174.

Optionally, end-of-stroke indicators 1002*a*, 1002*b* may be provided and positioned relative to the respective hydraulic fluid chambers 186*a*,186*b* to provide signals to controller 200' when the terminal ends of hydraulic pistons 154*a*, 154*b* reach preselected positions which are referred to as the "pre-defined end of stroke position" in the respective stroke direction. The pre-defined end of stroke positions are selected such that when the corresponding terminal end of the corresponding hydraulic piston 154*a*, 154*b* is at the corresponding pre-defined end of stroke position, the gas piston is almost at the physical end of stroke but is not yet in contact with the corresponding chamber wall in the gas chamber. For example, in an embodiment, a pre-defined end of stroke position may be 0.5" away from a terminal end wall of the hydraulic fluid chamber 186*a*, 186*b*. When end-of-stroke indicators 1002*a*, 1002*b* are provided, controller 200' is configured to receive signals from the end-of-stroke indicators 1002*a*, 1002*b* and process these signals to determine whether an end of stroke has been reached during each stroke.

During operation, controller 200' receives signals from the proximity sensors 157*a*, 157*b*, pressure sensor(s) 1004, temperature sensor 1006, and optionally end of stroke indicators 1002*a*,1002*b*, during each stroke. Controller 200' then determines a time interval for operating pump unit 1174 to pump in a reversed direction based on the received signal, or determines a next reversal time $T_r$ for reversing the pumping direction. Controller 200' controls pump unit 1174 to reverse the pump's pumping direction at the determined time $T_r$, for the determined time interval, which is referred to as the "lag time" (LP) for each pump cycle.

It may be appreciated that time $T_r$ is not the time when the gas piston 182 is at the end of stroke, which can be either the physical end of stroke or the pre-defined end of stroke position. There may be a time lag between the reversal of the pumping direction and the actual end of stroke due to movement inertia. That is, a pump cycle does not completely overlap in time with the piston stroke cycle due to movement inertia as the piston may still move some distance in the original direction after the pumping direction has been reversed.

Thus, a control algorithm may be provided to predict when to reverse the pumping direction so that the gas piston 182 will be very close to the physical end of stroke at the actual end of each stroke but will not actually contact the gas chamber end walls during operation.

Figure 10B:
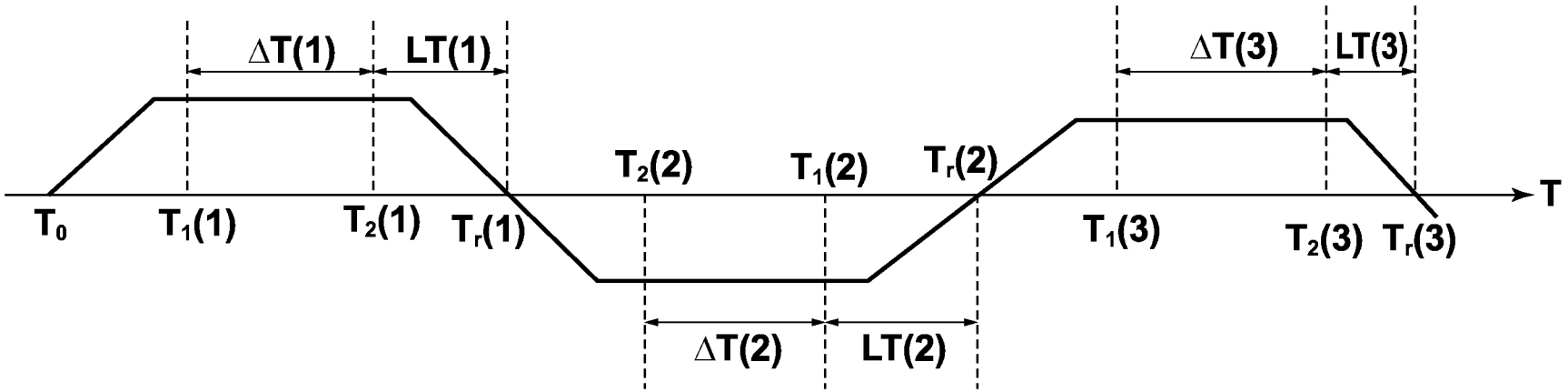
FIG. 10B is a diagram illustrating the pressure profile in different pump cycles during use of the pump unit shown in FIG. 10A.

In an embodiment, $T_r$ or LT may be determined as follows, as illustrated in FIG. 10B. For clarity, it is noted that FIG. 10B illustrates the pump cycle. As can be appreciated, pump unit 1174 is typically operated to apply the driving force on gas piston 182 cyclically in opposite directions, where the pump pressure is ramped up or down at the beginning and end of each pump cycle. An illustrative driving force profile over time (which may be similar to the pump control signal profile) is shown in FIG. 10B. It is noted that the numbers in parentheses, e.g. "(1)", "(2)", "(3)", etc., in FIG. 10B indicate the pump cycle number for identification purposes only.

Assuming pump Cycle 1 starts at time $T_0$, when the hydraulic pump in pump unit 1174 starts to ramp up to a set pumping speed to provide a selected driving force or pressure (referred to as +P for ease of discussion) applied on gas piston 182, the gas piston 182 is driven by the driving force to move towards one end (e.g. the end on the right hand side in FIG. 10B) of the gas chamber in a first direction (e.g. the right direction).

In this regard, the pump output flow rate may be controlled based on a fixed input electrical signal. The pump may have an internal mechanism to provide the required flow rate precisely using internal mechanical feedback to self-compensate. This is helpful in a compression system where the load pressure may be constantly changing and a constant output flow rate is desirable.

Assuming gas piston 182 is initially at Position 1, or reaches Position 1 sometime after $T_0$, gas piston 182 will leave Position 1 at some point in time, T1(1), and this can be determined by controller 200' based on a signal received from proximity sensor 157*b* (such as when proximity sensor 157*b* turns off from an "on" state). Thus, proximity sensor 157*b* can be used to detect the time, T1(1), at which time gas piston 182 leaves Position 1. As gas piston 182 continues to move right and reaches Position 2, at time T2(1), proximity sensor 157*a* detects that gas piston 182 has reached Position 2 and sends a signal to controller 200' to indicate that gas piston 182 has reached Position 2 at time T2(1). At this time, controller 200' receives, or may have received, signals from pressure sensor(s) 1104 and temperature sensor 1106 for determining a load pressure, LP(1), applied on gas piston 182 at time T2(1) and a fluid temperature of the hydraulic driving fluid, FT(1).

At time T2(1), or very shortly thereafter, controller 200' calculates, according to a pre-defined algorithm, as will be further discussed below, a lag time or the reversal time for the next pump cycle. The relationship between LT(1) and Tr(1) is Tr(1)=T2(1)+LT(1). That is, once LT(1) is determined, the pump reversal time Tr(1) for reversing the pumping direction of the hydraulic pump and thus the direction of the hydraulic driving pressure (driving force) on gas piston 182 can be determined. The hydraulic pump may be operated to ramp down at a selected time interval before Tr(1), as illustrated in FIG. 10B.

In a particular embodiment, the lag time LT for each pump cycle may be calculated based on three contribution factors, denoted as f(V), f(LP), and f(FT) for ease of reference.

V is the average speed of gas piston 182 during a piston stroke, and can be calculated as V=D/ΔT, where D is the distance traveled by gas piston 182 between times T1 and T2 and ΔT (=|T2−T1|) is the corresponding travel time. The lag time contribution f(V) may be determined based on a pre-stored mapping table or a predetermined formula. The mapping table or formula may be based on empirical data, and may be updated during operation based on further data collected during operation. For example, the values in the mapping table may be initially set at values lower than the expected values for safety, such as by −50 milliseconds (ms), and be updated during operation so that each value in the mapping table is incremented by 1 ms in the required speed range until an end of stroke flag is detected. The values in the mapping table may be subtracted by 25 ms every time a physical end of stroke has occurred. The mapping table may include different tables for different speed ranges so that closer mapping over each range can be achieved. In some embodiments, reduction of the values in the mapping tables may be limited to a maximum reduction of 250 ms below the expected or initial values.

As noted above, LP is the Load Pressure experienced by gas piston 182, and can be calculated as the pressure differential between the fluid pressures applied at the opposite ends of gas compressor 150', or the pressure difference between the fluid pressures in hydraulic fluid lines 1163*a* and 1163*b*. The lag time contribution f(LP) may be determined based on an empirical formula, such as $$f(LP)=a\times LP+b, \text{ or } f(LP)=a\times(b-LP),$$

where parameters "a" and "b" may be determined or selected based on empirical data obtained on the same or similar systems.

The lag time contribution factor f(FT) may also be determined based on an empirical formula, such as $$f(FT)=d\times FT+e, \text{ or } f(FT)=d\times(e-FT)$$

where parameters "d" and "e" may be determined or selected based on empirical data obtained on the same or similar systems.

In selected embodiments, the total lag time may be a simple sum of f(V), f(LP), and f(FT), i.e., LT=f(V)+f(LP)+f(FT). In other embodiments, the overall lag time may be a weighted sum or another function of the three contributing factors.

The lag time LT may be calculated in a suitable time unit that provides effective and adequate pump control. It has been found that for some applications, millisecond (ms) is a suitable time unit.

Assuming LT is calculated as a simple sum of the three contributing factors, the LT for pump Cycle 1 is:

$$LT(1)=f(V(1))+f(LP(1))+f(FT(1)).$$

Tr(1) can then be determined as Tr(1)=T2(1)+LT(1). Pump unit 1174 is controlled by controller 200' to reverse pumping direction at Tr(1).

As can be appreciated, controller 200' may control the operation of pump unit 1174 in a number of different manners to achieve the same reversal timing. For example, instead of deterring the reversal timing directly, controller 200' may be configured to determine the time for commencing the ramp down, and adjust or calibrate this time. For a fixed ramp down interval (e.g. 300 ms), this would be equivalent to determining and adjusting the reversal timing. Further, the reversal time Tr(1) may also be calculated from the ramp down start time if the ramp down interval is known.

In any event, at Tr(1), pump Cycle 1 ends and the next cycle, pump Cycle 2 starts. In pump Cycle 2, pump unit 1174 is controlled by controller 200' to pump in the opposite direction as compared to Cycle 1 to drive gas piston in the second direction (e.g. in this example, the left direction as shown in FIG. 10A).

As the hydraulic pump ramps up in the opposite direction, to apply a driving force or pressure (−P) to drive gas piston towards the left direction, gas piston 182 will leave Position 2, which can be detected using proximity sensor 157*a* when it turns from the "on" state to the "off" state, and controller 200' can determine the time T2(2) at which gas piston 182 leaves Position 2 based on the signal received from proximity sensor 157*a*. When gas piston 182 returns to Position 1, proximity sensor 157*b* turns from off to on and produces and sends a signal to controller 200' to indicate that Position 1 is reached in Cycle 2 at time T1(2).

At time T1(2), controller 200' also receives, or may have received, signals from pressure sensor(s) 1104 and temperature sensor 1106 for determining a load pressure, LP(2) applied on gas piston 182 at time T1(2) and a fluid temperature of the hydraulic driving fluid, FT(2).

At time T1(2), or very shortly thereafter, controller 200' calculates a lag time for Cycle 2, LT(2), as: LT(2)=f(V(2))+f(LP(2))+f(FT(2)).

The next pump reversal time Tr(2) may be calculated Tr(2)=T1(2)+LT(2).

Controller 200' then controls pump unit 1174 to reverse pumping direction for the next cycle at time Tr(2), or to pump in the current direction for a time interval of LT(2) before reversing the pumping direction.

At Tr(2), the next pump cycle, Cycle 3 starts. The process continues similar to Cycle 1.

It may be appreciated that, LT(1), LT(2), and lag times for other pump cycles, may or may not be the same. The lag times can be conveniently adjusted in real time to account for changes in environment and operating conditions.

To provide improved efficiency, each lag time may also be adjusted based on other factors or events. For example, when end of stroke indicators 1002*a*, 1002*b* are provided, the signals received from the end of stroke indicators 1002*a*, 1002*b* may be taken into account. For instance, for pump Cycle 1 in the example of FIG. 10B, if controller 200' has not received a signal from end of stroke indicator 1002*a* to indicate that gas piston 182 has reached the predefined end of stroke position after Cycle 2, which means that the calculated value for LT(1) was not long enough, then the initially calculated LT(3) value may be increased by a pre-selected increment, such as 1 ms. This value should be sufficiently small to avoid possible physical end of stroke.

In another example, if a calculated LT is too long, a physical end of stroke will occur, which may be detected by monitoring any spike in the detected load pressure LP. When a physical end of stroke is detected, which may be considered as an "end of stroke event", the initially calculated LT for a subsequent pump cycle may be reduced by a selected amount, such as 25 ms. This reduction time should be sufficiently large to avoid a possible further physical end of stroke. This reduction may be implemented by reducing the values in the mapping table for speed contribution by 25 ms per occurrence of an end of stroke event, up to a maximum of 250 ms. The maximum may be selected to prevent run away adjustment, particularly when the physical end of stroke events are due to some other reasons instead of over-determined lag time.

As now can be appreciated, the above control process can take into account of the changes in environment and operation conditions in real time, and provide efficient gas compression while reducing the risks of physical end of stroke.

Figure 17:
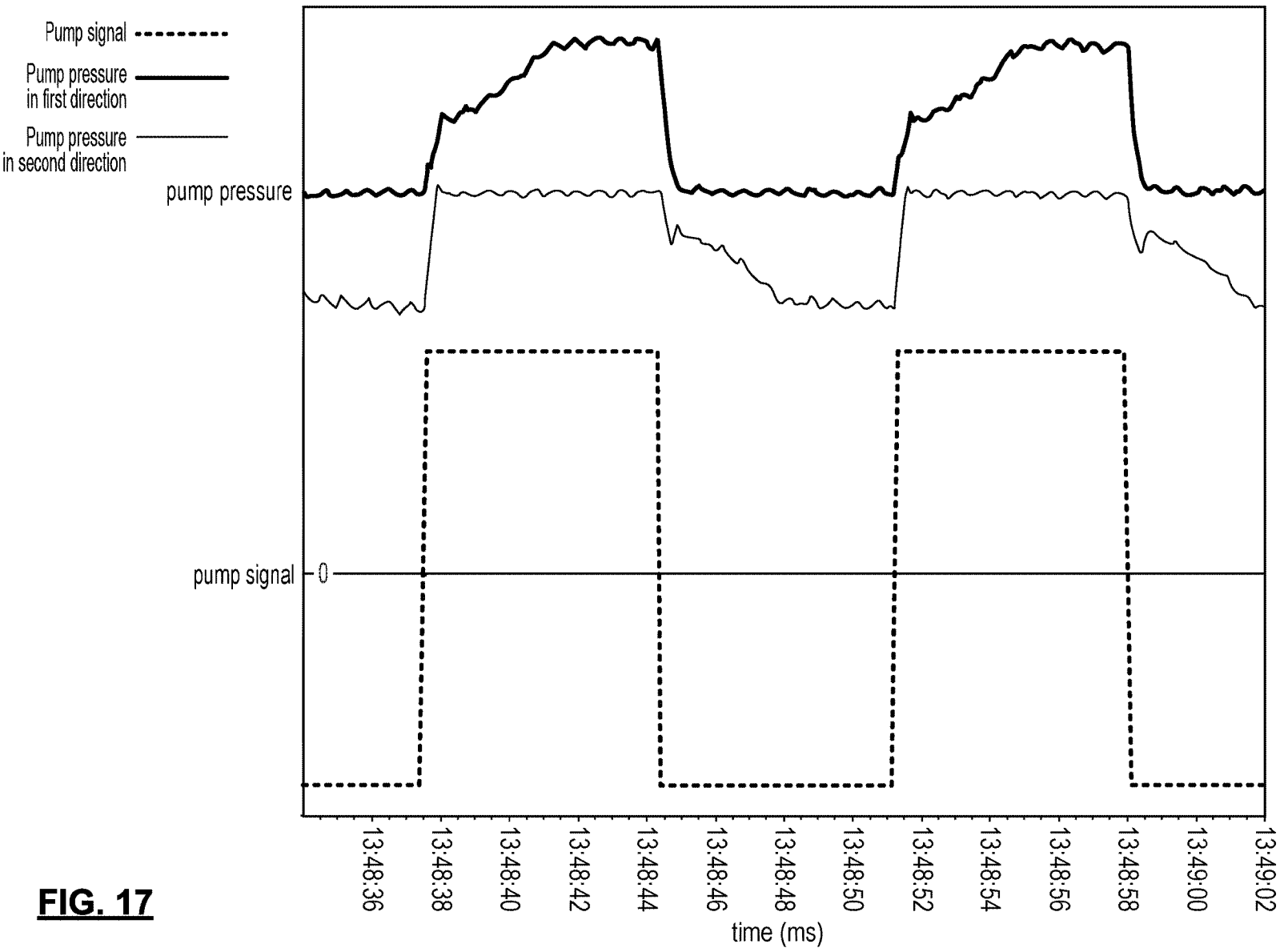
FIG. 17 is a line graph showing a realistic control (pump) signal applied to a hydraulic pump for driving a gas compressor and the corresponding pressure responses at the output ports of the pump.

A more realistic control signal (labelled as pump signal) profile applied to a pump for driving a gas compressor is shown in FIG. 17, with the corresponding pump pressure responses. The control signal is shown in the dash line, where the positive portions of the signal correspond to pump signals applied for driving the gas piston in a first direction and the negative portions correspond to pump signals applied for driving the piston in the opposite, second direction. The solid lines in FIG. 17 represent the corresponding pump pressures at the respective output ports of the pump, which may be measured at lines 1163*a* and 1163*b* (P and S ports) respectively as illustrated in FIG. 10A. The thicker solid line corresponds to the pump pressure applied in the first direction, in response to the positive portions of the pump signal. The thinner solid line corresponds to the pump pressure applied in the second direction, in response to the negative portions of the pump signal.

The system shown in FIG. 10A is described in further details below.

In FIG. 10A, self-calibrating gas compressor system 126' may be modified from gas compressor system 126 illustrated in FIG. 7. Gas compressor 150' may be modified from gas compressor 150 illustrated in FIG. 2 and FIG. 3(*i*)-3(*iv*)). Generally, gas compressor system 126' adaptively controls the operation of gas compressor 150' to provide improved gas compression therein via controller 200'. Gas compressor system 126' may be a closed loop system as illustrated, or may be an open loop system as can be understood by those skilled in the art. In an embodiment, an open loop system (not shown) may use a pump unit similar to the pump unit 1174 combined with a 4-way valve to drive the reciprocal movement of the gas compressor piston, as can be understood by those skilled in the art. In some embodiments, the buffer chamber may be omitted. The piston stroke length for gas piston 182 can be controlled such that gas piston 182 driven by hydraulic fluid supply system 1160' and controller 200' can travel nearly the full length gas compression chamber in gas cylinder 180 with reduced risks of physical end of stroke.

As illustrated, gas compressor 150' is in hydraulic fluid communication with hydraulic fluid supply system 1160'. Controller 200' is in electronic communication with the illustrated sensors, either by wired communication or wireless communication. Hydraulic fluid supply system 1160' is controlled by controller 200'. In particular, controller 200' may be configured and programmed for controlling the operation of pump unit 1174. Pump unit 1174 can receive a control signal from controller 200' and adjust its pumping speed and pumping direction based on the control signal, to apply the driving fluid provided by reservoir 1172 to alternately drive hydraulic pistons 154*a*, 154*b*, and thus gas piston 182.

As discussed above, pump unit 1174 includes outlet ports S and P for selectively and alternately delivering a pressurized hydraulic fluid to each of fluid communication line 1163*a* or 1163*b* respectively. Pressure sensors 1004 may be electrically connected to each of the output ports S and P to provide sensed pressure signals to controller 200' for determining a load pressure applied to piston 182.

One or more temperature sensors 1006 may be electrically connected to at least one of hydraulic cylinders 152*a* or 152*b* for sensing a temperature of the driving fluid contained therein during movement of pistons 182, 154*a*, and 154*b*. Temperature sensor 1006 may be in electrical communication with controller 200' for providing a sensed temperature signal to the controller 200'.

Gas compressor system 126' can self-calibrate the operation of the pump unit to control the movement of piston 182 based on V, LP and FT, as described herein.

Stroke Movement of Piston

A "stroke" refers to the movement of a piston, such as piston 182, within a gas compression chamber, such as chamber 181, in each direction from the beginning to the end during the piston's reciprocal linear movement in the chamber.

To achieve optimal gas compression, it is desirable for gas piston 182 to travel nearly the entire length between the end walls at ends 1008 and 1010. However, to avoid possible physical end of stroke, piston 182 may be controlled to travel between pre-defined end of stroke positions which may be at a distance of 0.5" from the respective end wall at ends 1008 and 1010.

In an embodiment, gas compressor 150' is driven by a controlled hydraulic fluid supply system 1160' and controller 200' to provide smooth transition between strokes of gas piston 182 and efficient gas compression. Controller 200' may be used to re-calibrate piston 182 displacement parameters to improve stroke efficiency during subsequent strokes based on data or signals indicative of the driving fluid temperature, piston speed, load pressure and stroke length information acquired during a prior stroke. As discussed herein, these signals can be derived from the pressure sensor 1004, the temperature sensor 1006, and proximity sensors 157*a* and 157*b*.

As noted above, sensors 1004, 1006, 157*a* and 157*b* may be electrically coupled to controller 200' or wirelessly coupled (e.g. across a network).

Gas compressor system 126' may generally operate in a similar manner as discussed with reference to gas compressor 126 of FIG. 7 but performs additional control actions and calculations as described above.

In an embodiment, controller 200' of FIG. 10A may be further programmed to use additional sensor data obtained from gas compressor 150' to improve stroke displacement of gas piston 182 during operation of gas compressor 150'. Controller 200' is configured for controlling driving fluid supply system 1160' to provide smooth transitions between strokes while maximize or optimize gas compression efficiency.

For example, controller 200' may be programmed in such a manner to control hydraulic fluid supply system 1160' to ensure a smooth transition between strokes.

Figure 13:
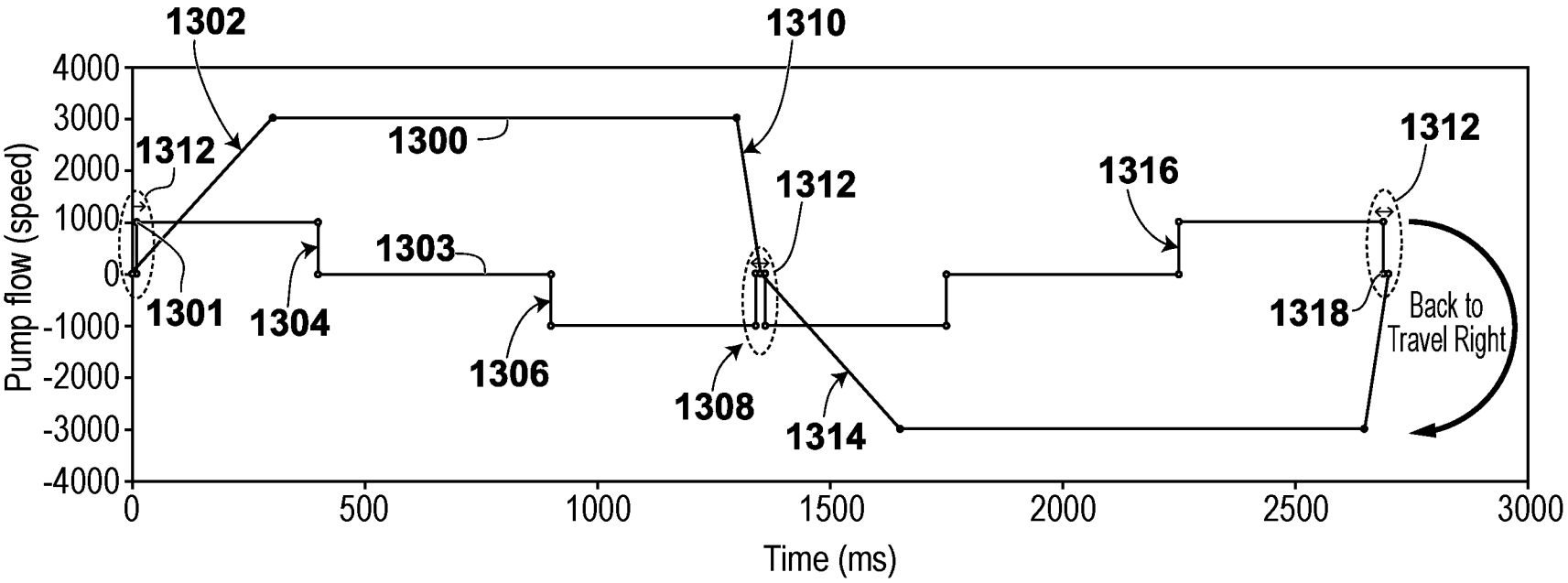
FIG. 13 is a graphical depiction of waveforms for controlling operation of components of the compressor shown in FIG. 10A.

Further details of the operation of controller 200' and pump unit 1174 are discussed below with reference to FIG. 13. In FIG. 13, the line indicated by 1300, 1302, 1310, and

1314 represents the pump flow speed and direction, and the middle line labelled by 1301, 1304, 1303, 1306, 1308, 1312, 1316, and 1318 indicates the sensor on-off states of proximity sensors 157*a*,157*b*. For the sensor states, a positive value indicates that the right proximity sensor 157*b* is on, a negative value indicates that the left proximity sensor 157*a* is on, and a zero value indicates that both sensors are off. FIG. 13 shows the pump speed in a full stroke cycle, where the fluid pressure is applied to drive the pistons towards the right when the speed is above zero and the fluid pressure is applied to drive the pistons toward left when the speed is below zero. As can be seen in FIG. 13, for each half cycle, the pump speed may be ramped up to the selected top speed within about 300 ms, and held constant over an extended period and then ramped down to zero within about 50 ms.

In some embodiments, proximity sensor 157*a* is mounted on and extending within cylinder barrel 187*a*. Proximity sensor 157*a* is operable such that during operation of gas compressor 150', as piston 154*a* is moving from left to right, just before piston 154*a* reaches the position shown in FIG. 3(*i*), proximity sensor 157*a* will detect the presence of a portion of the hydraulic piston 154*a* within hydraulic cylinder 152*a*. Proximity sensor 157*b* may be similarly mounted cylinder barrel 187*b* and used to detect the presence of another portion on piston 154*b*. Based on such detections, the relative position of a piston face 182*a*, 182*b* (as shown in FIG. 10A) near an end of the cylinder (end 1008, 1010) can be derived.

End of stroke indicators 1002*a*, 1002*b* may be omitted in some embodiments, in which case piston positions detected by proximity sensors 157*a*, 157*b* may be used to indicate the pre-defined end of stroke positions.

Sensor 157*a* may send a signal to controller 200' indicating that the sensor 157*a* is on, in response to which controller 200' can take steps to change the operational mode of hydraulic fluid supply system 1160'.

Proximity sensor 157*b* may operate in a similar manner as described with reference to sensor 157*a*.

Controller 200' may be programmed to control hydraulic fluid supply system 1160 in such a manner as to provide for a relatively smooth slowing down, a stop, reversal in direction and speeding up of piston rod 194 along with hydraulic pistons 154*a*, 154*b* and gas piston 182 as piston rod 194, hydraulic pistons 154*a*, 154*b* and gas piston 182 transition between a drive stroke to the right to a drive stroke to the left, and so on.

In some embodiments, proximity sensors 157'*a*, 157'*b* may be implemented using inductive proximity sensors, such as model BI 2--M12-Y1X-H1141 sensors manufactured by Turck, Inc. Inductive sensors are operable to generate proximity signals in response to a portion of piston rod 194 and/or hydraulic pistons 154*a*, 154*b* being proximate to the respective proximity sensors 157*a* or 157*b*. In an embodiment, the proximity sensors may be configured so that the sensor turns on when the sensor is in the proximity of a cut-out section of the piston rod so the sensor does not sense the presence of any piston material (e.g. steel) in its proximity, and turn off when an uncut section of the piston rod or an end of stroke indicator attached to the piston rod is within the proximity of the sensor so the sensor can sense the presence of the uncut section or the end of stroke indicator. The proximity threshold may be about 5 mm. That is, for example, if the end of indicator is within a 5 mm distance from the sensor, the sensor turns off. If there is no piston material (steel) within the 5 mm range, the sensor turns on.

Signals from proximity sensors 157*a*, 157*b* may be used to initiate capture of sensor measurements at other sensors, such as pressure and temperature sensors 1004, 1006.

Referring to FIGS. 11A to 11E, an example of gas piston 182 and hydraulic pistons 154*a*, 154*b*, and corresponding operation of proximity sensors 157*a* and 157*b*, is illustrated, for a period in a stroke of the gas piston 182, showing displacement of hydraulic pistons 154*a* and 154*b* and gas piston 182 of gas compressor 150'. For easy understanding, the pistons and the gas compressor cylinder 180 are separated in FIGS. 11A-11E to better show the relative axial positions of the pistons 182 and 154*a*, 154*b* with regard to cylinder 180 during a stroke.

To provide position indications and trigger state transitions of the proximity sensor 157*a* or 157*b* when the gas piston 182 reaches a respective pre-defined position, an axially extending groove 158*a* is provided near the terminal end of hydraulic piston 154*a* and an axially extending groove 158*b* is provided near the terminal end of hydraulic piston 154*b* (grooves 158*a*, 158*b* are also individually or collectively referred to as groove 158 or grooves 158). Each groove 158 has a near end 159 close to the gas piston 182, which is denoted as 159*a* on hydraulic piston 154*a* and as 159*b* on hydraulic piston 154*b*. Each groove 158 also has a far end 160 away from the gas piston 182, which is denoted as 160*a* on hydraulic piston 154*a* and as 160*b* on hydraulic piston 154*b*. As can be seen, grooves 158*a* and 158*b* are spaced apart, by a selected distance suitable for measuring the piston speed. The grooves 158, including their end positions and the distance between each pair of ends 159 and 160 (i.e. the axial length of the axially extending grooves 158), are configured and positioned to cause the proximity sensors 157 to detect a position of the gas piston 182, such as an end of stroke position, when the far end 160 (e.g. end 160*a*) is in proximity of the corresponding proximity sensor 157 (e.g. sensor 157*a*), and to detect another position of the gas piston 182 when the near end 159 (e.g. end 159*a*) is in proximity of the corresponding proximity sensor 157 (e.g. sensor 157*a*). The position at which the near end 159 is in proximity of the corresponding proximity sensor 157, may represent a transition position to trigger the counting of the lag time, for the purpose to reverse the driving direction of the driving fluid so as to, in time, reverse the direction of travel of the gas piston 182 after the lag time. In other words, this second position may indicate the start of the lag time.

Figures 11A, 11B, 11C, 11D, 11E:
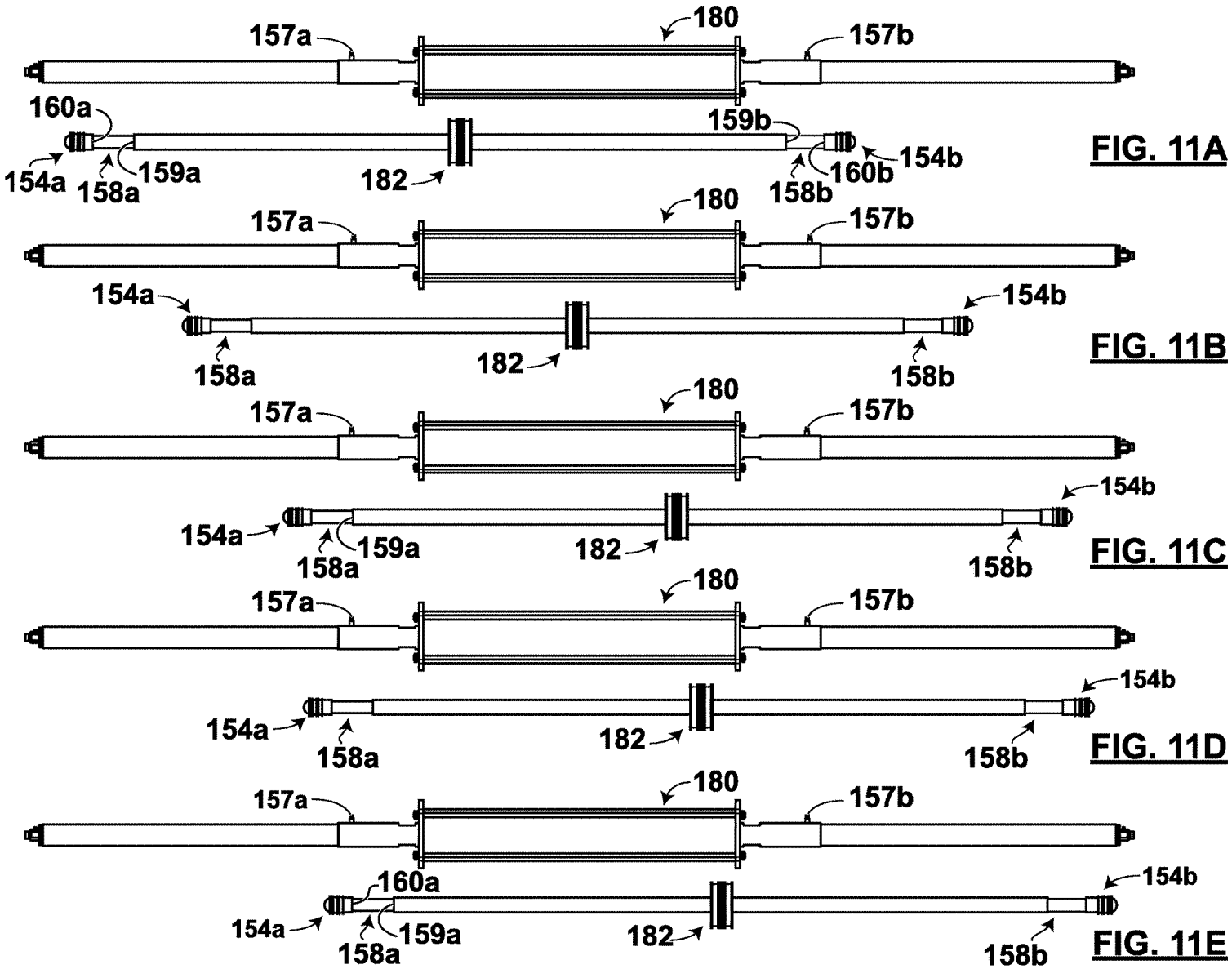
FIGS. 11A, 11B, 11C, 11D, and 11E are schematic views of the gas compressor of FIG. 10A during various stages of a stroke cycle in operation.

As illustrated in FIG. 11A, gas piston 182 and hydraulic pistons 154*a*, 154*b* all travel to the right from an end of stroke position where the far end 160*b* of groove 158*b* is in proximity of proximity sensor 157*b*. The time of this end of stroke position is indicated as 1301 in FIG. 13. At the time shown in FIG. 11B, the proximity sensor 157*b* is in an on-state. At this time, the driving fluid pump is applying a fluid pressure to drive the pistons towards the right as illustrated in FIG. 13 between points 1301 and 1304. As the gas piston 182 and hydraulic pistons 154 continue to travel to the right, and near end 159*b* of groove 158*b* passes proximity sensor 157*b*, and proximity sensor 157*b* transitions from the on-state to the off-state (i.e. turns off). The time of this transition is indicated as 1304 in FIG. 13. This time of transition may also be considered as the (right direction) start time T1 for calculating the piston speed and lag time. Time T1 may be recorded based on an internal clock in the controller 200'. The position of the gas piston 182 at this time T1 may be considered as Position 1 discussed above. In FIG. 11B, gas piston 182 has traveled further right and passed Position 1.

As hydraulic pistons 154*a* and 154*b* and gas piston 182 continue to travel to the right from the position shown in FIG. 11B to the position shown in FIG. 11C, and the near end 159*a* of the groove 158*a* on piston 154*a* reaches a position proximate the left proximity sensor 157*a*, proximity sensor 157*a* senses the physical change and turns on. This transition time is indicated as 1306 in FIG. 13, and may be recorded as T2 and provided to controller 200' for calculating piston speed and lag time. The position of the gas piston 182 at time T2 may be considered as Position 2 discussed above. Time T2 may be considered the (right direction) stop time. As can be appreciated, the distance of travel of gas piston 182 between time T1 and time T2 (or from Position 1 to Position 2) can be calculated based on the distance between near ends 159*a* and 159*b* and the distance between sensors 157*a* and 157*b*, and is a constant. The value of this distance may be stored in controller 200'. Thus, controller 200' can calculate the average travel speed of gas piston 182 based on T1, T2 and the stored distance of travel. At this time, the hydraulic fluid pressure may be measured and stored and the temperature may also be measured and stored. These stored values may be used to calculate the lag time as discussed elsewhere herein.

As can be appreciated, for more accurate determination of the piston speed, the near ends 159 of grooves 158 should be positioned such that T1 and T2 are both within the time period when the pump unit is operating at a constant speed (see 1300 in FIG. 13), so that the pump speed does not change between time T1 and time T2. Conveniently, the groove length of grooves 158 can be adjusted based on the given compressor to meet this condition.

As hydraulic pistons 154*a*, 154*b* and gas piston 182 continue to travel to the right, as shown in FIG. 11D and FIG. 11E, the gas piston eventually reaches a desired end of stroke position, which may be indicated by the far end 160*a* reaching a position in proximity of proximity sensor 157*a*, and triggering a transition of proximity sensor 157*a* from the on-state to the off-state, as illustrated in FIG. 11E. At this time, gas piston 182 is located proximal to the right end of gas compression cylinder 180. After the desired end of stroke position is reached, both sensors 157*a* and 157*b* may be in the off-state for a short period of time (indicated at 1308 in FIG. 13).

After the end of stroke is detected, the pump unit is continued to be operated at the same direction for the duration of the determined lag time (see 1300 in FIG. 13) before ramping down (see 1310 in FIG. 13) and reversing the pumping direction (see 1314 in FIG. 13) to move hydraulic pistons 154*a*, 154*b* and gas piston 182 in an opposite (left in this case) direction. The reversal of the pumping direction may include a deceleration phase in the same direction (e.g. from +X to 0 in 50 ms) and an acceleration phase in the opposite direction (e.g. from 0 to −X in 300 ms).

The actual time of the pump reversal (or end of stroke) may be stored and used to compare to the target time for the end of stroke for determining if the lag time for the next stroke should be extended or shortened.

While not expressly illustrated, the second half cycle of the piston stroke towards the left is similar to the half cycle to the right, but with the direction reversed.

Figure 15A:
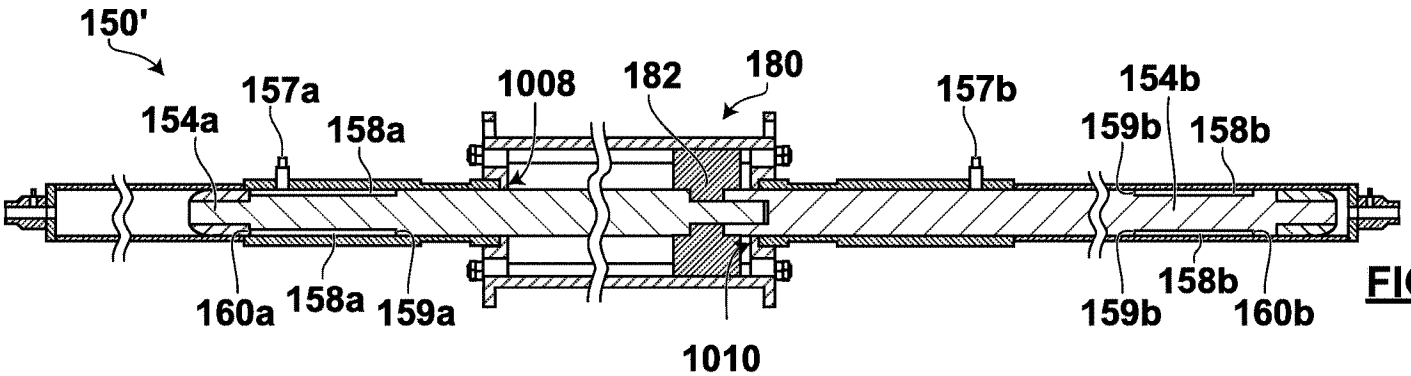
FIGS. 15A, 15B, and 15C are side views of the gas compressor shown in FIG. 10A, during various stages of movement of the gas piston and hydraulic pistons of FIG. 10A.
Figure 15B:
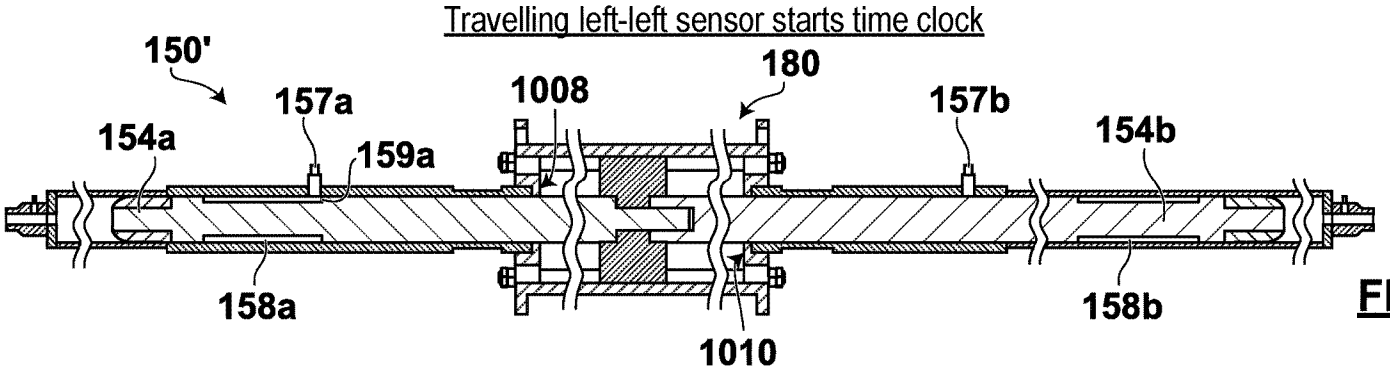
Figure 15C:
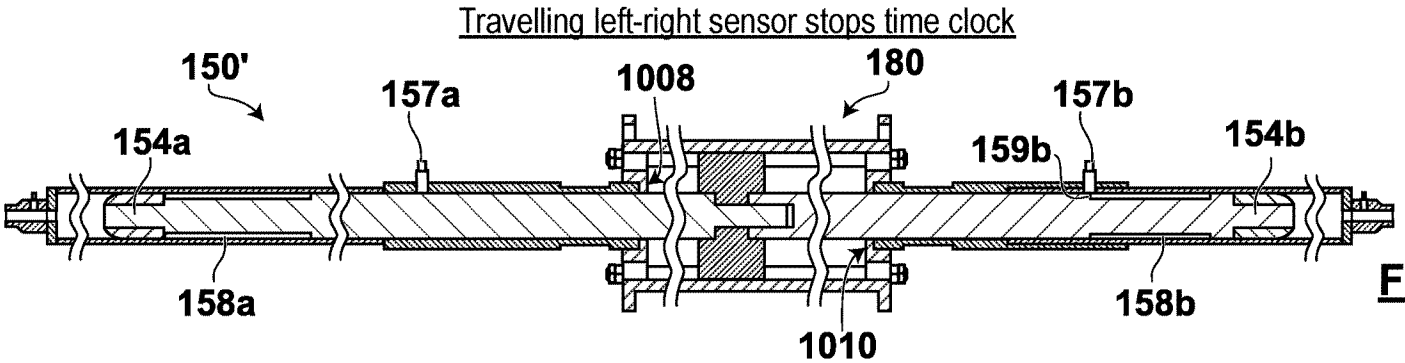

FIGS. 15A, 15B and 15C show schematic side views of gas compressor 150' during an example cycle of operation of hydraulic pistons 154*a*, 154*b* and gas piston 182. In FIG. 15A, the right end of stroke of hydraulic piston 154*b* has been confirmed. As can be seen, gas piston 182 positioned within gas compression cylinder 180 has reached a pre-defined distance from a second end 1010 of the gas compression cylinder (e.g. ⅝"). Subsequently, controller 200' generates a control signal to provide driving fluid to gas compressor 150' as discussed above to cause gas piston 182 to travel to the left. Once left proximity sensor 157*a* detects hydraulic piston 154*a*, proximity sensor 157*a* then turns on (see FIG. 15B). As pistons 182, 154*a*, and 154*b* travel to the left as shown in FIG. 15C, right proximity sensor 157*b* then senses an end portion of hydraulic piston 154*b* and turns on. Controller 200' is configured to capture the time for left sensor 157*a* turning on in FIG. 15B as t1 and the time for right sensor 157*b* turning on in FIG. 15C as t2 such that the difference in time between t1 and t2 is used to calculate the speed of piston 182 as further discussed below.

Figure 16:
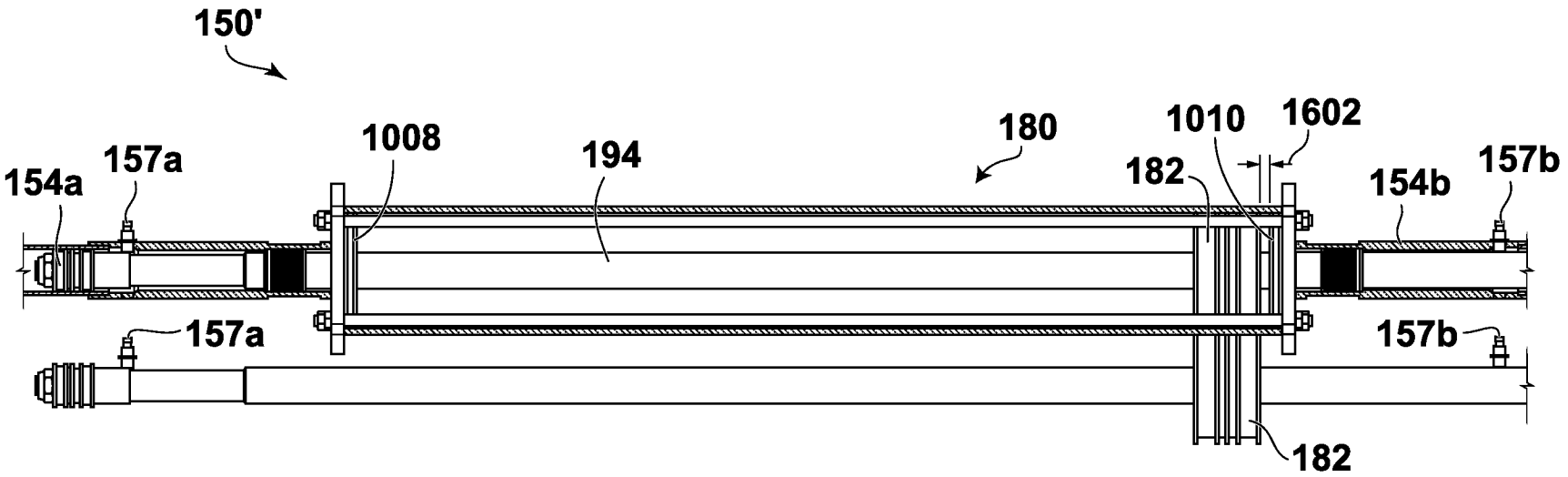
FIG. 16 is a schematic view of the gas compressor of FIG. 10A during one stage of operation.

FIG. 16 shows a schematic side view of the interior of the gas compressor 150'. As shown in FIG. 16, once gas piston 182 reaches a pre-defined desired distance (e.g. 0.5") shown at element 1602 from an end of gas compression cylinder 180, both proximity sensors 157*a* and 157*b* are turned off and piston rod 194 has stopped moving, this is considered as the end of a stroke in one direction such that piston rod 194 will start to move in an opposite direction for the next stroke.

As will be discussed below with respect to FIG. 10A and FIG. 14, proximity sensors 157*a*, 157*b* are used to indicate the times at which a particular part of gas piston 182 arrives at a position proximate the respective proximity sensor during a stroke and the sensed signal from proximity sensors 157*a*, 157*b* can be used to determine the (average) speed of the piston during a stroke and the time when piston 182 reached a predefined end position at or near the end of stroke. Additionally, as will be discussed with reference to FIG. 14, when proximity sensors 157*a*, 157*b* are triggered at different times, additional measurements may be taken (e.g. temperature and pressure signals may be detected and recorded) for adjusting the lag time values. The additional measurements are provided to controller 200' to modify the operation of hydraulic fluid supply system 1160' and thus gas compressor 150' for subsequent strokes to account for changes in temperature, and load pressure.

The following provides a description of the values captured by gas compressor 150' via end of stroke indicators 1002*a*, 1002*b*; proximity sensors 157*a*, 157*b*; pressure sensor 1004 and temperature sensor 1006 (FIG. 10A) in order to calculate corresponding lag time values via controller 200' (FIG. 10A) and modify the operation of gas compressor 150' for subsequent strokes based on the overall lag time determined from the corresponding lag time values.

Lag Time Calculation

The total lag time calculation, as discussed herein, may be used to determine a time delay after an indicated end of stroke of a first hydraulic piston (e.g. 154*b*) in one direction (e.g. after both proximity sensors 157*a*, 157*b* have experienced a state transition before initiating a displacement signal from controller 200' to supply driving fluid to one of hydraulic fluid cylinders 152*a*, 152*b* such as to cause the transition of movement of a piston (e.g. piston 154*a*) in an opposite direction. A state transition of the sensor may be from OFF to ON or from ON to OFF. The ON or OFF information of each sensor may also be used by controller 200' to determine or process control signals. Examples of the time delay are shown at 1308 and 1318 in FIG. 13 such that after end of a stroke of the piston 182, once the previously determined lag time expires, pump 1174 signal is ramped in the reverse direction of the previous stroke. Ideally, it is desirable to start ramping up pump unit 1174 before gas piston 182 reaching the physical end of stroke.

For example, by using the lag time, controller 200' may cause hydraulic piston 154*b* to traverse past the respective proximity sensor 157*b* by a pre-defined distance in order to achieve a full stroke for the gas compressor 150', such that gas piston 182 is located proximal to one end of gas compression cylinder 180 (see FIG. 16).

As will be described below, controller 200' is programmed to calculate speed, pressure and temperature measurements (from sensed position information received from proximity sensors 157*a*, 157*b*, pressure sensor information from pressure sensor 1004 and temperature sensor information from temperature sensor 1006) from for gas compressor 150' in order to determine the lag time calibration parameters.

End of stroke indicators (1002*a*, 1002*b*) shown in FIG. 10A may also be communication with controller 200' to provide additional flags. For example, end of stroke indicators 1002*a*, 1002*b* provide signals indicating a piston end for hydraulic pistons 154*a*, 154*b* has reached a desired end of stroke position (e.g. a position located about half inch from the end of stroke of hydraulic piston 154*a*, 154*b*).

For example, if end of stroke indicators 1002*a*, 1002*b* indicate that a desired end of stroke has been reached in a previous stroke, then no adjustment is made to the lag time. Conversely, if a physical end of stroke is reached (e.g. such that a piston face 182*a* or 182*b* hits a respective end 1010 or 1008 of gas compression cylinder 180) then the overall lag time calibration is adjusted such that a second fixed predetermined value (e.g. 25 ms) is deducted from the previously defined lag time value so that on the next stroke, hydraulic pistons 154*a* and 154*b* do not travel as far. Similarly, on a subsequent stroke if the end of stroke indicator indicates that it has not been activated (e.g. a desired end of stroke has not been reached), then the lag time is increased by the first pre-defined amount of time (e.g. 1 ms) until the end of stroke is reached. In this manner, controller 200' allows automated self-calibration of the lag time.

In at least some embodiments, proximity sensors 157*a*, 157*b* may be used to determine when a desired end of stroke for piston 182 has been reached such that end of stroke indicators 1002*a* and 1002*b* are not used.

In addition to the end of stroke indicators, speed, pressure and temperature measurements (as obtained from sensors 1004, 1006 and based on proximity sensors 157*a*, 157*b*) are calculated and used to tailor the lag time at the end of each stroke to ensure that a full stroke is obtained for maximum gas compression of gas compressor 150'.

Speed Measurements

Figure 12:
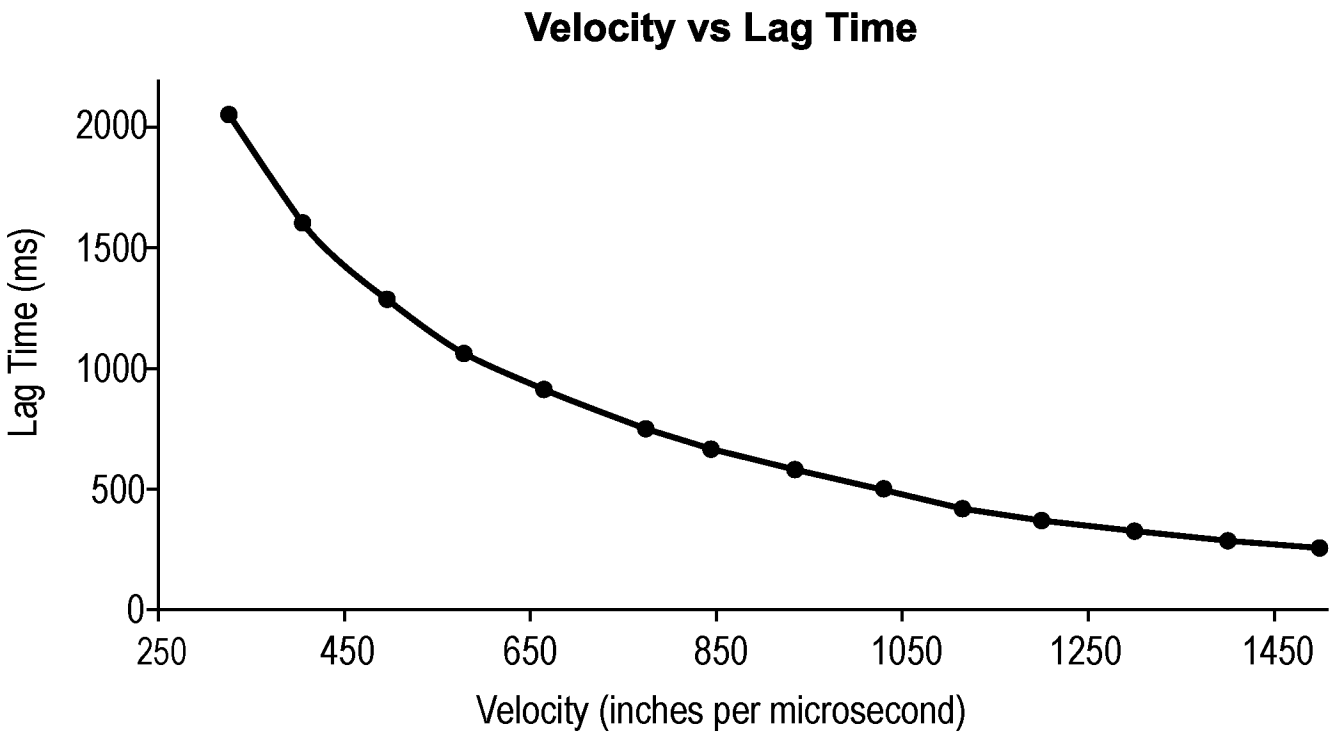
FIG. 12 is a graph illustrating a lag time factor associated with changes in velocity of a piston stroke in the gas compressor of FIG. 10A.

Referring to FIGS. 10A, 13 and 15A-15C, to calculate speed, controller 200' may be configured to capture a first time value for the start time (1301, FIG. 13) that a first sensor 157*a* is turned on (e.g. a negative transition, see FIG. 15B) and then capture a second value for the time that second sensor 157*b* (see FIG. 15C) is turned on (see 1306, FIG. 13). The speed is calculated as the difference between the first and second time values divided by a fixed distance between first proximity sensor 157*a* and second proximity sensor 157*b* (e.g. 35" distance). This result provides the average speed for a particular stroke and is calculated by controller 200'. The average speed is then mapped to predefined values for lag time associated with the speed (see FIG. 12) and used to calculate a first lag time value based on the mapping (e.g. Lag (V)).

Hydraulic Pressure Measurements

Referring to FIG. 10A, a hydraulic gas pressure transducer 1004 may be located on each of the P port and the S port of the pump unit 1174. Each of gas pressure sensor/transducers 1004 may be in electronic communication with controller 200' and provide a signal to controller 200' for calculating the driving pressure (or load pressure) based on the pressure differential between the pressures at the P and S port (or in lines 1163*a* and 1163*b*) respectively. In response to receiving such signals, the controller 200' calculates the hydraulic pressure difference as: Load Pressure=Absolute value of (Pressure P−Pressure S). The pressure values P and S are measured at the time that the second proximity sensor is turned on (e.g. sensor 157'*a* when piston 182 stroke is moving to the right). For example, the calculated pressure difference may provide an indication of the amount of work being performed by gas compressor system 100 with gas compressor 150'. The absolute load pressure value is then used by controller 200' to calculate a second lag time value (e.g. Lag(LP)) based on a previously determined relationship between pressure values and lag times for gas compressor 150'. This second lag time value is then used by controller 200' to modify the operation of gas compressor 150' for subsequent strokes as discussed below in calculating the overall lag time value. Generally speaking, the higher the load pressure, the harder compressor 150' is operating (e.g. hydraulic pistons 154*a*, 154*b* run slower). Thus, the higher the measured hydraulic pressure difference (between lines 1163*a* and 1163*b*), the higher the lag time value (e.g. Lag (LP)) associated with the pressure measurement in order to achieve a full stroke of hydraulic piston (e.g. 154*a*, 154*b*).

In alternative embodiments, it may not be necessary to measure the absolute pressure differential between the two ports P and S. For example, in a different embodiment, the driving fluid may be provided with an open fluid circuit, and a directional valve may be used to alternately apply a positive pressure on one or the other of the two hydraulic pistons 154*a* or 154*b*. In this case, a single pressure sensor in the fluid supply line upstream of the directional valve may be sufficient to provide the pressure load measurement.

Driving Fluid Temperature Measurement

Gas compressor 150' further comprises at least one temperature sensor 1006 (FIG. 10A) for measuring the temperature of the hydraulic driving fluid contained therein (e.g. within chambers 152*a*, 152*b*) on a continuous basis. An example of a suitable temperature sensor may be Parker IQAN 20073658.

Generally speaking, based on prior experimental data, the hydraulic fluid temperature may typically range from 15° C. to 35° C. Therefore, in one embodiment, 35° C. may be used as a base reference point, where the lag adjustment is set at 0 ms. The output lag time associated with the temperature (e.g. the lag time contribution from the temperature value) may be −125 ms at 15° C. Lag times at other temperatures may be extrapolated based on linear relationship from these two points.

Without being limited to any particular theory, it is expected that when the driving fluid is cooler, its viscosity increases and provides more resistance to movement of hydraulic piston 182. As a result, hydraulic piston 154*a*, 154*b* moves slower at lower temperatures. The lag time variable associated with the temperature is used to account for such change. Based on the sensed temperature (as provided by temperature sensor 1006), a third lag time value (e.g. Lag(FT)) may be determined as described above. This third lag time value (e.g. Lag (FT)) is then used by controller 200' to modify the operation of hydraulic fluid supply system 1160' or hydraulic pump unit 1174 for supplying the driving fluid to drive subsequent strokes as discussed below in calculating the overall lag time value.

Total Lag Time (LT)

As noted above, during a stroke, the lag time values may be calculated for each of the first, second and third lag time values (associated respectively with the speed of the gas piston (V), the load pressure applied to the gas piston (LP), and the temperature of the driving fluid (FT)) and are then used to calculate an overall lag time value as discussed above and further illustrated below.

For example, when the gas piston 182 is in a stroke moving towards the right hand side as shown in FIG. 11(A)-11(E), the overall lag time provides a delay time between the time (T2) when the second proximity sensor 157*a* is turned on (which indicates gas piston 182 has reached a predefined position, Position 2, in the stroke path) and the time to start ramping up hydraulic pump unit 1174 to apply a driving force in the opposite direction to drive gas piston 182 towards the left hand side. It is expected that after the lag time has elapsed, the speed of gas piston 182 will decelerate down to zero.

Conceptually, as shown in FIG. 13, when travelling in one direction, after the second proximity sensor turns on (see 1306 in FIG. 13), then both sensors turn off for a brief period of time (see 1308 in FIG. 13). Hydraulic fluid supply system 1160' is configured to delay for a period of time (lag time) which is equivalent to $LT_V+LT_{FT}+LT_{LP}$, where, using the notations above, $LT_V=f(V)$, $LT_{FT}=f(FT)$, and $LT_{LP}=f(LP)$. As discussed above, $LT_V$ may be determined based on the average speed of piston 182 during the previous stroke.

An example calculation of the lag time (LT) is provided below for illustration purposes.

Lag Time Contribution for Speed (V)

In this example, the average speed of piston 182, which may be indicated by V (=D/ΔT) as discussed above, or by corresponding values of stroke per minute, is mapped to predetermined lag time values based empirical data and adjusted during operation, as illustrated in Table I.

Table I is an example mapping table for illustrating the relationship between the average stroke speed of gas piston 182 (e.g. in strokes per minute), the average speed (V) of gas piston 182 (in inch/μs), and the lag time contribution $LT_V$ or f(V) in ms. The data listed in Table I correspond to the data points shown in FIG. 12.

TABLE I

| Strokes per minute | V (inch/μs) | $LT_V$ (ms) |
|---|---|---|
| 8.5 | 1500 | 255 |
| 8.0 | 1400 | 290 |
| 7.5 | 1300 | 330 |
| 7.0 | 1200 | 375 |
| 6.5 | 1115 | 425 |
| 6.0 | 1030 | 500 |
| 5.5 | 935 | 585 |
| 5.0 | 845 | 670 |
| 4.5 | 775 | 750 |
| 4.0 | 665 | 915 |
| 3.5 | 580 | 1060 |
| 3.0 | 495 | 1283 |
| 2.5 | 405 | 1600 |
| 2.0 | 325 | 2050 |
| 1.5 | 0 | 2050 |
| 1.0 | 0 | 2050 |

For the example in Table I, D=35 inches and ΔT is the time period between the triggering signals from the two proximity sensors in each stroke cycle. For each given V, the corresponding $LT_V$ or f(V)) can be directly determined from Table I. A similar mapping table may be stored in a storage media accessible by controller 200'. In some embodiments, during practical implementation, it may be desirable to maintain a minimum stroke speed, such as a minimum of 2 stroke/min (spm). For this reason, the mapping may be adjusted such that the lag time contribution f(V) remains constant for piston speed below a certain threshold so that a minimum average speed of gas piston 182 is maintained, to result in 2 spm. In this case, there may be a wait time so that the net value of piston speed and wait time results in an overall lower speed for gas piston 182, as illustrated in the last two rows (in bold) in Table I. For example, when V=935 in/μs (or 5.5 spm), $LT_V$ is 595 ms from Table I.

Lag Time Contribution for Load Pressure (LP)

In this example, the lag time contribution associated with the load pressure f(LP) may be calculated as:

$$f(LP)=a\times LP+b,$$

where a=0.116959, b=−16.9591, the unit for the lag time is millisecond (ms), and the unit for LP is psi. This formula may be applied in a predefined pressure range, such as from 145 to 1000 psi, within which, the lag time contribution f(LP) changes linearly from 0 ms to 100 ms. As an example, when the LP is 500 psi, the $LT_{LP}$ from this equation is 42 ms.

Lag Time Contribution for Temperature (FT)

In this example, the lag time contribution associated with the fluid temperature f(FT) may be calculated as:

$$f(FT)=d\times FT+e,$$

where d=6.25 and e=−218.75, FT is in ° C., and the lag time is in ms. This formula may be applied in a predefined temperature range, such as from 15° C. to 35° C., with the lag time contribution changing from −125 ms to 0 ms. As an example, when the FT is 30° C., the $LT_{FT}$ from this equation is −31 ms.

Total Lag Time

In the above example, with V=935 in/μs (or 5.5 spm), LP=500 psi, and FT=30° C., the total lag time LT=595+42-31=596 ms.

End of Stroke Indicators

In one embodiment, each end of stroke indicator 1002*a*, 1002*b* may be located at one end of gas compressor 150' and is configured to provide a signal to controller 200' as to whether hydraulic piston 154*a*, 154*b* has traveled to a predefined distance to the terminal end wall of the respective cylinder, e.g. half an inch, which indicates a pre-defined end of stroke position. During operation, if a pre-defined end of stroke position (the desired full stroke) has not been reached, controller 200' performs calibrations to adjust the mapping or algorithm for determining the speed contribution to the lag time in subsequent strokes of gas piston 182 such that the pre-defined end of stroke position is more likely to be reached in the next stroke. For example, an additional lag increment of 1 ms may be added to the next total lag time, and the lag time function for the piston speed may be adjusted so that future lag time calculation for the speed contribution will take this information into account. When the speed contribution is determined based on a mapping table, the values in the table may be adjusted.

Figure 14:
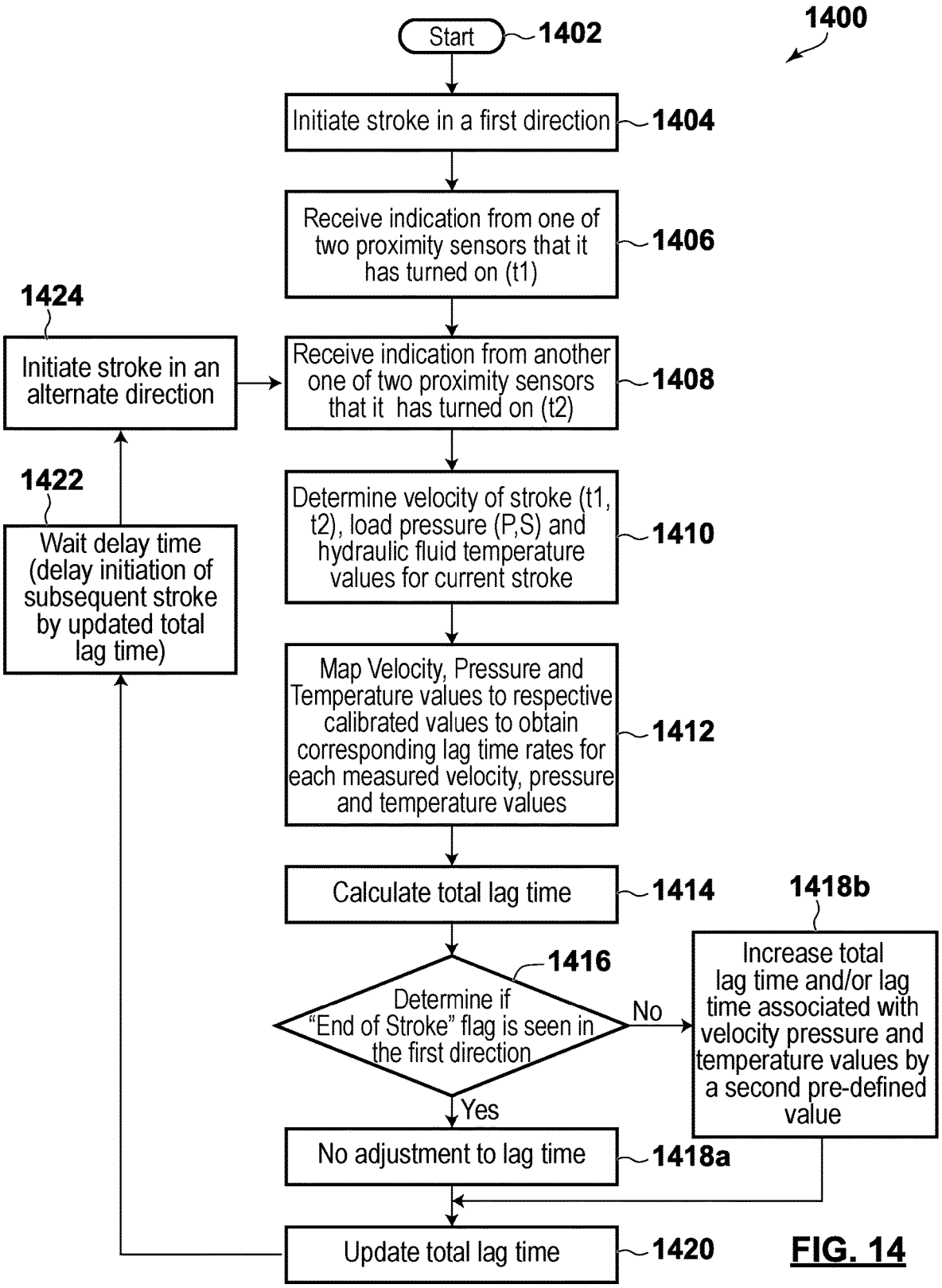
FIG. 14 is a process flowchart showing blocks of code for directing the controller of FIG. 10A to control the operation of the piston strokes of the gas compressor shown in FIG. 10A.

Referring to FIGS. 10A and 14, a process for self-calibrating gas compressor 150' to achieve full longitudinal strokes of gas piston 182 and hydraulic pistons 154*a* and 154*b* is shown at 1400. The process 1400 begins at block 1402 when an operator causes gas compressor 150' to start operation in response to receiving the start signal at an input. As shown at block 1404, controller 200' performs a startup process. In one embodiment, the startup process involves controller 200' producing a displacement control signal which causes movement of the gas piston 182, hydraulic pistons 154*a* and 154*b* in a first direction (e.g. to the right). As shown at 1406, the time that an indication is received from a first proximity sensor (e.g. 157*b*) that it has turned on is recorded as t1 (e.g. in response to sensing proximity of a portion of hydraulic piston 154*b*) and the time that a second proximity sensor (e.g. 157*a*) indicates that it has turned on is recorded as t2 (e.g. in response to sensing hydraulic piston 154*a*). Times t1 and t2 are stored by controller 200' (e.g. in a data store, not shown). At block 1410, the speed of a stroke is calculated as discussed above based on t1 and t2 measurements and a fixed distance between the two sensors 157*a* and 157*b*. Additionally, at block 1410, a measurement for pressure is captured by pressure sensor 1004 and provided to controller 200' in order to calculate the absolute pressure calculation noted above. Furthermore, at block 1410, a temperature measurement is captured by temperature sensor 1006 and provided to controller 200'. At block 1412, controller 200' then uses the calculated speed, load pressure and fluid temperature values to map to lag time values associated with each value (e.g. Lag (speed), Lag (pressure), and Lag(temperature). At block 1414, the total lag time value is then calculated by controller 200' as the sum of the lag time values (e.g. Total lag time=Lag (speed)+Lag(pressure)+Lag(temperature)). At block 1416, controller 200' monitors the end of stroke indicators (e.g. 1002*a*, 1002*b*) to determine whether the end of stroke has been reached within a stroke. If yes, then at block 1418*a*, the total lag time remains the same. Further alternately (not illustrated), if a physical end of stroke is reached as determined by a pressure spike in the gas compressor 150', then controller 200' reduces the total lag time is by a first pre-defined value. If no end of stroke flag is detected at 1416, then at block 1418*b*, controller 200' increases the total lag time is by a second pre-defined value. At block 1420, controller 200' updates the total lag time based on the end of stroke indicator. At block 1422, controller 200' implements a delay time equivalent to the determined total lag time at block 1420. This delay is the amount of time it takes to maintain speed and then decelerate piston 182 stroke initiated at block 1404 to a speed of zero. Subsequent to the delay, controller 200' then proceeds to initiate the stroke (movement of hydraulic pistons 154*a*, 154*b* and gas piston 182) in the opposite direction at block 1424.

In one embodiment, the displacement control signal produced by controller 200' (FIG. 10A) for controlling the stroke of piston 182 and hydraulic pistons 154*a*, 154*b* of gas compressor 150' (FIG. 10A) is shown as waveform 1300 in FIG. 13. As shown on waveform 1300, controller 200' generates a first ramped portion 1302 in which the pump control signal is ramped from 0 to +X (pump speed) in 300 ms. As shown on waveform 1303, the movement of hydraulic piston 154*b* to the right causes right proximity sensor 157*b* to turn on.

At time 1304, the movement of piston 154*b* to the right causes right proximity sensor 157*b* to turn off and left proximity sensor 157*a* is triggered on by the movement of hydraulic piston 154*a* to the right at time 1306. At event 1304, a right START time (t1) value is saved.

At time 1306, a right STOP time (t2) value is saved. As noted above, the time values t1 and t2 are used by controller 200' to calculate the speed of piston 182 during movement to the right. Additionally, at time 1306, the hydraulic pressure is captured by pressure sensor 1004 and provided to controller 200'. Further, the temperature of hydraulic fluid flowing through gas compressor 150' is captured by temperature sensor 1006 and provided to controller 200' at time 1306. As discussed above, based on the speed, temperature, and pressure values, controller 200' calculates the total lag time. The total lag time calculated may be associated with movement of piston 182 to the right for use in modifying subsequent strokes to the right and stored within a data store for access by controller 200'.

At time 1308, both left and right proximity sensors 157*a* and 157*b* turn off for a very brief period of time and controller 200' recognizes that the end of stroke (e.g. for the movement of the hydraulic piston 154*b*) has been reached since both sensors are off. At time 1308, controller 200' waits for a previously defined amount of lag time and once the right lag time has expired, the pump control signal causes hydraulic piston 154*b* to decelerate from X to zero, shown as the ramp down portion at 1310, in for example 50 ms. Thus, during this right stroke movement of hydraulic piston 154*b*, the lag time is calculated for the next stroke by controller 200'. If the end of stroke was not reached as determined by end of stroke indicator 1002*a*, then the lag time value is increased by a first pre-defined value. Conversely, the calculated lag time value is decreased by a second pre-defined value if the physical end of stroke is hit which is seen as a hydraulic pressure spike in gas compressor 150'. Controller 200' subsequently generates a negative displacement signal and accelerates hydraulic pistons 154*a*, 154*b* and gas piston 182 to the left such that the pump speed is ramped (accelerated) in the opposite direction from 0 to −X in 300 ms. Left proximity sensor 157*a* turns on with the movement and proximity of hydraulic piston 154*a* and at time 1316, right proximity sensor 157*b* turns on with the movement and proximity of hydraulic piston 154*b*. Also, at time 1316, speed of the left stroke is calculated along with pressure and temperature values respectively received from pressure sensor 1004 and temperature sensor 1006. At time 1318, both proximity sensors 157*a* and 157*b* are off and deceleration of the displacement control signal provided by controller 200' occurs after the previously defined lag time expires. It is noted that time portion 1312 indicates a short time period that both proximity sensors 157*a* and 157*b* are off and thus controller 200' determines that the end of stroke has been reached.

In a modified embodiment, when an end of stroke event, such as a physical end of stroke, has been detected during a stroke, instead of reducing the lag time (LT) by a large value (such as 25 ms) for the next stroke, the LT may be reduced by 1 ms (i.e., −1 ms) in each subsequent stroke until an end of stroke event is no longer detected. Such reduced decrease of LT after detection of end of stroke events may be used throughout the entire operation, or may be used during a selected period of operation. For example, when a physical end of stroke is expected to have occurred due to significant change in operation conditions or other external factors, a larger deduction in LT may be helpful. When an end of stroke event is expected to have occurred due to slight over-adjustment of the LT in the previous stroke, a smaller reduction in LT for the next stroke may provide a more smooth operation and quicker return to optimal operation. In further embodiments, an automatic reduction of 1 ms from the LT may also be implemented as long as the end of stroke positon is reached during a previous stroke. If in the subsequent stroke, the end of stroke position is again reached, the LT is reduced further by 1 ms. However, if in the subsequent stroke, the end of stroke position is not reached, the LT may be then increased by 1 ms. In this manner, a more smooth operation may be achieved in at least some applications, and possible physical end of strokes due to slow drifting operating conditions may be avoided.

Various other variations to the foregoing are possible. By way of example only—instead of having two opposed hydraulic cylinders each being single acting but in opposite directions to provide a combined double acting hydraulic cylinder powered gas compressor:

- a single but double acting hydraulic cylinder with two adjacent hydraulic fluid chambers may be provided with a single buffer chamber located between the innermost hydraulic fluid chamber and the gas compression cylinder;
- a single, one way acting hydraulic cylinder with one hydraulic fluid chamber may be provided with a single buffer chamber located between the hydraulic fluid chamber and the gas compression cylinder, in which gas in only compressed in one gas compression chamber when the hydraulic piston of the hydraulic cylinder is moving on a drive stroke.

In alternative embodiments, the grooves 158 on hydraulic pistons 154 as illustrated in FIGS. 11A-11E may be used to provide signals for controlling the reversal of the gas piston 182 wihtout measuring or calculating some or all of the speed of travel of gas piston 182, the load pressure on the hydraulic pistons, and the temperature of the driving fluid. Instead, respective ends of the grooves 158 may be used in combination with the corresponding proximity sensors 157 to set a reversal time when a first end of the grooves 158 is within proximity of the corresponding proximity sensor 157, with a selected lag time or ramp time. The lag time may be initially set for a default value, and is increased or decreased incrementally in subsequent strokes depending on whether in the previous stroke, the other proximity sensor 157 detects the presence of the other end of the groove within its proximity. In this sense, the first end of the groove may be considered an reversal or turnaround indicator, and the second end of the groove may be considered an end-of-stroke indicator.

In further alternative embodiments, the hydraulic pistons 154 as illustrated in FIGS. 11A-11E may be modified to provide more than two grooves, or multiple grooves on each hydraulic piston, which are axially aligned along the piston axis. When multiple grooves are provided, one or two ends of different grooves may be used to provide the reversal and end-of-stroke signals. For example, the particular ends (active ends) of the grooves that are selected to provide or calculate the reversal time may be determined based on the operation speed of the gas piston, such as the number of strokes per minute. For instance, when the operation speed is higher, the selected active ends may be separated by more grooves in between; and when the operation speed is lower, fewer grooves are between the selected active ends. In an example embodiment, the reversal or turnaround time may be determined by counting the number grooves that pass by a particular proximity sensor during a stroke. To illustrate, assuming there are N grooves on a hydraulic cylinder, when the compressor is operated at the full speed, the piston reversal or turnaround time may be triggered or determined once (N−M) grooves have passed the proximity sensor and have been counted by the controller, where M is less or equal to N. That is, M grooves have been skipped at full speed. At half speed, the reversal or turnaround may be triggered when (N-M/2) grooves have been counted (with M/2 grooves being skipped). At the minimum speed, all N grooves may be counted before the reversal or turnaround. The number of skipped grooves may be reduced gradually or incrementally as the operation speed decreases, and may be proportional to the operation speed.

In an embodiment, a method of adaptively controlling a hydraulic fluid supply to supply a driving fluid for applying a driving force on a piston in a gas compressor is provided. The driving force is cyclically reversed between a first direction and a second direction to cause the piston to reciprocate in strokes. The method includes monitoring, during a first stroke of the piston, a speed of the piston, a temperature of the driving fluid, and a load pressure applied to the piston; and controlling reversal of the driving force after the first stroke based on the speed, load pressure, and temperature, wherein controlling reversal of the driving force comprises determining a lag time before reversing the direction of the driving force, and delaying reversal of the driving force by the lag time; monitoring whether the piston has or has not reached a predefined end position during a previous stroke; and in response to the piston not reaching the predefined end position during the previous stroke, increasing the lag time by a pre-selected increment. The speed of the piston may be monitored using proximity sensors. The pre-selected increment may be 1 millisecond. The method may further include monitoring an end of stroke event; and in response to occurrence of the end of stroke event, decreasing the lag time by a sufficient amount to avoid recurrence of the end of stroke event in subsequent strokes. The lag time may be decreased as the temperature decreases below a temperature threshold. The lag time may be increased as the load pressure increases. The lag time may be increased by an amount linearly proportional to the load pressure. The gas compressor may be a double-acting gas compressor. The gas compressor may comprise a gas cylinder and first and second hydraulic cylinders; wherein the gas cylinder comprises a gas chamber for receiving a gas to be compressed and having a first end and a second end, and each of the first and second hydraulic cylinders comprises a driving fluid chamber for receiving the driving fluid; and wherein the piston comprises a gas piston reciprocally moveable within the gas chamber for compressing the gas received in the gas chamber towards the first or second end; and a hydraulic piston moveably disposed in each driving fluid chamber and coupled to the gas piston such that reciprocal movement of the hydraulic piston causes corresponding reciprocal movement of the gas piston. The speed of the piston may be monitored using first and second proximity sensors positioned and configured to respectively generate a first signal indicative of a first time (T1) when a first part of the piston is in a proximity of the first proximity sensor, and a second signal indicative of a second time (T2) when a second part of the piston is in a proximity of the second proximity sensor, whereby the speed of the piston may be calculable based on T1, T2 and a distance between the first and second proximity sensors, and wherein the load pressure may be measured at T1 or T2. The temperature of the driving fluid may be monitored using a temperature sensor mounted in the gas compressor or in the hydraulic fluid supply. The hydraulic fluid supply may include a hydraulic pump having first and second ports for supplying the driving fluid and applying the driving force, and wherein the load pressure may be monitored by monitoring a fluid pressure differential between the first and second ports.

In various other variations a buffer chamber may be provided adjacent to a gas compression chamber but a driving fluid chamber may be not immediately adjacent to the buffer chamber; one or more other chambers may be interposed between the driving fluid chamber and the buffer chamber—but the buffer chamber still functions to inhibit movement of contaminants out of the gas compression chamber and in some embodiments may also protect a driving fluid chamber.

In other embodiments, more than one separate buffer chamber may be located in series to inhibit gas and contaminants migrating from the gas compression chamber.

One or more buffer chambers may also be used to ensure that a common piston rod through a gas compression chamber and hydraulic fluid chamber, which may contain adhered contamination from the gas compressor, is not transported into any hydraulic fluid chamber where the hydraulic oil may clean the rod. Accumulation of contamination over time into the hydraulic system is detrimental and thus employment of one or more buffer chambers may assist in reducing or substantially eliminating such accumulation.

When introducing elements of the present invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Of course, the above described embodiments are intended to be illustrative only and in no way limiting. The described embodiments of carrying out the invention are susceptible to many modifications of form, arrangement of parts, details, and order of operation. The invention, therefore, is intended to encompass all such modifications within its scope.

The invention claimed is:

1. A control system for adaptively controlling a fluid supply to supply a driving fluid for applying a driving force on a reciprocating piston the driving force being cyclically reversed between a first direction and a second direction to cause the piston to reciprocate in strokes, the system comprising:

first and second proximity sensors positioned and configured to respectively generate a first signal indicative of a first time (T1) when a first part of the piston is in proximity of the first proximity sensor, and a second signal indicative of a second time (T2) when a second part of the piston is in a proximity of the second proximity sensor, whereby a speed of the piston during a first stroke of the piston is calculable based on T1, T2 and a distance between the first and second proximity sensors;

one or more pressure sensors positioned and configured to generate a signal indicative of a load pressure applied on the piston;

a temperature sensor positioned and configured to generate a signal indicative of a temperature of the driving fluid; and a controller configured to receive signals from said sensors and for controlling the fluid supply to control reversal of the driving force based on the speed of the piston, the temperature of the driving fluid, and the load pressure applied to the piston during the first stroke.

2. The system of claim 1, wherein the controller is configured to determine a lag time before reversing the direction of the driving force, and to delay reversal of the driving force by the lag time after T2.

3. The system of claim 2, further comprising an indicator positioned and configured for generating an end of stroke signal when the piston has reached a predefined end position in the first stroke, wherein the controller is configured to, in response to not receiving the end of stroke signal during the first stroke, increase the lag time by a pre-selected increment.

4. The system of claim 3, wherein the pre-selected increment is 1 millisecond.

5. The system of claim 3, wherein the indicator for generating the end of stroke signal is a third proximity sensor.

6. The system of claim 2, wherein the controller is further configured to determine if an end of stroke event has occurred based on a change in the load pressure; and in response to occurrence of the end of stroke event, to decrease the lag time by a sufficient amount to avoid recurrence of the end of stroke event in subsequent strokes.

7. The system of claim 2, wherein the controller is configured to decrease the lag time when the temperature decreases below a temperature threshold.

8. The system of claim 2, wherein the controller is configured to increase the lag time when the load pressure increases.

9. The system of claim 8, wherein the lag time is increased by an amount linearly proportional to the load pressure.

10. The system of claim 1, wherein the piston comprises first and second axially extending and spaced apart grooves each having an end, and wherein each one of the first and second parts of the piston is one of the ends of the first and second grooves.

11. The system of claim 10, wherein each one of the first and second grooves has another end configured and positioned to cause a respective one of the first and second proximity sensors to generate a signal indicative of an end of stroke position of the piston when the other end is in proximity of the respective one of the first and second proximity sensors.

12. A gas compressing system comprising:

a gas compressor comprising a gas chamber for receiving a gas, having a first end and a second end; a gas piston reciprocally moveable in the gas chamber for compressing the gas towards the first or second end;

a hydraulic fluid source for supplying a hydraulic fluid to apply a driving force to the gas piston, the driving force cyclically reversible between a first direction and a second direction to cause the gas piston to reciprocate in strokes; and a control system according to claim 1 for controlling the hydraulic fluid source and the driving force applied to the gas piston, wherein the gas piston is the reciprocating piston, the hydraulic fluid source is the fluid supply and the hydraulic fluid is the driving fluid.

13. The gas compressing system of claim 12, wherein the gas compressor is a double-acting gas compressor.

14. The gas compressing system of claim 12, wherein the gas compressor comprises first and second hydraulic cylinders, each comprising a driving fluid chamber for receiving the driving fluid and a hydraulic piston moveably disposed therein and coupled to the gas piston, such that reciprocal movement of the hydraulic piston causes corresponding reciprocal movement of the gas piston, the hydraulic piston comprising an axially extending groove having an end configured and positioned to function as one of the first and second parts of the piston.

15. The gas compressing system of claim 13, wherein the groove has another end configured and positioned to cause a respective one of the first and second proximity sensors to generate a signal indicative of an end of stroke position of the piston when the other end is in proximity of the respective one of the first and second proximity sensors.

16. The gas compressing system of claim 12, wherein the hydraulic fluid supply comprises a hydraulic pump having first and second ports for supplying the driving fluid and applying the driving force.

17. A gas compressor comprising:

a gas cylinder comprising a gas chamber and a gas piston reciprocally moveable within the gas chamber for compressing a gas in the gas chamber, the gas piston having a first end and a second end;

a first hydraulic cylinder coupled to the gas cylinder adjacent the first end of the gas piston, and a second hydraulic cylinder coupled to the gas cylinder adjacent of the second end of the gas piston, wherein each one of the first and second hydraulic cylinders comprises a driving fluid chamber for receiving a driving fluid and a hydraulic piston moveably disposed in the driving fluid chamber and coupled to the gas piston such that reciprocal movement of the hydraulic piston causes corresponding reciprocal movement of the gas piston, the hydraulic piston comprising an axially extending groove thereon, the groove having a first end and a second end; and a first proximity sensor on the first hydraulic cylinder and a second proximity sensor on the second hydraulic cylinder, for detecting positons and movement of the gas piston, wherein the grooves of the hydraulic pistons and the first and second proximity sensors are configured and positioned to cause a corresponding one of the first and second proximity sensors to generate a signal indicative of a position of the gas piston when one of the first and second ends of the grooves is in proximity of the corresponding proximity sensor.

18. The gas compressor of claim 17, wherein each one of the first ends of the grooves is positioned to indicate an end of stroke position of the gas piston, and the second ends of the grooves are positioned for measuring a speed of the gas piston during a stroke.

19. The gas compressor of claim 18, wherein the first ends of the grooves are far ends away from the gas piston and the second ends of the grooves are near ends close to the gas piston.

20. The gas compressor of claim 17, comprising a controller configured to receive signals from the first and second proximity sensors and for controlling reversal of a driving force applied by the driving fluid based on the signals received from the first and second proximity sensors.

* * * * *